US012339105B1

(12) United States Patent
Maiorano

(10) Patent No.: US 12,339,105 B1
(45) Date of Patent: Jun. 24, 2025

(54) TARGET APPARATUS AND METHOD

(71) Applicant: Giuseppe Maiorano, Newark, NJ (US)

(72) Inventor: Giuseppe Maiorano, Newark, NJ (US)

( * ) Notice: Subject to any disclaimer, the term of this patent is extended or adjusted under 35 U.S.C. 154(b) by 0 days.

(21) Appl. No.: 19/033,003

(22) Filed: Jan. 21, 2025

Related U.S. Application Data

(62) Division of application No. 18/927,397, filed on Oct. 25, 2024, now Pat. No. 12,235,084, which is a division of application No. 18/746,192, filed on Jun. 18, 2024, now Pat. No. 12,163,767.

(51) Int. Cl.
*F41J 5/00* (2006.01)
*F41J 5/26* (2006.01)

(52) U.S. Cl.
CPC ..... *F41J 5/26* (2013.01)

(58) Field of Classification Search
CPC ..... F41J 5/26
USPC ..... 273/283
See application file for complete search history.

(56) References Cited

U.S. PATENT DOCUMENTS

D831,126 S * 10/2018 Goodman-Pollack ..... D21/453

* cited by examiner

*Primary Examiner* — James E McDonough
(74) *Attorney, Agent, or Firm* — Walter J. Tencza, Jr.

(57) ABSTRACT

A target apparatus including: a base; a V-shaped member having first and second ends, the second end connected to the base; a first cleat, configured to connect to one or more inflated balloons, fixed to the V-shaped member; wherein the V-shaped member includes first and second members; the first member having first and second edges; wherein the second member has a first and second edges; wherein the first edges of the first and second members are fixed together; wherein the second edges of the first and second members are separated by a gap; and wherein the first cleat is fixed to the V-shaped member so that at least part of the first cleat is between the first and second members. The target apparatus further includes a first ring fixed to the first V-shaped member so that at least part of the first ring is between the first and second members.

6 Claims, 44 Drawing Sheets

TARGET APPARATUS AND METHOD

CROSS REFERENCE TO RELATED APPLICATION(S)

The present application is a divisional of and claims the priority of U.S. patent application Ser. No. 18/927,397, filed on Oct. 25, 2024, inventor and applicant Giuseppe Maiorano, which is a divisional of and claims the priority of U.S. patent application Ser. No. 18/746,192, filed on Jun. 18, 2024, issued as U.S. Pat. No. 12,163,767 on Dec. 10, 2024, inventor and applicant Giuseppe Maiorano, such that the present application claims the benefit of both Ser. No. 18/927,397 and Ser. No. 18/746,192.

FIELD OF THE INVENTION

This invention relates to devices for targets for shooting at with projectiles, particularly firearm projectiles.

BACKGROUND OF THE INVENTION

There are various known target devices for shooting at with projectiles.

SUMMARY OF THE INVENTION

One or more embodiments of the present invention provide improved target apparatuses, such as improved firearm target apparatuses, which typically may allow for the attachment of one or more balloons. The improved firearm target apparatuses may include metal, steel, plastic, polymer, and/or a combination of these.

In one or more embodiments, The improved target apparatuses may be attached to known existing target apparatuses, such as known existing steel and/or metal target apparatuses.

In one or more embodiments, the improved target apparatuses may be configured to have one or more balloons attached to the improved target apparatuses.

The target apparatuses may be configured to be shot at with projectiles, particularly firearm projectiles or any projectile traveling at low, medium, or high velocities.

In at least one embodiment, a target apparatus is provided which may include: a base; a first V-shaped member having a first end and an opposing second end, wherein the opposing second end is connected to the base; a first cleat fixed to the first V-shaped member; wherein the first V-shaped member includes a first member and a second member; wherein the first member has a first edge and a second edge; wherein the second member has a first edge and a second edge; wherein the first edges of the first and second members are fixed together; wherein the second edges of the first and second members are separated by a gap; and wherein the first cleat is fixed to the V-shaped member so that at least part of the first cleat is between the first and second members.

The first cleat may include a flat portion having a first end and an opposing second end; wherein the first cleat includes a first angled portion fixed at an angle to the first end of the flat portion; and wherein the first cleat includes a second angled portion fixed at an angle to the second end of the flat portion. The first cleat may be configured to have one or more balloons removably attached to the first cleat.

The target apparatus may further include a first ring; and wherein the first ring is fixed to the first V-shaped member so that at least part of the first ring is between the first and second members. The first ring may be fixed to the first V-shaped member closer to the first end of the first V-shaped member than the first cleat. The target apparatus may include a second V-shaped member which is connected to the first V-shaped member.

In at least one embodiment, the target apparatus may include a base; a first V-shaped member having a first end and an opposing second end, wherein the opposing second end is connected to the base; a first plate having a front surface and an opposing rear surface, wherein the first plate is connected to the first V-shaped member at the first end of the first V-shaped member; a first cleat connected to the rear surface of the first plate; wherein the first V-shaped member includes a first member and a second member; wherein the first member has a first edge and a second edge; wherein the second member has a first edge and a second edge; wherein the first edges of the first and second members are fixed together; wherein the second edges of the first and second members are separated by a gap; and wherein the first plate is connected to the first V-shaped member so that when the rear surface of the first plate is visible, the gap is visible, and when the front surface of the first plate is visible, the gap is not visible.

The target apparatus may further include a motor fixed to the rear surface of the first plate; and wherein the first cleat is connected to a shaft of the motor, and the first cleat is configured to rotate with respect to the first plate when the shaft of the motor rotates.

The target apparatus may further include a base; a first flexible member, wherein the first flexible member has a first end and a second opposing end, with the second opposing end is adapted to be removably attached to the base at a first location; a first cleat connected to the first flexible member; and a first ring connected to the first flexible member closer to the first end of the first flexible member than the first cleat.

The target apparatus may include a second flexible member, wherein the second flexible member has a first end and a second opposing end, with the second opposing end of the second flexible member is adapted to be removably attached to the base at a second location, while the second opposing end of the first flexible member is simultaneously removably attached to the base at the first location; a second cleat connected to the second flexible member; and a second ring connected to the second flexible member closer to the first end of the second flexible member than the second cleat.

In at least one embodiment, the target apparatus may include a first plate having a front surface and an opposing rear surface; and wherein the base is fixed to the rear surface of the first plate. The target apparatus may further include a first V-shaped member having a first end and an opposing second end; and wherein the first V-shaped member includes a first member and a second member; wherein the first member has a first edge and a second edge; wherein the second member has a first edge and a second edge; wherein the first edges of the first and second members are fixed together; wherein the second edges of the first and second members are separated by a gap; and wherein the first end of the first V-shaped member is fixed to the first plate so that the rear surface of the first plate is visible when the gap is visible and when the first cleat is visible, and the front surface of the first plate is visible when the gap is not visible, and the first cleat is not visible.

In at least one embodiment, a method is provided, which includes shooting at a target apparatus, such as by firing a projectile from a firearm at the target apparatus, wherein the target apparatus is configured in the various alternatives previously referred to.

DETAILED DESCRIPTION OF THE DRAWINGS

Figure 1:
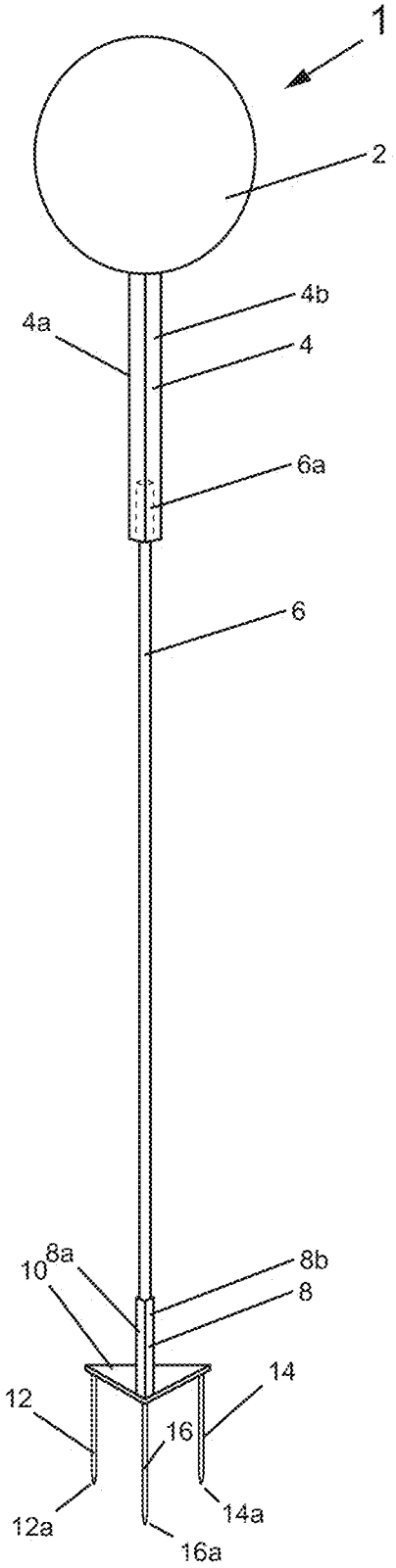
FIG. 1 shows a front and top perspective view of a first target apparatus with an attached first balloon in accordance with an embodiment of the present invention.

FIG. 1 shows a front and top perspective view of a target apparatus 1 with an attached first balloon 2 in accordance with an embodiment of the present invention.

The target apparatus 1 may include an L or V shaped member 4, a rod or member 6, an L or V-shaped member 8, a base 10, and legs 12, 14, and 16. Each of the legs 12, 14, and 16 is fixed at a first end at a right angle, or substantially right angle to the base 10. Each of the legs 12, 14, and 16 has an opposing second end (12*a* for leg 12, 14*a* for leg 14, and 16*a* for leg 16) which may have point, so each of opposing ends 12*a*, 14*a*, and 16*a* may be drive into a horizontal ground surface or into a member such as a wood beam or member.

The L or V-shaped member 4, rod or member 6, and L or V-shaped member 8 may be made of steel or hardened steel. The members 10, 12, 14, and 16 may be made of steel or hardened steel.

Figure 13A:
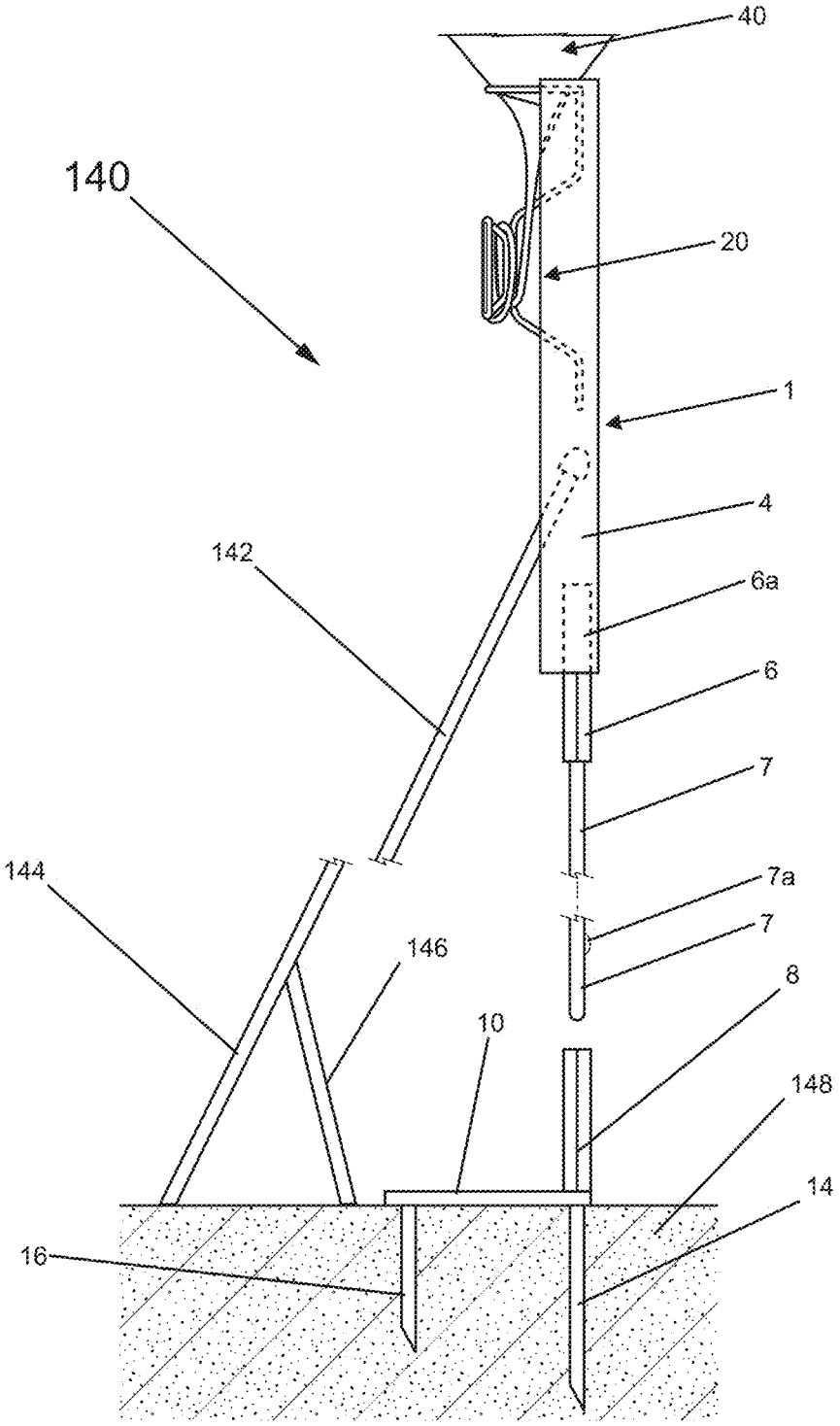
FIG. 13A shows a side view of the embodiment of FIG. 1, with an additional support member, with the first cleat apparatus of FIG. 2A, and with portion of the second balloon shown attached to the first cleat apparatus.
Figure 13B:
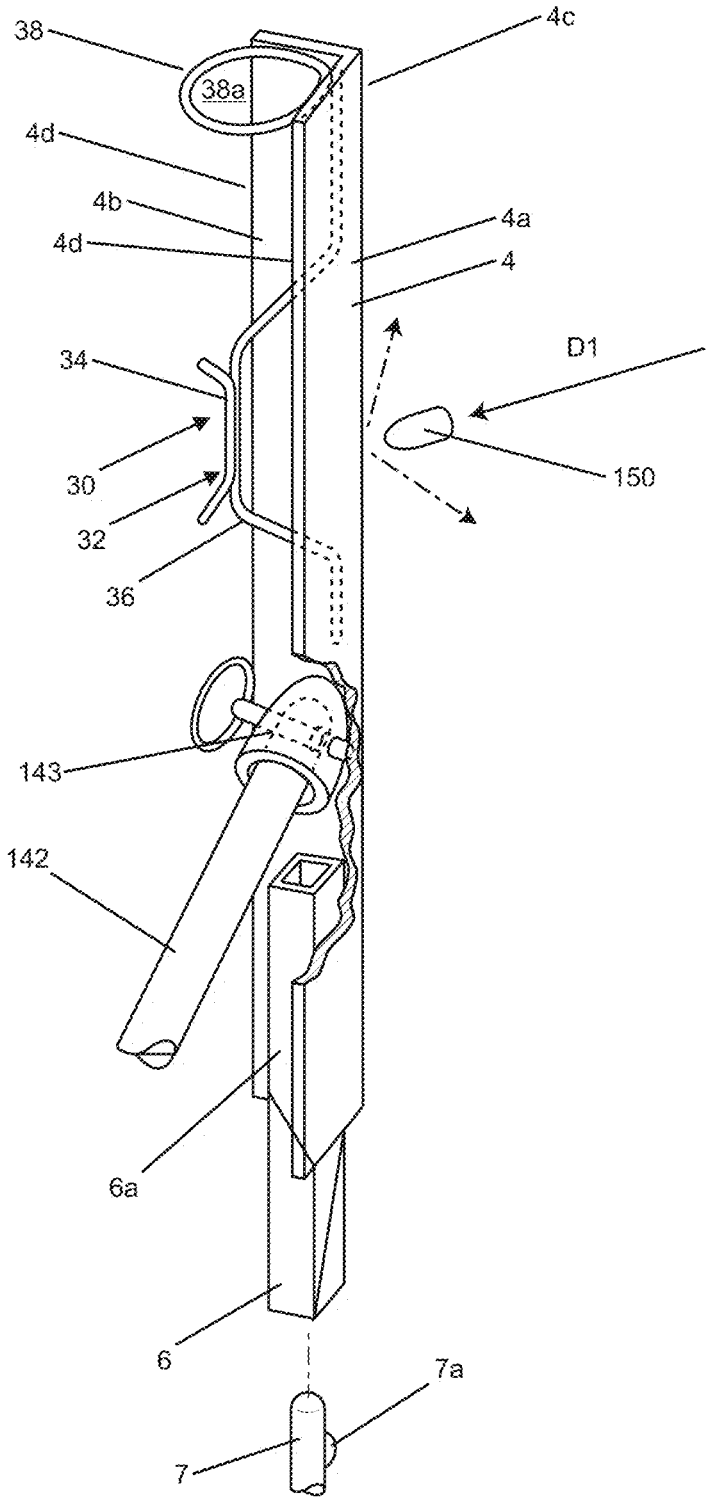
FIG. 13B shows a view of first part of the apparatus shown in FIG. 13A, with some portions shown in a broken away view, and some portions left out, and additionally with a bullet shown approaching the exterior of an L or V-shaped member.

In operation the target apparatus 1 is oriented, similar or identical to as shown in FIG. 13B, with respect to a firearm shooter, so that a bullet or projectile 150, travelling in a direction D1, from a firearm of a firearm shooter, which impacts member 4, will impact the exterior of either member 4*a* or 4*b* or the exterior of the junction 4*c* of the member 4. The members 4*b* and 4*a* are preferably at an angle of between thirty and ninety degrees, and this causes the bullet 150 to be deflected. The cleat apparatus 30 shown in FIG. 13B (or one of the other cleat apparatuses of the present application) is shielded by the members 4*b* and 4*a* from being hit with the projectile 150. The target apparatus 1 is configured so that the bullet or projectile 150 does not pass between end 4*d* of member 4*b* and end 4*d* of member 4*a* and into the interior between members 4*a* and 4*b*, but rather the projectile 150 is deflected away from the member 4. Each of the target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29, also are configured to deflect a projectile in a manner similar or identical to as described with respect to FIG. 13B using one or more L or V-shaped members.

The balloon 2 may be attached to the target apparatus 1 in various ways, as will be described. The balloon 2 may be described as being part of the target apparatus 1, or may be described as being attached to the target apparatus 1.

Figure 2A:
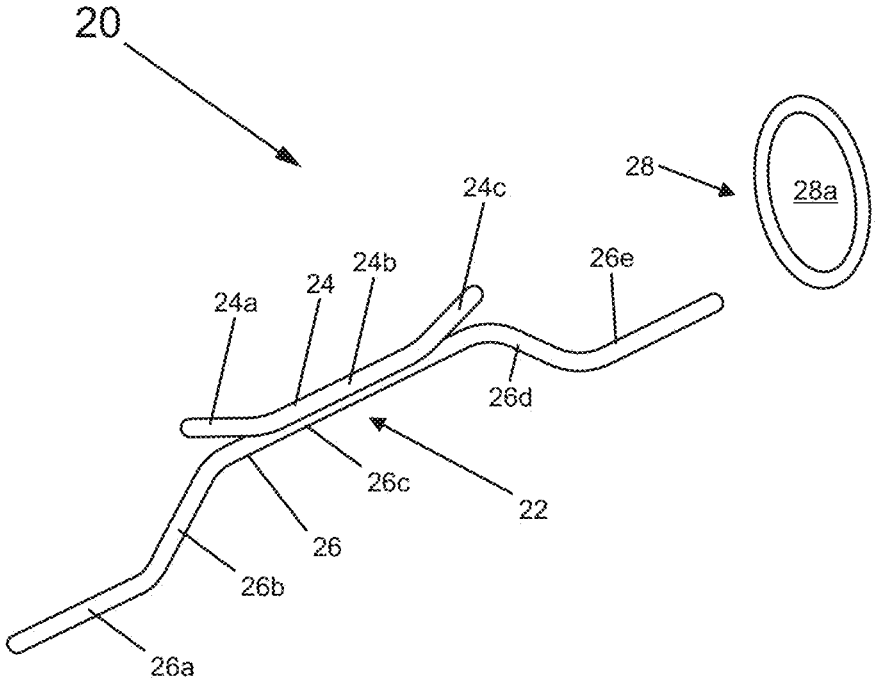
FIG. 2A shows a rear, bottom, and left perspective view of a first cleat apparatus for use with the embodiment of FIG. 1, and for use with other target apparatuses described in the present application.

FIG. 2A shows a rear, bottom, and left perspective view of a cleat or wedge apparatus 20 for use with the embodiment of FIG. 1, and with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29. The cleat apparatus 20 may be made of metal, such as steel, hardened steel or spring steel wire The cleat apparatus 20 may include part, cleat, or wedge 22 and a ring 28. The ring 28 has a central opening 28*a*. The part or cleat 22 includes portions 24 and 26. In FIG. 2A, the ring or loop 28 is shown detached from the cleat 22.

The portion 24 has a central member 24*b*, and inclined members 24*a* and 24*c* which are fixed at an angle with respect to the central member 24*b*. The portion 26 has a central member 26*c*, and inclined members 26*b* and 26*d* which are fixed at an angle with respect to the central member 26*c*. The inclined members 26*b* and 26*d* are fixed to straight members 26*a*, and 26*e*, respectively. The central members 24*b* and 26*c* are fixed together.

Figure 2B:
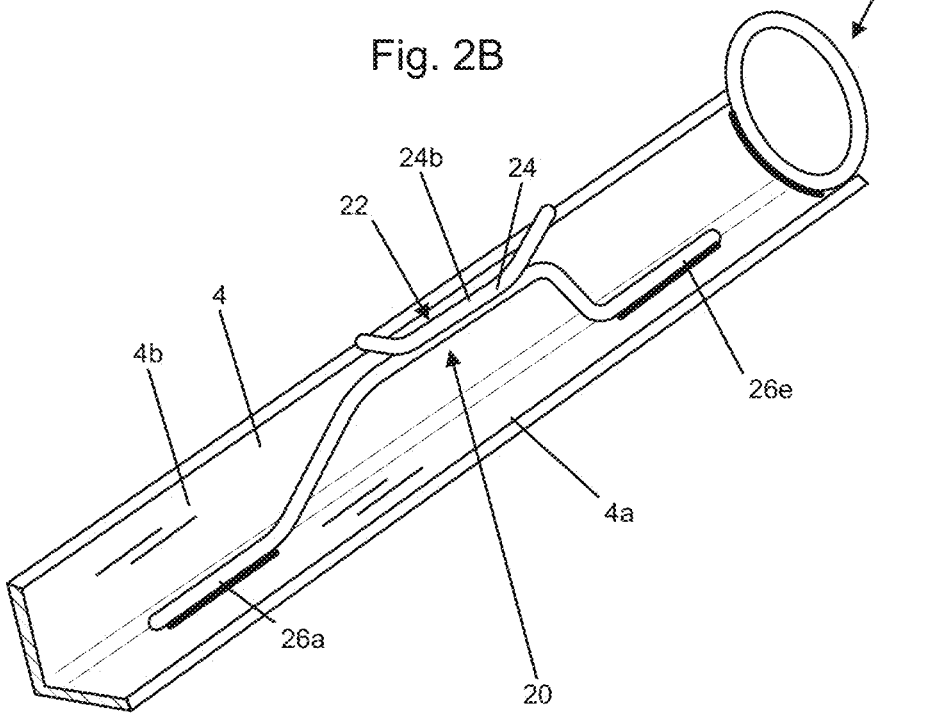
FIG. 2B shows a rear, bottom, and left perspective view of the first cleat apparatus of FIG. 2A fixed to part of a first L or V-shaped member of the first target apparatus of FIG. 1

FIG. 2B shows a rear, bottom, and left perspective view of the cleat apparatus 20 of FIG. 2A fixed to part of the L or V-shaped member 4 of the first target apparatus 1 of FIG. 1. The second cleat apparatus 20 is fixed in FIG. 2B, so that the portion 22 is not against either a member or wall 4*a* or a member wall 4*b* of the member 4, and typically central member 24*b* is about equidistant from either wall 4*a* or wall 4*b* of the member 4. In at least one embodiment, the members 26*a* and 26*e* may be welded at or near the junction of members 4*a* and 4*b*, parallel to the junction of members 4*a* and 4*b*. This allows adequate clearance for winding an end of a balloon around portion 24 in order to attach a balloon to the cleat apparatus 20 and thereby to target apparatus 1 of FIG. 1.

Figure 3A:
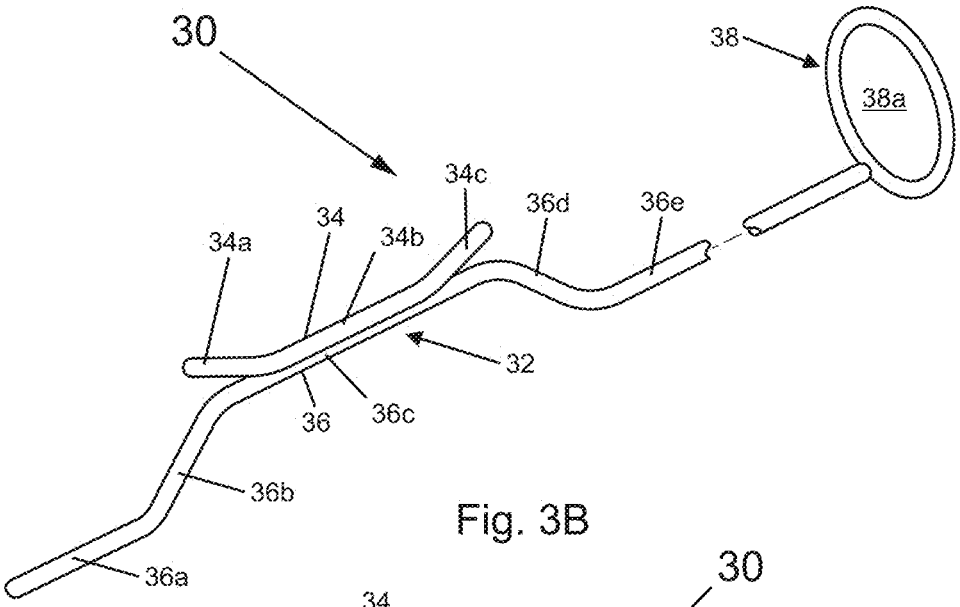
FIG. 3A shows a rear, bottom, and left perspective view of a second cleat apparatus for use with the embodiment of FIG. 1, and for use with other target apparatuses described in the present application
Figure 3B:
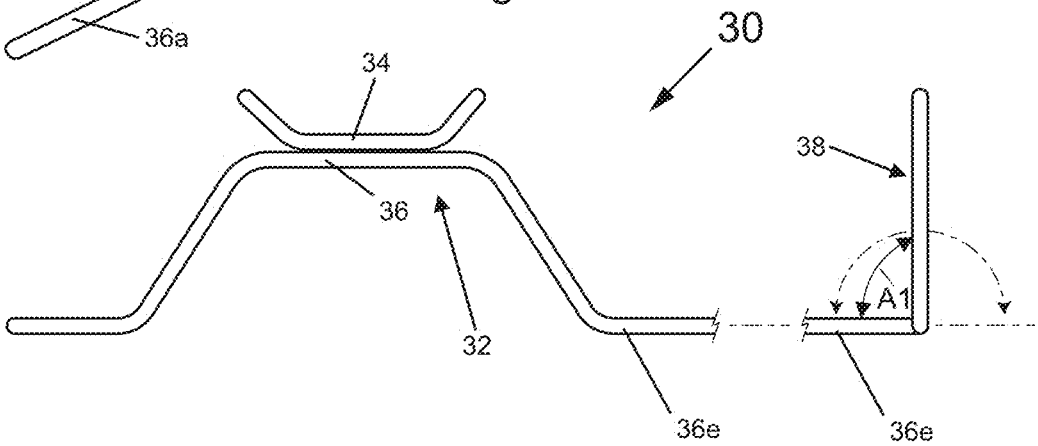
FIG. 3B shows a left side view of the second cleat apparatus of FIG. 3A.
Figure 3C:
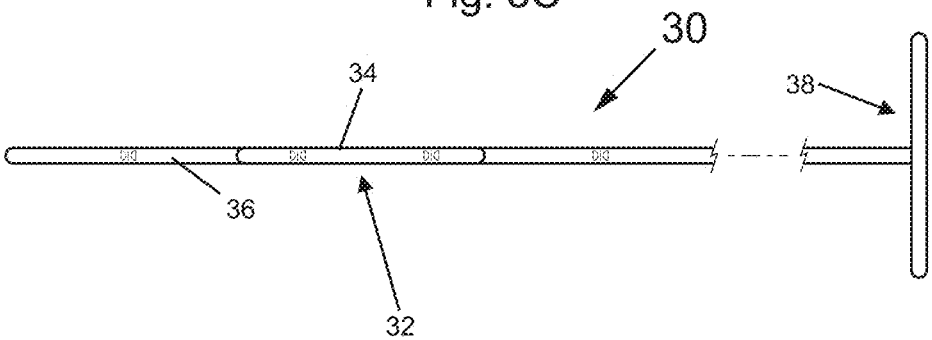
FIG. 3C shows a top view of the second cleat apparatus of FIG. 3A.

FIG. 3A shows a rear, bottom, and left perspective view of a cleat apparatus 30 for use with the embodiment of FIG. 1, and with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29. The cleat apparatus 30 may be fixed to the L or V-shaped member, similar or identical to the cleat apparatus 20 as shown in FIG. 2B. The cleat apparatuses 20 or 30 typically sit behind the metal walls 4*a* and 4*b*, so that the cleat apparatuses 20 or 30 cannot be seen in the front view of FIG. 1. FIG. 3B shows a left side view of the cleat apparatus 30 of FIG. 3A. FIG. 3C shows a top view of the second cleat apparatus 30 of FIG. 3A. FIGS. 3A-3C are shown with part of member 36*e* broken away to show that a length of member 36*e* may vary. In addition, the angle A1 between the ring or loop 38 and the member 36*e* may also vary, but in at least one embodiment is preferred to be about ninety degrees.

The cleat apparatus 30 includes 30 may be made of metal, such as steel, hardened steel or steel spring wire. The cleat apparatus 30 may include part 32 and ring 38. The ring 38 has a central opening 38*a*. The part 32 includes portions 34 and 36.

The portion 34 has a central member 34*b*, and inclined members 34*a* and 34*c* which are fixed at an angle with respect to the central member 34*b*. The portion 36 has a central member 36*c*, and inclined members 36*b* and 36*d* which are fixed at an angle with respect to the central member 36*c*. The inclined members 36*b* and 36*d* are fixed to straight members 36*a*, and 36*e*, respectively. The central members 34*b* and 36*c* are fixed together.

As shown in FIG. 3B, the ring 38 may be fixed at an angle of A1, which may be ninety degrees with respect to the member 36*e*. In one or more embodiment, the angle A1 may be different from ninety degrees.

Figure 4A:
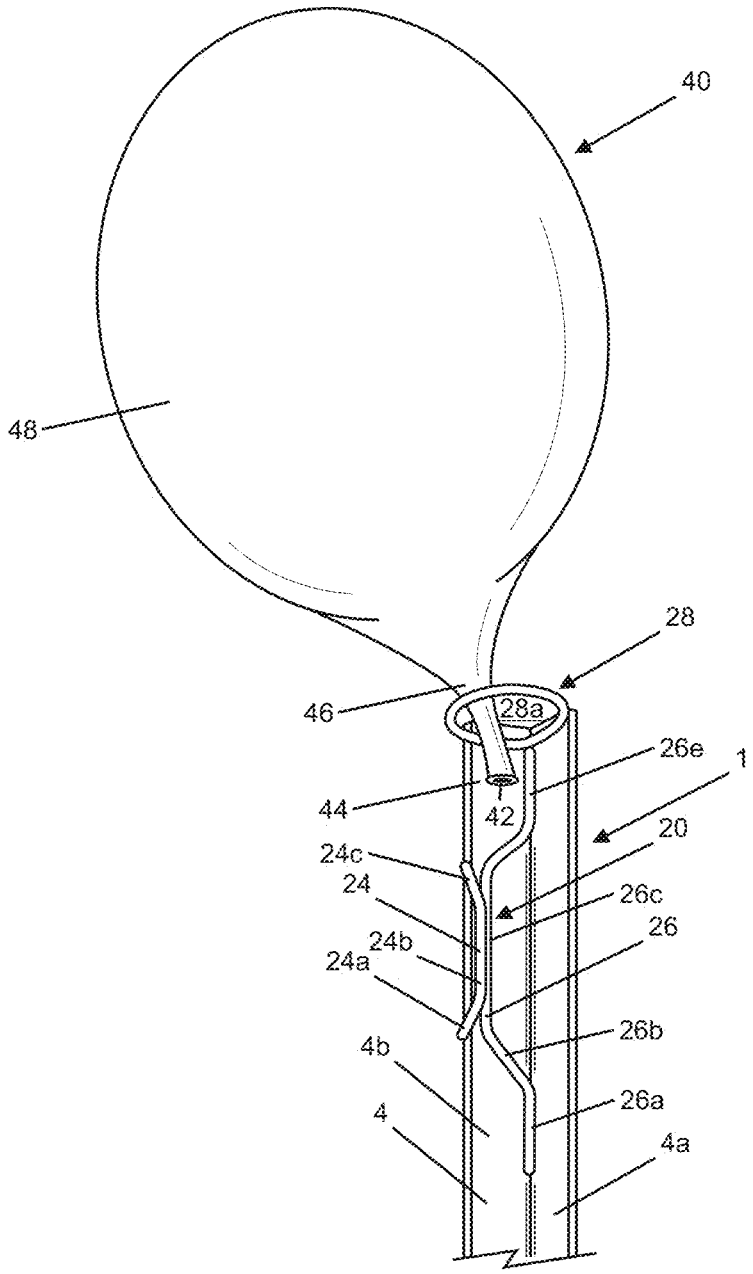
FIG. 4A shows a rear, bottom, and left perspective view of the first cleat apparatus of FIG. 2A fixed to part of the first L or V-shaped member of the first target apparatus of FIG. 1, and a second balloon having a first end inserted through a ring of the first cleat apparatus of FIG. 2A in a first step.

FIG. 4A shows a rear, bottom, and left perspective view of the cleat apparatus 20 of FIG. 2A fixed to part of the L or V-shaped member 4 of the target apparatus 1 of FIG. 1, and a balloon 40 having a first end 44 (at which there is an opening 42) inserted through the opening 28*a* of the ring 28 of the cleat apparatus 20 of FIG. 2A in a first step. An inflated body portion 48 of the balloon 40 is also shown.

Figure 4B:
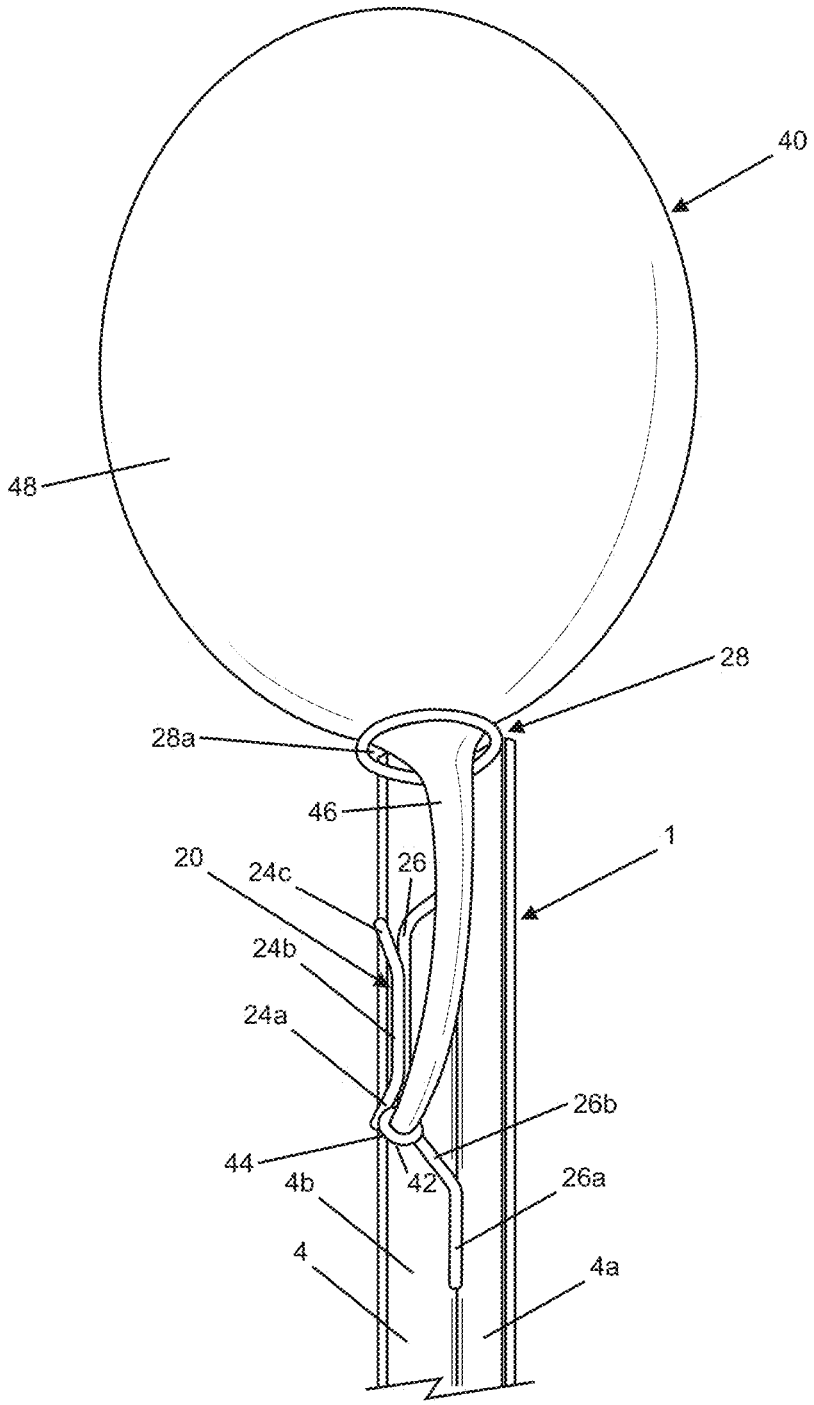
FIG. 4B shows a rear, bottom, and left perspective view of the first cleat apparatus of FIG. 2A fixed to part of the first L or V-shaped member of the first target apparatus of FIG. 1, and the second balloon having a first end which has been inserted through the ring of the first cleat apparatus of FIG. 2A, and pulled forward towards a distal end of a first part of the first cleat apparatus in a second step.

FIG. 4B shows a rear, bottom, and left perspective view of the cleat apparatus 20 of FIG. 2A fixed to part of the L or V-shaped member 4 of the target apparatus 1 of FIG. 1, and the ballon 40 having a first end 44 which has been inserted through the opening 28*a* ring 28 of the cleat apparatus 20 of FIG. 2A, and pulled forward towards a distal end of portion 24*a* of part 24 of the cleat apparatus 20 in a second step.

Figure 4C:
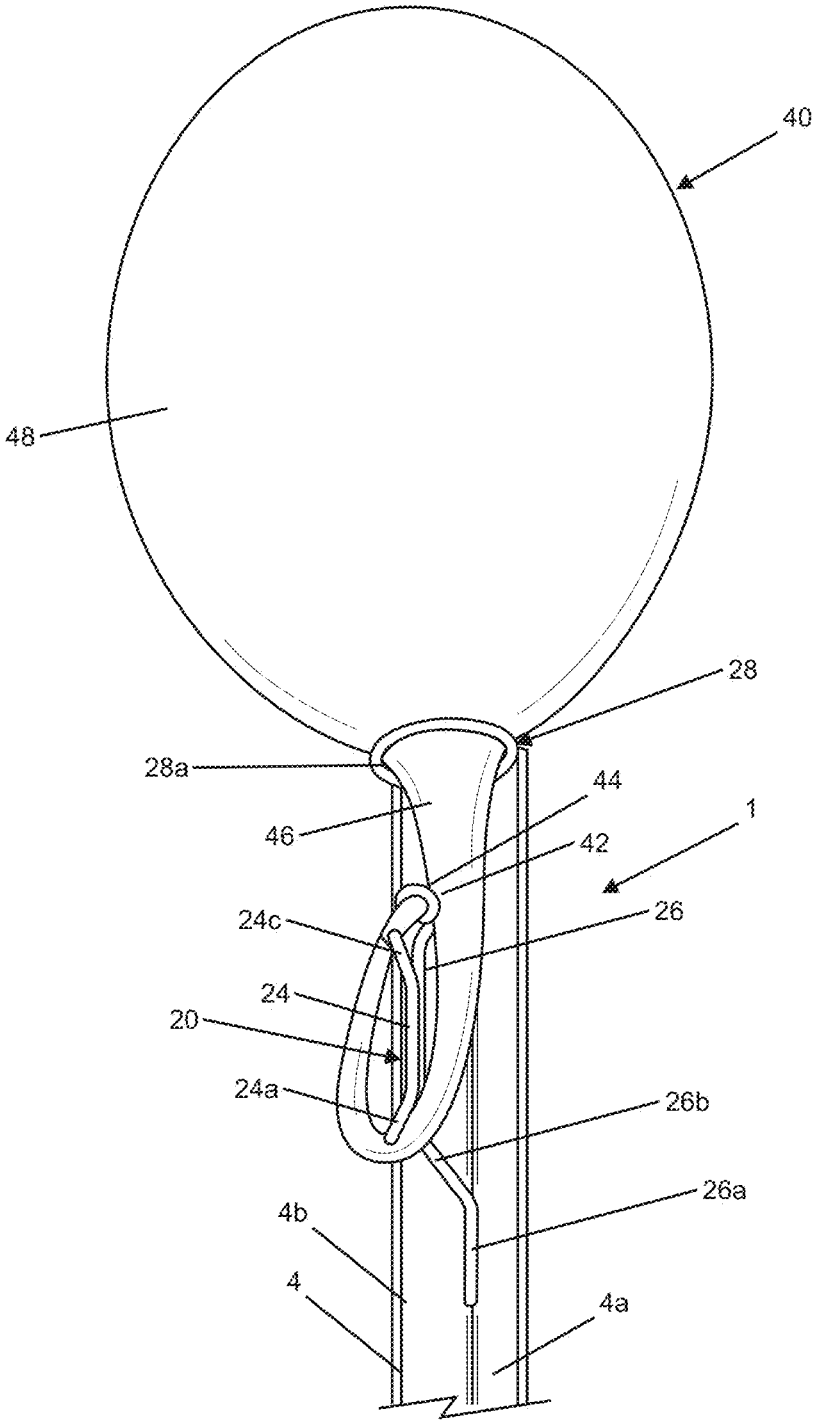
FIG. 4C shows a rear, bottom, and left perspective view of the first cleat apparatus of FIG. 2A fixed to part of the first L or V-shaped member of the first target apparatus of FIG. 1, and the second balloon having a first end which has been inserted through the ring of the first cleat apparatus of FIG. 2A, after the second step of FIG. 4B, wherein the first end of the second balloon has been wound around the distal end of the first part of the first cleat apparatus and back towards a proximal end of the first part of the first cleat apparatus in a third step.

FIG. 4C shows a rear, bottom, and left perspective view of the cleat apparatus 20 of FIG. 2A fixed to part of the L or V-shaped member 4 of the target apparatus 1 of FIG. 1, and the balloon 40 having a first end 44 which has been inserted through the ring 28*a* of the portion 20 of the cleat apparatus 20 of FIG. 2A, after the second step of FIG. 4B, wherein the first end 44 of the balloon 40 has been wound around the distal end of portion 24*a* of part 24 of the cleat apparatus 20 and back towards a proximal end of portion 24*c* of the part 24 of the cleat apparatus 20 in a third step.

Figure 4D:
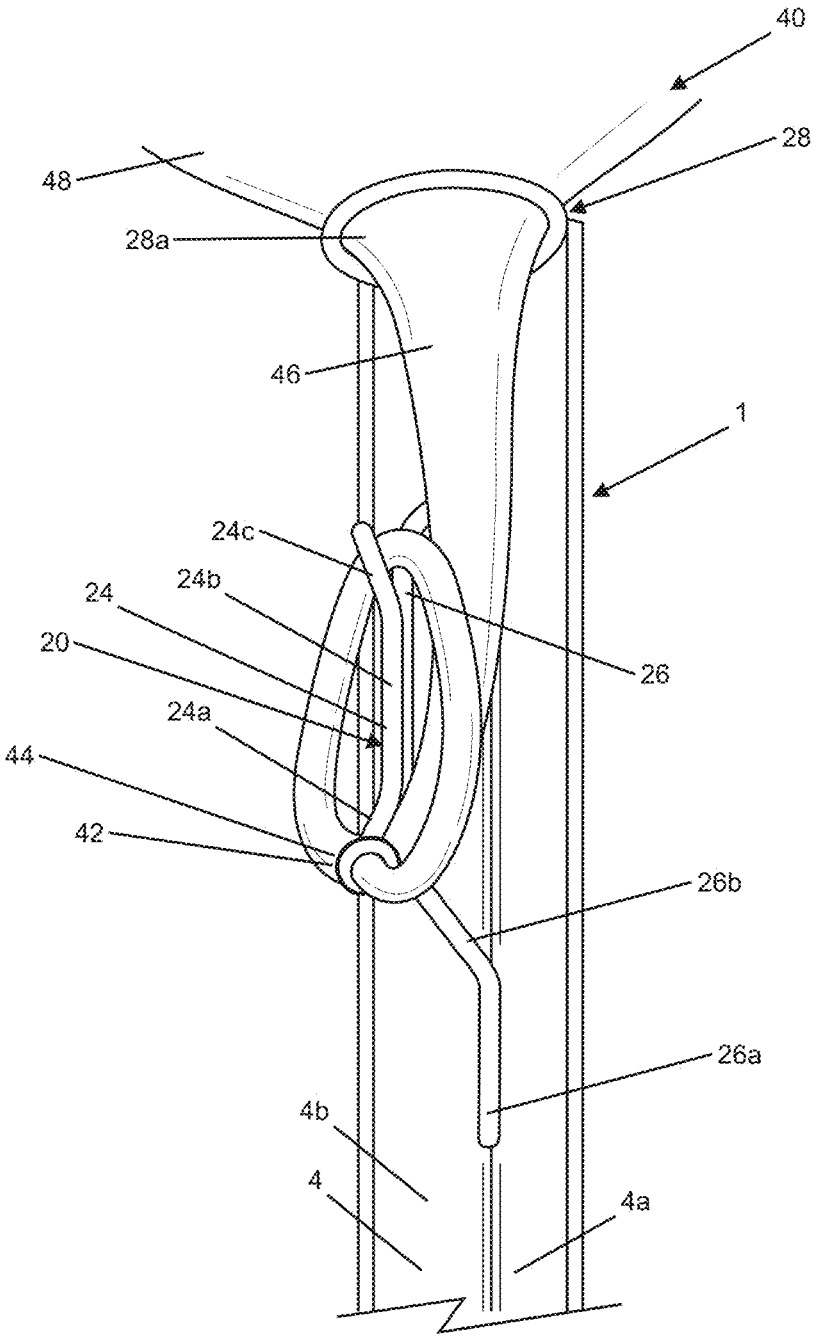
FIG. 4D shows a rear, bottom, and left perspective view of the second cleat apparatus of FIG. 2A fixed to part of the first L or V-shaped member of the first target apparatus of FIG. 1, and the second balloon having a first end which has been inserted through the ring of the first cleat apparatus of FIG. 2A, after the third step of FIG. 4D, wherein the first end of the second balloon has been wound around the proximal end and pulled back towards the distal end of the first cleat apparatus, in a fourth step.
Figure 4E:
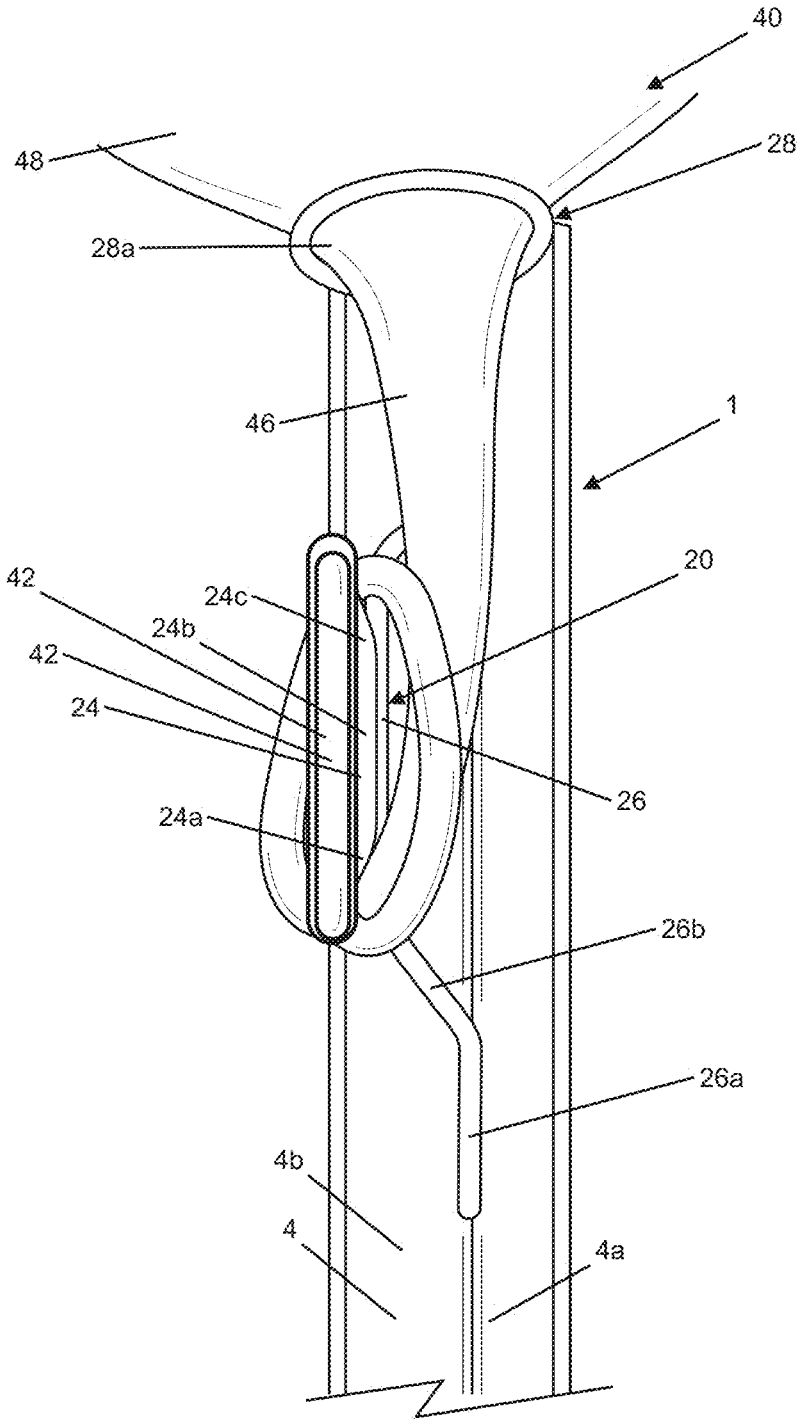
FIG. 4E shows a rear, bottom, and left perspective view of the first cleat apparatus of FIG. 2A fixed to part of the first L-shaped member of the first target apparatus of FIG. 1, and the second balloon having a first end which has been inserted through the ring of the first cleat apparatus of FIG. 2A, after the fourth step of FIG. 4D, wherein the first end of the second balloon stretched over both the proximal and distal ends of the first part of the first cleat apparatus, thereby attaching the second balloon, to the first L-shaped member of the first target apparatus in a fifth step.

FIG. 4D shows a rear, bottom, and left perspective view of the cleat apparatus 20 of FIG. 2A fixed to part of the first L or V-shaped member 4 of the target apparatus 1 of FIG. 1, and the balloon 40 having a first end 44 which has been inserted through the opening of the ring 28 of the cleat apparatus 20 of FIG. 2A, after the third step of FIG. 4D, wherein the first end 44 of the balloon 40 has been wound around the proximal end of part 24*c* and pulled back towards the distal end of part 24*a* of the cleat apparatus 20, in a fourth step;

FIG. 4E shows a rear, bottom, and left perspective view of the cleat apparatus 20 of FIG. 2A fixed to part of the L or V-shaped member 4 of the target apparatus 1 of FIG. 1, and the balloon having a first end 44 which has been inserted through the opening 28*a* of the ring 28 of the cleat apparatus 20 of FIG. 2A, after the fourth step of FIG. 4D, wherein the first end 44 of the balloon 40 stretched over both the proximal (closest end of part 24*c*) and distal (furthest end of part 24*a*) ends of the first part of the cleat apparatus 20, thereby attaching the balloon 40, to the L or V-shaped member 4 of the target apparatus 1 in a fifth step.

The first end 44 and/or lips of the balloon 40 may be wrapped around members 24*c* and 24*a* thereby anchoring the balloon 40, in an inflated state to the cleat or cleat portion 22.

The cleat apparatus 20 may be replaced in the embodiment shown by FIGS. 4A-4E, and FIG. 1, with the cleat apparatus 30 of FIGS. 3A-3E.

Figure 5:
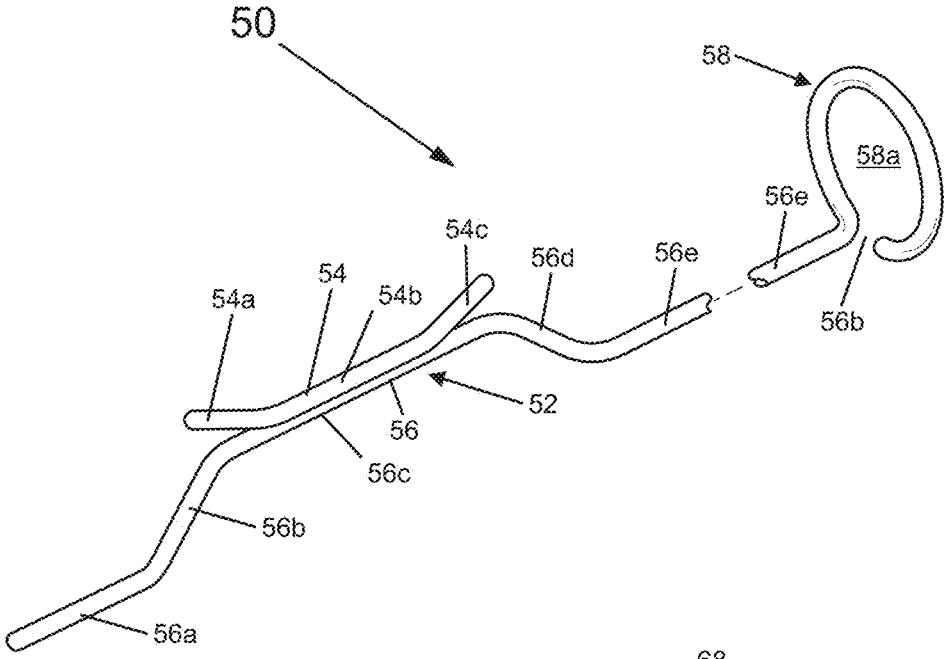
FIG. 5 shows a rear, bottom, and left perspective view of a third cleat apparatus for use with the embodiment of FIG. 1, and for use with other target apparatuses described in the present application.

FIG. 5 shows a rear, bottom, and left perspective view of a cleat apparatus 50 for use with the embodiment of FIG. 1, and with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29. The cleat apparatus 50 may be fixed to the L or V-shaped member 4, so that it is visible from a rear view of the apparatus 1 (and not visible from a front view), similar or identical to the manner of cleat apparatus 20 as shown in FIG. 2B. The cleat apparatus 50 may replace the cleat apparatus 20 in the embodiment shown by FIGS. 4A-4E and FIG. 1.

The cleat apparatus 50 may be fixed to the L or V-shaped member 4, similar or identical to the cleat apparatus 20 as shown in FIG. 2B. The cleat apparatuses 20, 30, or 50 typically sit behind the metal walls 4*a* and 4*b*, so that the cleat apparatuses 20, 30, or 50 cannot be seen in the front view of FIG. 1.

The cleat apparatus 50 may be made of metal, such as steel, hardened steel, or steel spring wire. The cleat apparatus 50 may include part 52 and ring 58. The ring 58 has a central opening 58*a*. The ring 50 may have a gap 56*b* and/or may be a partial ring. The part 52 includes portions 54 and 56.

The portion 54 has a central member 54*b*, and inclined members 54*a* and 54*c* which are fixed at an angle with respect to the central member 54*b*. The portion 56 has a central member 56*c*, and inclined members 56*b* and 56*d* which are fixed at an angle with respect to the central member 56*c*. The inclined members 56*b* and 56*d* are fixed to straight members 56*a*, and 56*e*, respectively. The central members 54*b* and 56*c* are fixed together. In FIG. 5, member 56*e* may be of variable length and is shown in broken away form.

Figure 6A:
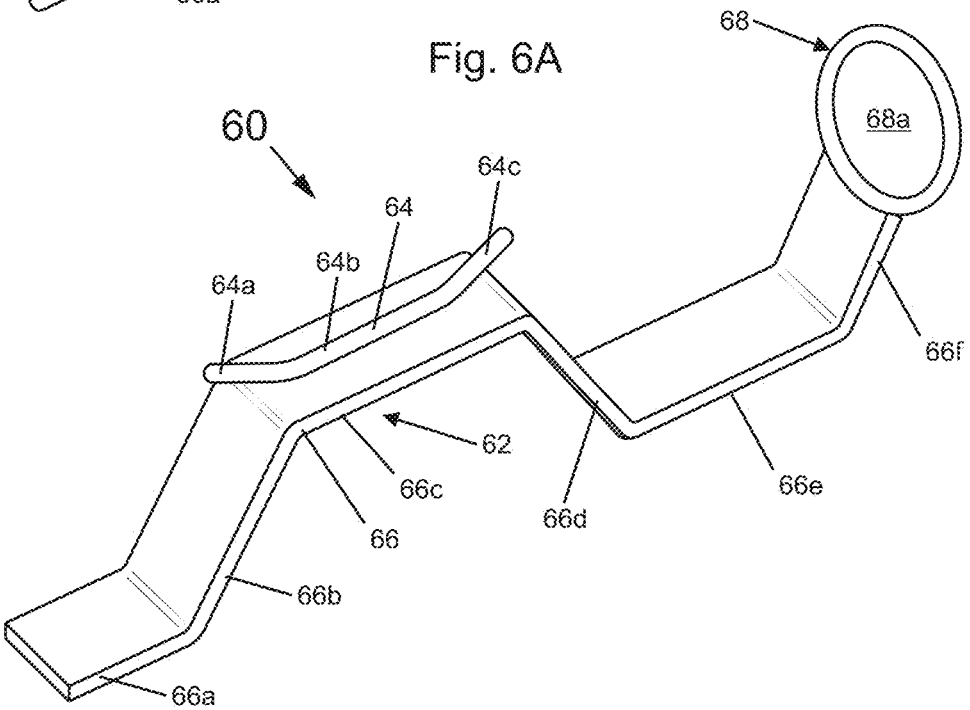
FIG. 6A shows a rear, bottom, and left perspective view of a fourth cleat apparatus for use with the embodiment of FIG. 1, and for use with other target apparatuses described in the present application.

FIG. 6A shows a rear, bottom, and left perspective view of a cleat apparatus 60 for use with the embodiment of FIG. 1, and with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

The cleat apparatus 60 may be fixed to the L or V-shaped member 4, so that it is visible from a rear view of the apparatus 1 (and not visible from a front view), similar or identical to the manner of cleat apparatus 20 as shown in FIG. 2B.

The cleat apparatus 60 may be fixed to the L or V-shaped member 4, similar or identical to the cleat apparatus 20 as shown in FIG. 2B. The cleat apparatuses 20, 30, 50, or 60 typically sit behind the metal walls 4*a* and 4*b*, so that the cleat apparatuses 20, 30, 50, or 60 cannot be seen in the front view of FIG. 1.

The cleat apparatus 60 may be made of metal, steel, hardened steel, or spring steel. The cleat apparatus 60 may include part 62 and ring 68. The ring 68 has a central opening 68*a*. The part 62 includes portions 64 and 66. The cleat apparatus 60 may made of a flattened or metal strip or ribbon.

Figure 6B:
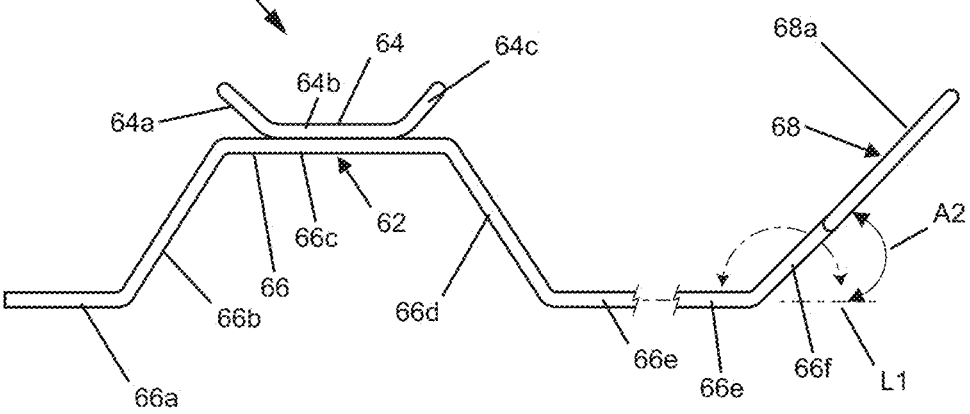
FIG. 6B shows a left side view of the fourth cleat apparatus of FIG. 6A.
Figure 6C:
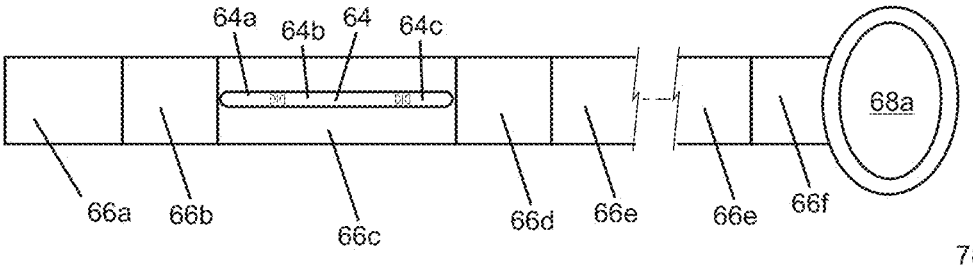
FIG. 6C shows a top view of the fourth cleat apparatus of FIG. 6A.

The portion 64 has a central member 64*b*, and inclined members 64*a* and 64*c* which are fixed at an angle with respect to the central member 64*b*. The portion 66 has a central member 66*c* (which may be a flat plate), and inclined members 66*b* and 66*d* (which may be flat plates) which are fixed at an angle with respect to the central member 66*c*. The inclined members 66*b* and 66*d* are fixed to straight members 66*a*, and 66*e* (which may be flat plates), respectively. The central members 64*b* and 66*c* are fixed together. FIG. 6B shows a left side view of the cleat apparatus 60 of FIG. 6A. FIG. 6C shows a top view of the cleat apparatus 60 of FIG. 6A.

FIG. 6B shows that a neck angle or Angle A2 of the ring 68 with respect to the member 66*e* can vary, however, in at least one embodiment, it is preferred to be about ninety degrees. FIG. 6B also shows a portion of member 66*e* broken away to show that a length of the member 66*e* from the junction with ring 68 to the junction with member 66*d*, may vary, depending on what target apparatus the member 66*e* is used with.

Figure 7:
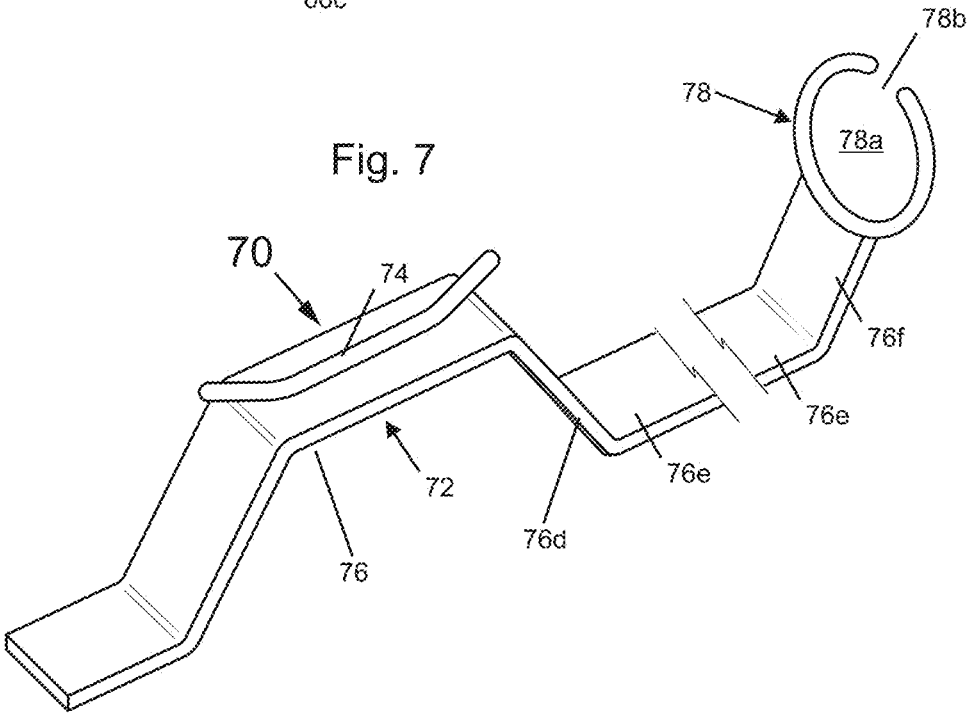
FIG. 7 shows a rear, bottom, and left perspective view of a fifth cleat apparatus for use with the embodiment of FIG. 1, and for use with other target apparatuses described in the present application.

FIG. 7 shows a rear, bottom, and left perspective view of a cleat apparatus 70 for use with the embodiment of FIG. 1, and with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29. The cleat apparatus 70 may be identical to the clear apparatus 60 except that the ring 78, unlike the ring 68, has a gap 78*b*. The ring 78 has an opening 78*a*. The cleat apparatus 70 includes parts portion 72 which includes parts 74 and 76, which may be identical to portion 62, and parts 64 and 66. The part 76 may include member 76*d*, 76*e*, and 76*f*. The member 76*e* is shown partly broken away, to show that the length of member 76*e* (from junction with member 76*d* to junction with member 76*f*) may vary.

Figure 8:
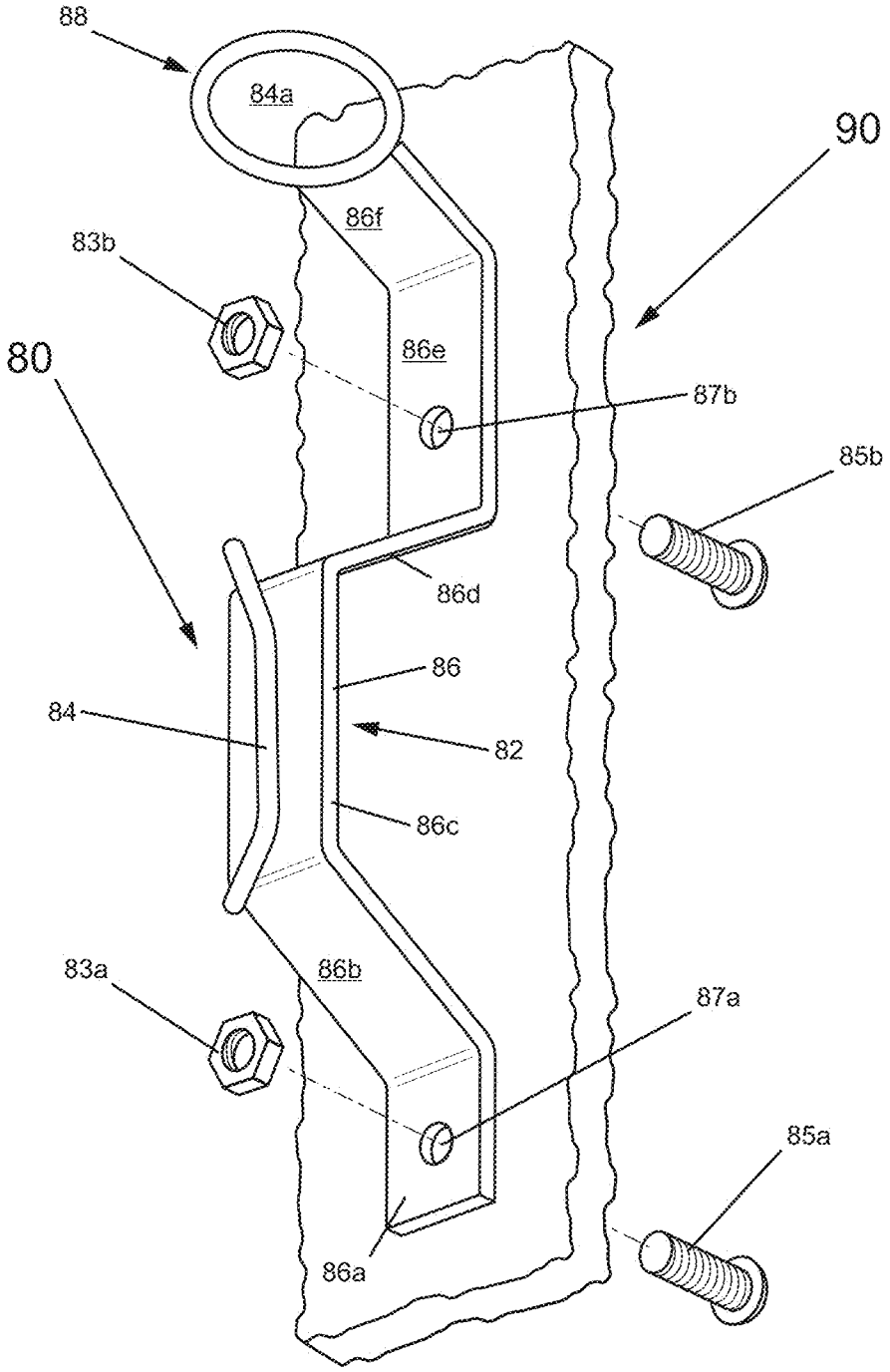
FIG. 8 shows a rear, bottom, and left perspective view of a sixth cleat apparatus for use with the embodiment of FIG. 1, and for use with other target apparatuses described in the present application, and FIG. 8 also shows a plate for mounting the sixth cleat apparatus.

FIG. 8 shows a rear, bottom, and left perspective view of a cleat apparatus 80 having components 82, 84, 86, 88, 88*a*, 86*a-f*, which may be identical to components 72, 74, 76, 78, 78*a*, and 76*a-g* of cleat apparatus 70, except for holes 87*a* and 87*b* in the members 86*a* and 86*e*, respectively. The cleat apparatus 80 is configured to be mounted by bolts 85*a* and 85*b*, and nuts 83*a* and 83*b* to member 90 which may be part of the L or V-shaped member 4 of the embodiment of FIG. 1. The cleat apparatus 80 may be used with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

In at least one embodiment, the cleat apparatus of FIG. 8 may also be used in addition to an existing steel shooting target, wherein its owner may attach the cleat apparatus 80 to their target thereby modifying with an addition of a balloon apparatus.

Figure 9:
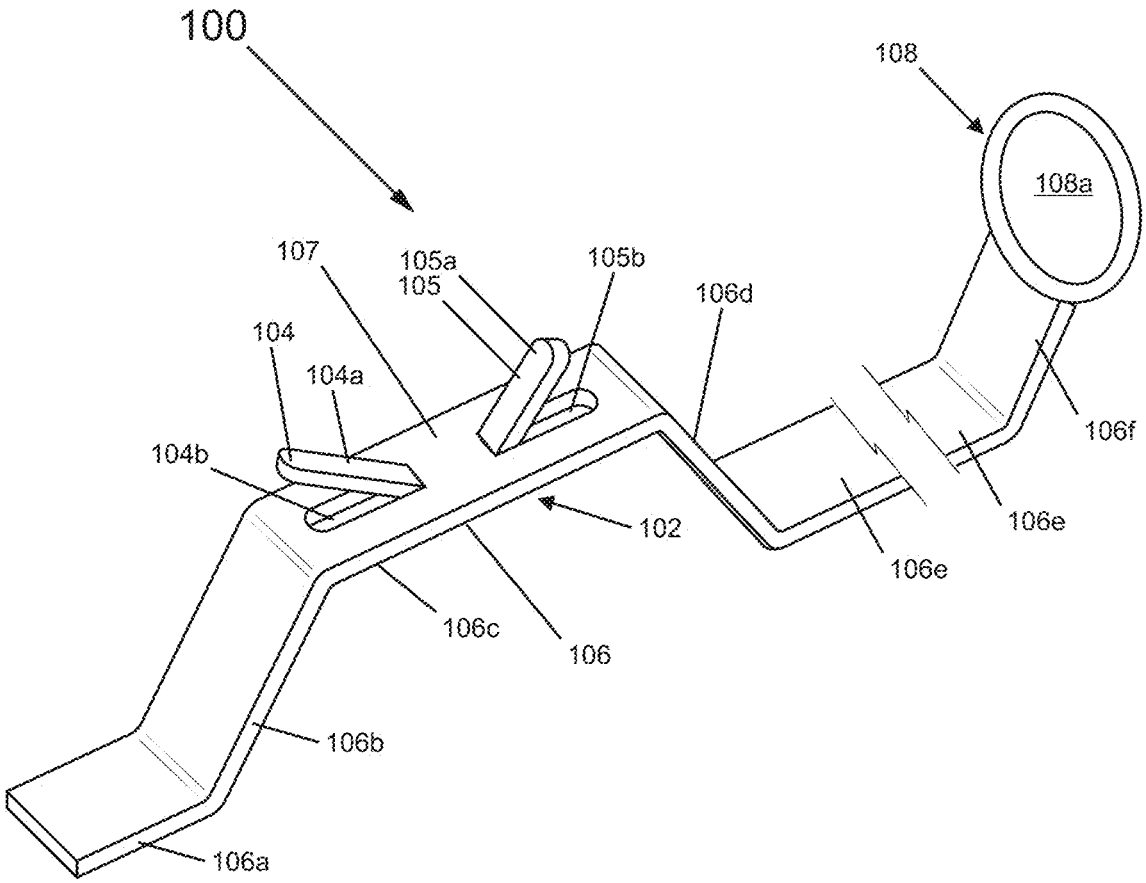
FIG. 9 shows a rear, bottom, and left perspective view of a seventh cleat apparatus, wherein a cleat is punched or stamped out, for use with the embodiment of FIG. 1, and for use with other target apparatuses described in the present application.

FIG. 9 shows a rear, bottom, and left perspective view of a cleat apparatus 100 for use with the embodiment of FIG. 1, in a similar manner to cleat apparatuses 20, 30, 50, 60, and 70 on the L or V-shaped member 4. The cleat apparatus 100 includes a portion 102 and a ring 108. The ring 108*a* has a central opening 108*a*. The portion 102 includes parts 104, 105, and 106. The part 106 includes parts or sections 106*a*, 106*b*, 106*c*, 106*d*, 106*e*, and 106*f*. The part 104 includes slots 104*b*, and part 104*a*. The part 105 includes slot 105*b* and part 105*a*. The parts 104*a* and 105*a* are punched or stamped through member 107.

The cleat apparatus 100 may be used with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

FIG. 9 also shows variable length for member 106*e*, by a broken away portion. In addition the angle of member 106*f* with respect to member 106*e* may be about ninety degrees but other angles are possible in other embodiments. In at least one embodiment, the ring 108 may have a gap, similar or identical to gap 78*b* shown in FIG. 7.

Figure 10:
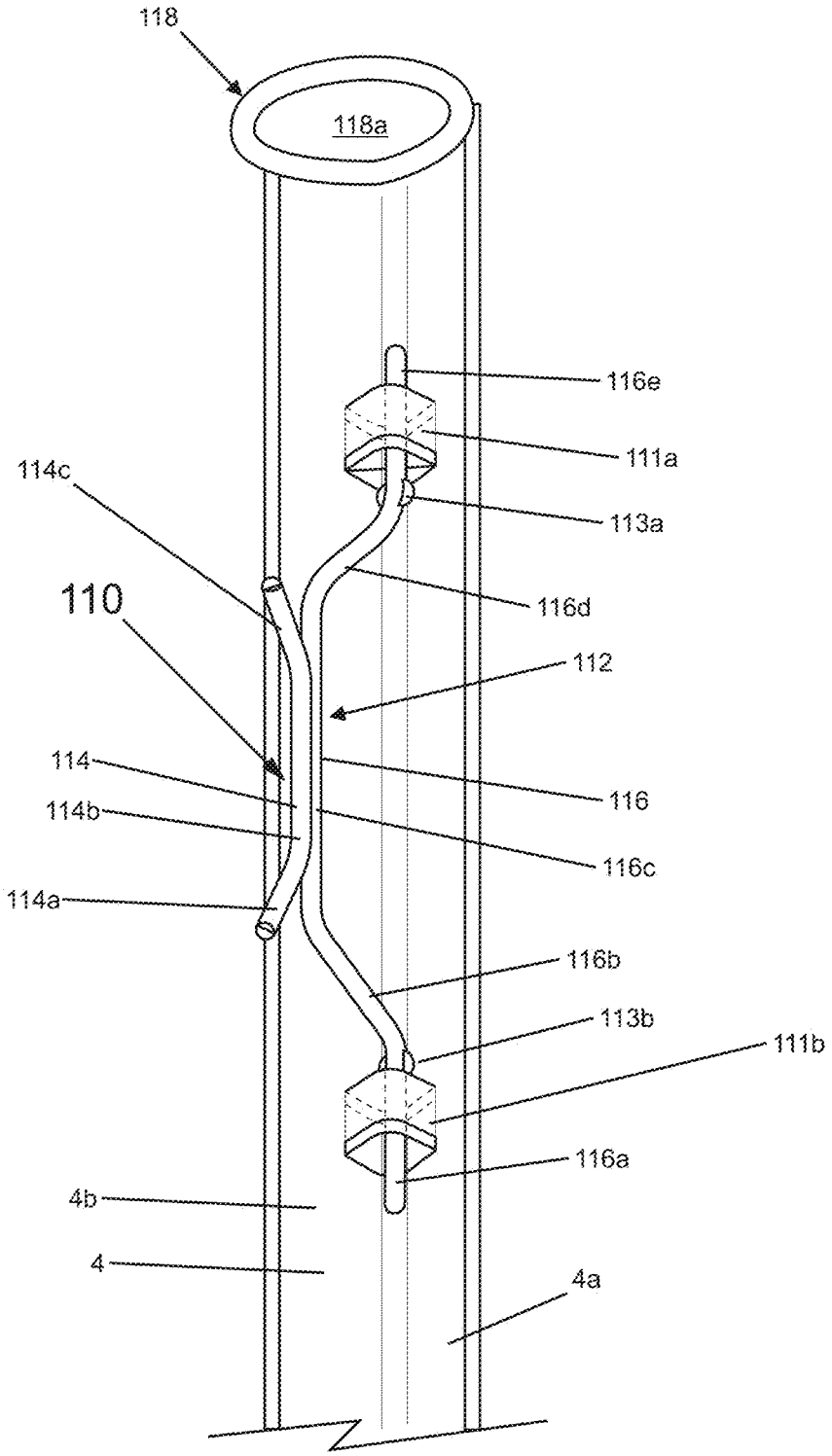
FIG. 10 shows a rear, bottom, and left perspective view of an eighth cleat apparatus for use with the embodiment of FIG. 1 fixed to an L or V-shaped member for use with the embodiment of FIG. 1, and for use with other target apparatuses described in the present application.

FIG. 10 shows a rear, bottom, and left perspective view of an cleat apparatus 110 for use with the embodiment of FIG. 1 fixed to an L or V-shaped member 4 for use with the embodiment of FIG. 1, in a manner similar or identical to cleat apparatuses 20, 30, 50, 60, and 70 on the L or V-shaped member 4. The cleat apparatus 110 includes a portion 112 and a ring 118. The ring 118 has a central opening 118*a*. The portion 112 includes parts 114, 116, 111*a*, 111*b*, 113*a*, and 113*b*. The part 116 includes parts or sections 116*a*, 116*b*, 116*c*, 116*d*, and 116*e*. The part 114 includes parts 114*a*, 114*b*, and 114*c*. The cleat apparatus 110 includes parts 111*a* and 111*b* which are typically punched and/or stamped through L or V-shaped member 4. The cleat apparatus includes parts 113*a* and 113*b* which are nubs which eliminate and/or substantially reduce rotation of cleat or cleat portion 112.

The cleat apparatus 110 may be used with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

Figure 11:
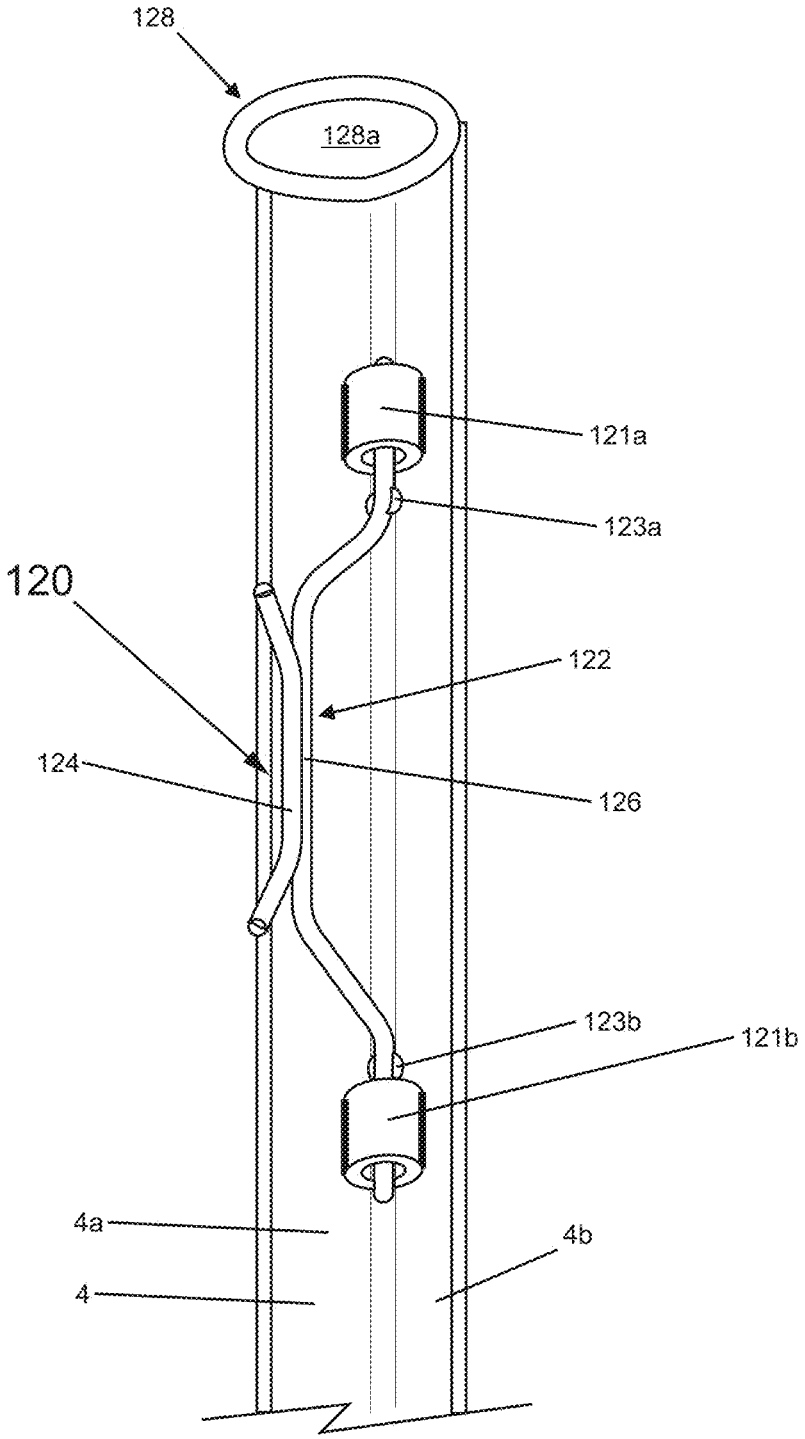
FIG. 11 shows a rear, bottom, and left perspective view of an nineth cleat apparatus for use with the embodiment of FIG. 1 fixed to an L or V-shaped member for use with the embodiment of FIG. 1, and for use with other target apparatuses described in the present application.

FIG. 11 shows a rear, bottom, and left perspective view of an cleat apparatus 120 for use with the embodiment of FIG. 1 fixed to an L or V-shaped member 4 for use with the embodiment of FIG. 1, in a manner similar or identical to cleat apparatuses 20, 30, 50, 60, 70, and 110 on the L or V-shaped member 4. The cleat apparatus 120 includes a portion 122 and a ring 128. The ring 128 has a central opening 128*a*. The portion 122 includes parts 124, and 126 which may be identical to parts 114 and 116, respectively, shown in FIG. 10. The cleat apparatus 120 includes parts 121*a*, 121*b* which are metal tubes welded/fixed to L or V-shaped member 4. The members 123*a* and 123*b* are nubs which eliminate and/or substantially reduce rotation of the cleat or cleat portion 122.

The cleat apparatus 120 may be used with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

Figure 12:
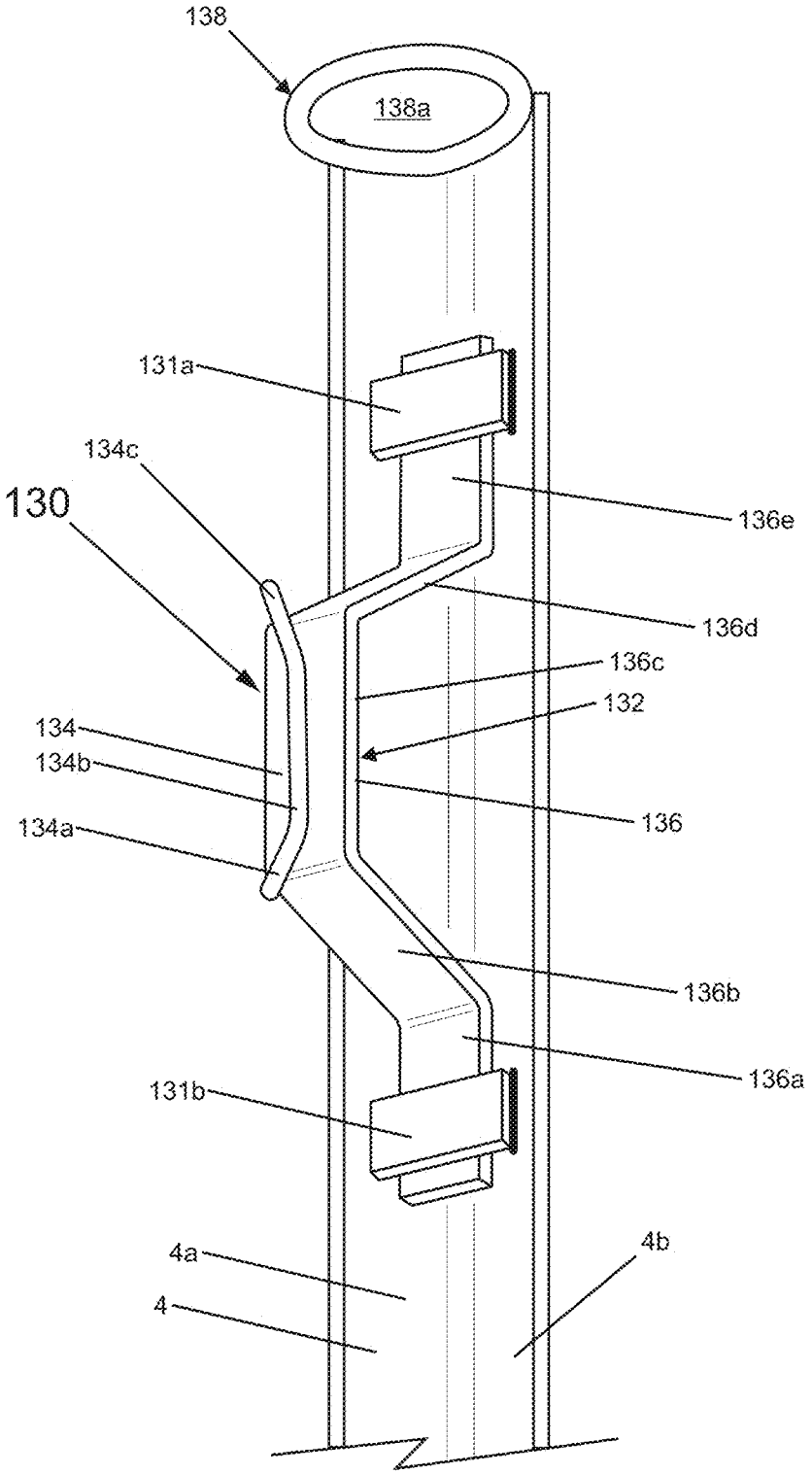
FIG. 12 shows a rear, bottom, and left perspective view of a tenth cleat apparatus for use with the embodiment of FIG. 1 fixed to an L or V-shaped member for use with the embodiment of FIG. 1, and for use with other target apparatuses described in the present application.

FIG. 12 shows a rear, bottom, and left perspective view of a cleat apparatus 130 for use with the embodiment of FIG. 1 fixed to an L or V-shaped member 4 for use with the embodiment of FIG. 1, in a manner similar or identical to cleat apparatuses 20, 30, 50, 60, 70, 110, and 120 on the L or V-shaped member 4. The cleat apparatus 130 includes a portion 132 and a ring 138. The ring 138 has a central opening 138*a*. The portion 132 includes parts 134, and 136 which may be identical to parts 114 and 116, respectively, shown in FIG. 10. The cleat apparatus 130 includes parts 131*a* and 131*b*, which may be used to fix the cleat apparatus 130 to the L or V-shaped member 4.

The cleat apparatus 130 may be used with other target apparatuses described in the present application, such as including, but not limited to those shown in FIGS. 13A, 14A, 15A, 17A, 17C, 18A, 19, 20A, 21A, 22, 23A, 24A, 24D, 25, 26, 27A, 28A, and 29.

FIG. 13A shows a side view of an apparatus 140 including the apparatus 1 of FIG. 1, with an additional support member 142, and/or support members 144 and 146, attached to L or V-shaped member 4, with the first cleat apparatus 20 of FIG. 2A, and with portion of the balloon 40 shown attached to the cleat apparatus 20.

In FIG. 13A, the support members 142, 144, and 146 help to provide support, wherein an end of 144 and an end of 146 are resting on a top ground surface of member or ground 148. The members 16 and 14 are inserted into the member or ground 148 in FIG. 13A. FIG. 13A also shows L or V-shaped member 8, member 7, L or V-shaped member 6, and member 4. The member 7 includes a locking nub or protrusion 7*a* to hold member 7 in place within a hollow bore of member 8. The member 6 includes a portion 6*a*, shown in dashed lines which is fixed to member 4. The member 7 is typically a round steel rod and the length is shown broken away, to indicate variation in length of member 7.

FIG. 13B shows a perspective view of an upper part of the apparatus 140 shown in FIG. 13A, with some portions shown in a broken away view, and some portions left out, and additionally with a bullet 150 shown approaching the exterior of the L or V-shaped member 4. In FIG. 13B, the support member 142 is shown pivotally connected by pin 143 to L or V-shaped member 4. FIG. 13B also shows the cleat apparatus 30, including portions or parts 32, 24, and 26, and ring 38 including opening 38*a*.

Figure 13C:
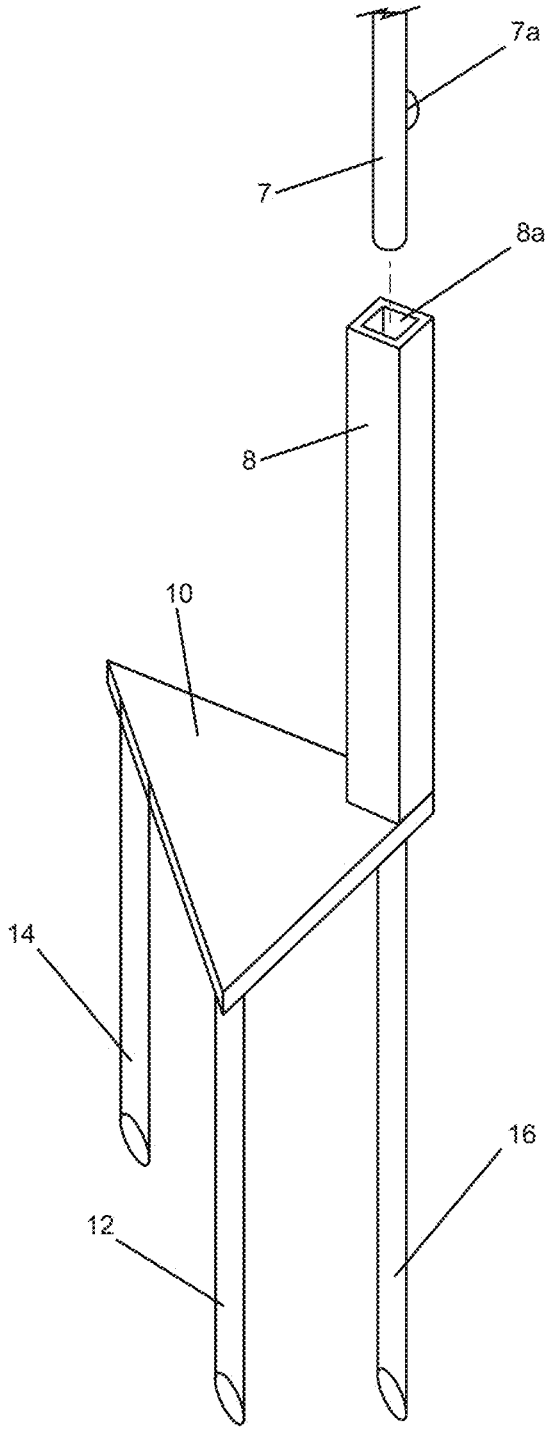
FIG. 13C shows a view of second part of the apparatus shown in FIG. 13A, with some portions shown in a broken away view, and some portions left out.

FIG. 13C shows a view of a part of the apparatus 140 shown in FIG. 13A, with some portions shown in a broken away view, and some portions left out. FIG. 13C shows the member 7, and the locking nub or protrusion 7*a*. FIG. 13C also shows a hollow bore 8*a* within the hollow member 8. Hollow member 8 is fixed to the base 10, which is fixed to the leg members 12, 14, and 16.

Figure 14A:
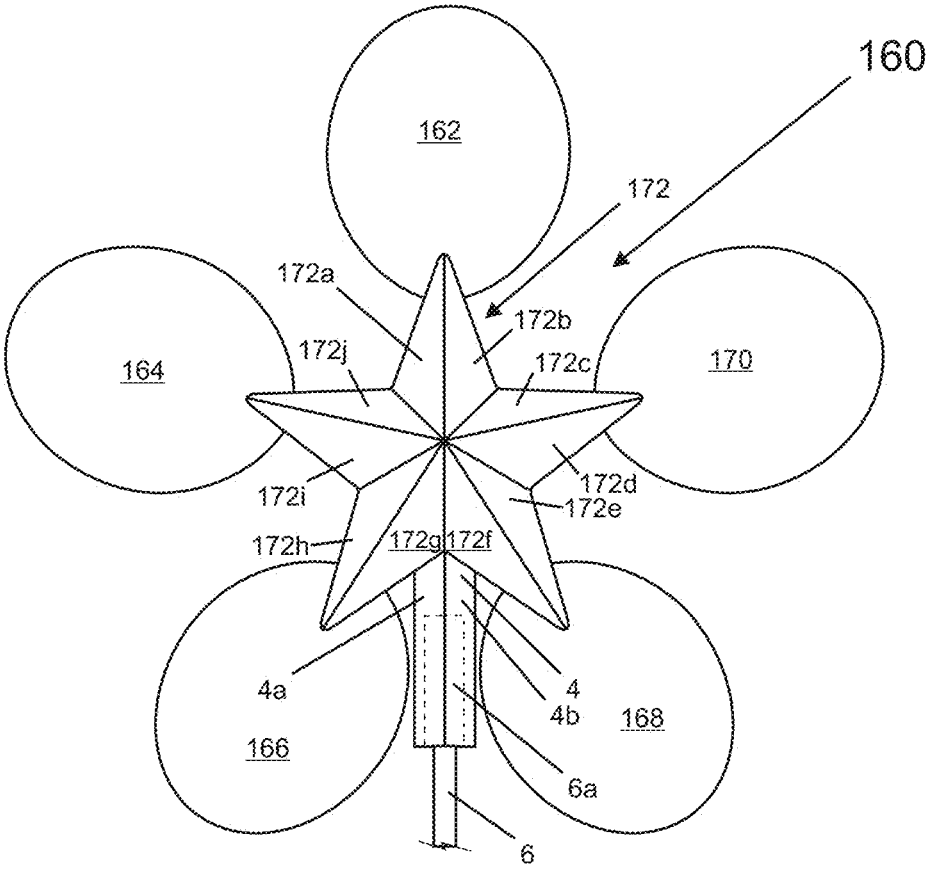
FIG. 14A shows a front view of a second target apparatus with a plurality of attached balloons in accordance with an embodiment of the present invention.
Figure 14B:
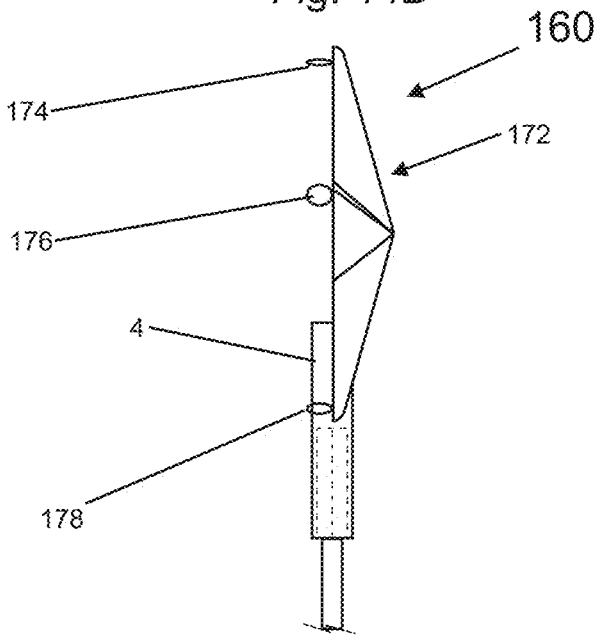
FIG. 14B shows a side view of the second target apparatus of FIG. 14A without any attached balloons.

FIG. 14A shows a front view of a target apparatus 160 with a plurality of attached balloons 162, 164, 166, 168, and 170 in accordance with an embodiment of the present invention. FIG. 14B shows a side view of the target apparatus 160 of FIG. 14A without any attached balloons. The plurality of balloons in FIG. 14A include balloons 162, 164, 166, 168, and 170.

The target apparatus 160 includes star-shaped structure 172, which may be made of metal such as steel, hardened steel, spring steel, AR 500 steel, or any steel with capability to inhibit the penetration (through the L or V-shaped member 4) of a firearms projectile, such as projectile 150 as shown, for example, in FIG. 13B. The star-shaped structure 172 includes surfaces 172*a*, 172*b*, 172*c*, 172*d*, 172*e*, 172*f*, 172*g*, 172*h*, 172*i*, and 172*j*.

The surface or member 172*j* is preferably at an angle of between thirty and ninety degrees with respect to the surface or member 172*i*. The surface or member 172*h* is preferably at an angle of between thirty and ninety degrees with respect to the surface or member 172*g*. The surface or member 172*f* is preferably at an angle of between thirty and ninety degrees with respect to the surface or member 172*e*. The surface or member 172*d* is preferably at an angle of between thirty and ninety degrees with respect to the surface or member 172*d*. Each of these pairs of surfaces or members is configured to provide a similar or identical function to the surfaces or members 4*a* and 4*b* as shown, for example in FIG. 13B, in order to deflect a projectile 150.

The target apparatus 160 includes members 4 and 6. The member 4 is L or V-shaped and includes the members 4*a* and 4*b* which are at an angle with respect to each other, where the angle preferably between thirty and ninety degrees to cause deflection of projectile, as shown from example in FIG. 13B.

The apparatus 160 includes rings 174, 176, 178, a ring opposite ring 176 which cannot be seen in FIG. 14B, and a ring opposite ring 178, which cannot be seen in FIG. 14B, for a total of five rings. There may be a central cleat apparatus (not shown in FIG. 14B, such as including portion 22 of cleat apparatus 20 shown in FIG. 2A fixed at the back of the star-shaped structure, for attaching the five balloons 162, 164, 166, 168, and 170 after each end of each of the balloons inserted through one of the five rings.

Figure 15A:
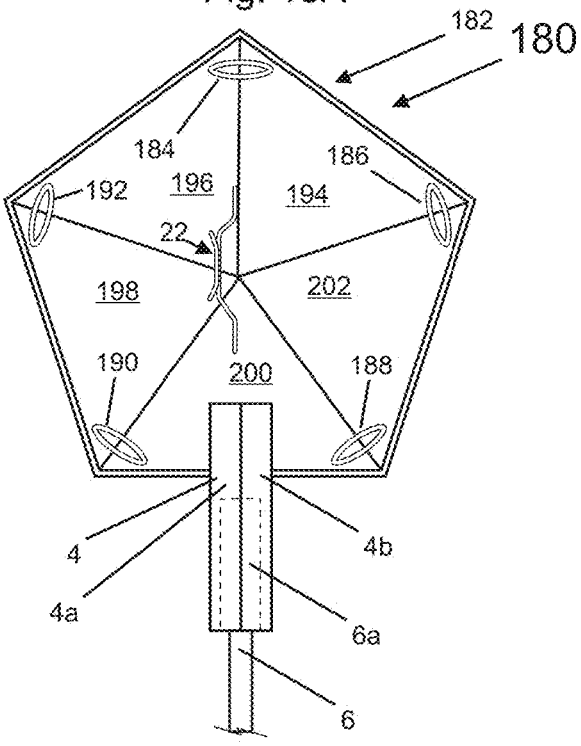
FIG. 15A shows a rear view of a third target apparatus of an embodiment of the present invention.
Figure 15B:
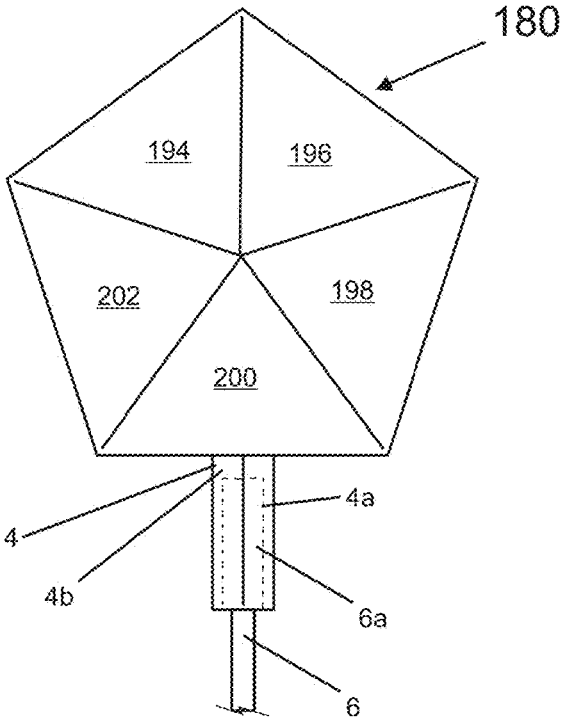
FIG. 15B shows a front view of the third target apparatus of FIG. 15A.
Figure 15C:
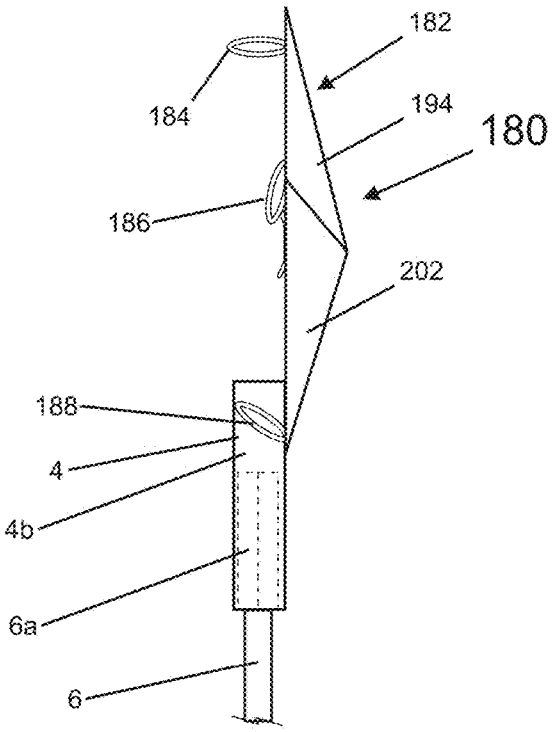
FIG. 15C shows a side view of the third target apparatus of FIG. 15A.

FIG. 15A shows a rear view of a target apparatus 180 of an embodiment of the present invention. FIG. 15B shows a front view of the target apparatus 180 of FIG. 15A. FIG. 15C shows a side view of the target apparatus 180 of FIG. 15A.

The target apparatus 180 includes rings 184, 186, 188, 190, and 192, and portion 22 of cleat apparatus 20 shown in FIG. 2A, fixed to the pentagon structure 182. The portion 22 of the cleat apparatus 20 is shown centrally or substantially centrally fixed to structure 182. The structure 182 has a plurality of surfaces, including surfaces 194, 196, 198, 200, and 202, each angled with respect to their adjacent surface of 194, 196, 198, 200, and 202. The target apparatus 180 includes members 4 and 6. The member 6 has a portion 6*a* which is fixed to the member 4. The member 4 is L or V-shaped and includes members 4*a* and 4*b* being at an angle with respect to each other.

Figure 16:
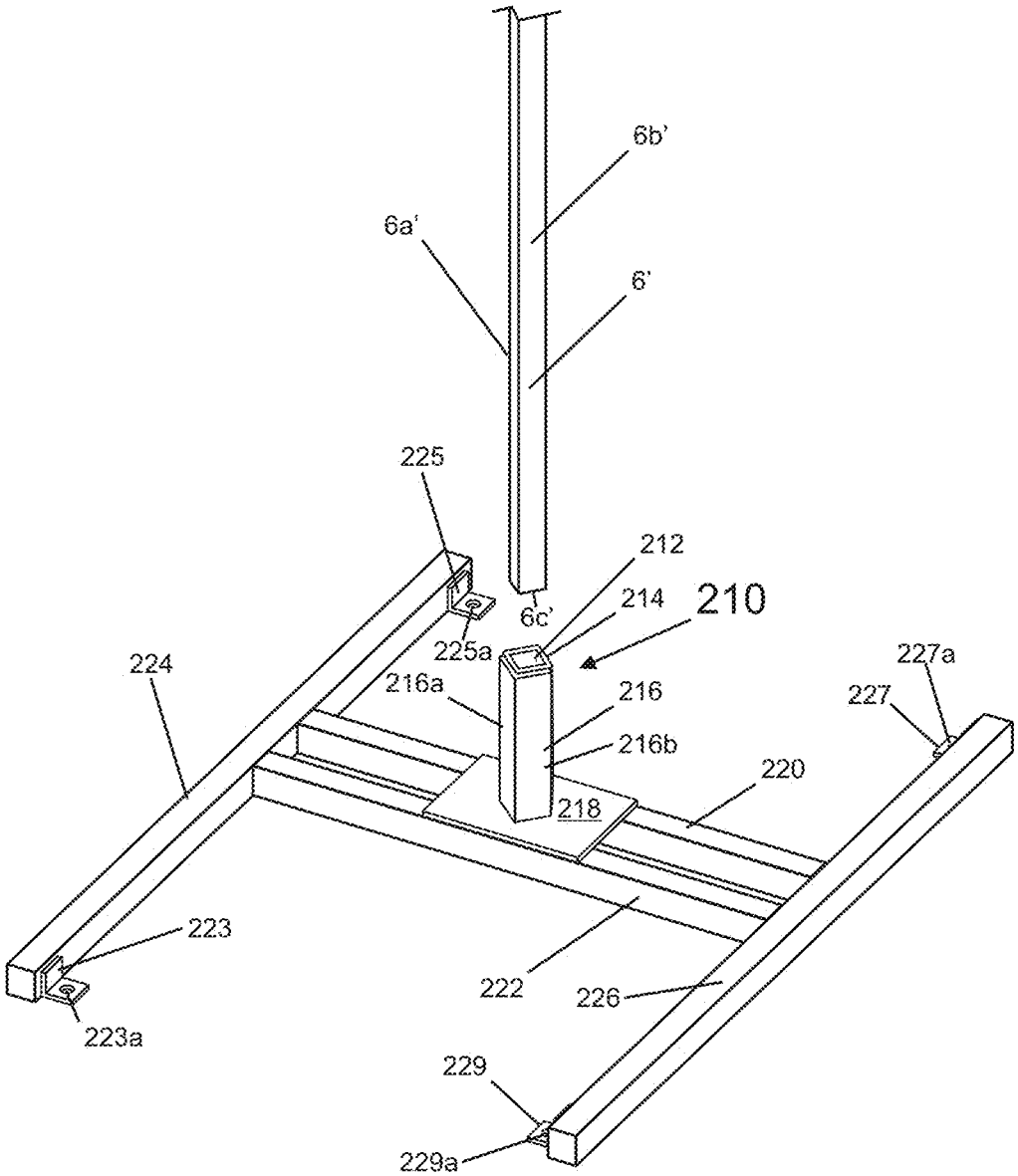
FIG. 16 shows a front, right, and top perspective view of a universal base which is configured to be used with a number of target apparatuses in accordance with the present invention, along with a member part of which is shown in FIGS. 15A-C.

FIG. 16 shows a front, right, and top perspective view of a universal base 210 which is configured to be used with a number of target apparatuses in accordance with the present invention, along with an L or V-shaped member 6' having members 6*a*' and 6*b*' and an end 6*c*', shown in FIG. 16, wherein The member 6 shown in FIG. 1 is typically a rod or variable length, while the member 6' is an L or V-shaped member.

The universal base 210 includes L or V-shaped member 216 having members 216*a* and 216*b* which are at an angle of preferably between thirty and ninety degrees, with respect to each other and are configured to provide a deflection function for deflecting a projectile similar to as shown in FIG. 13B for surfaces or members 4*a* and 4*b* . . . . The base 10 further includes a square or rectangular tube 214 having an opening or receiving bore 212 into which end 6*b* of rectangular or square beam or member 6 is configured to be inserted. The base 10 further includes base plate 218 to which tube 214 and L- or V-shaped member 216 are fixed at a right angle or substantially a right angle. The L or V-shaped member 216 is provided with the tube 214 to provide reinforcement for projectiles, such as bullets coming from the direction where the members 216*a* and 216*b* are joined.

The plate 218 if fixed to the rails or members 220 and 222. Each of the rails or members 220 and 222 are fixed at one end to member 224 and at an opposite end to member 226. There are L-shaped brackets 223 and 225 fixed to member 224 and L-shaped brackets 227 and 229 fixed to member 226. The L-shaped brackets have openings 225*a*, 223*a*, 227*a*, and 229*a*, through which fasteners or spikes may be inserted and driven into ground or a beam to fix the overall universal base 210 to a ground surface or ground beam.

In at least one embodiment, the base 210 of FIG. 16 is not compatible with the third target apparatus of FIGS. 15A-C. Rather the embodiment of FIG. 13C is compatible with FIGS. 15A-C.

Figure 17A:
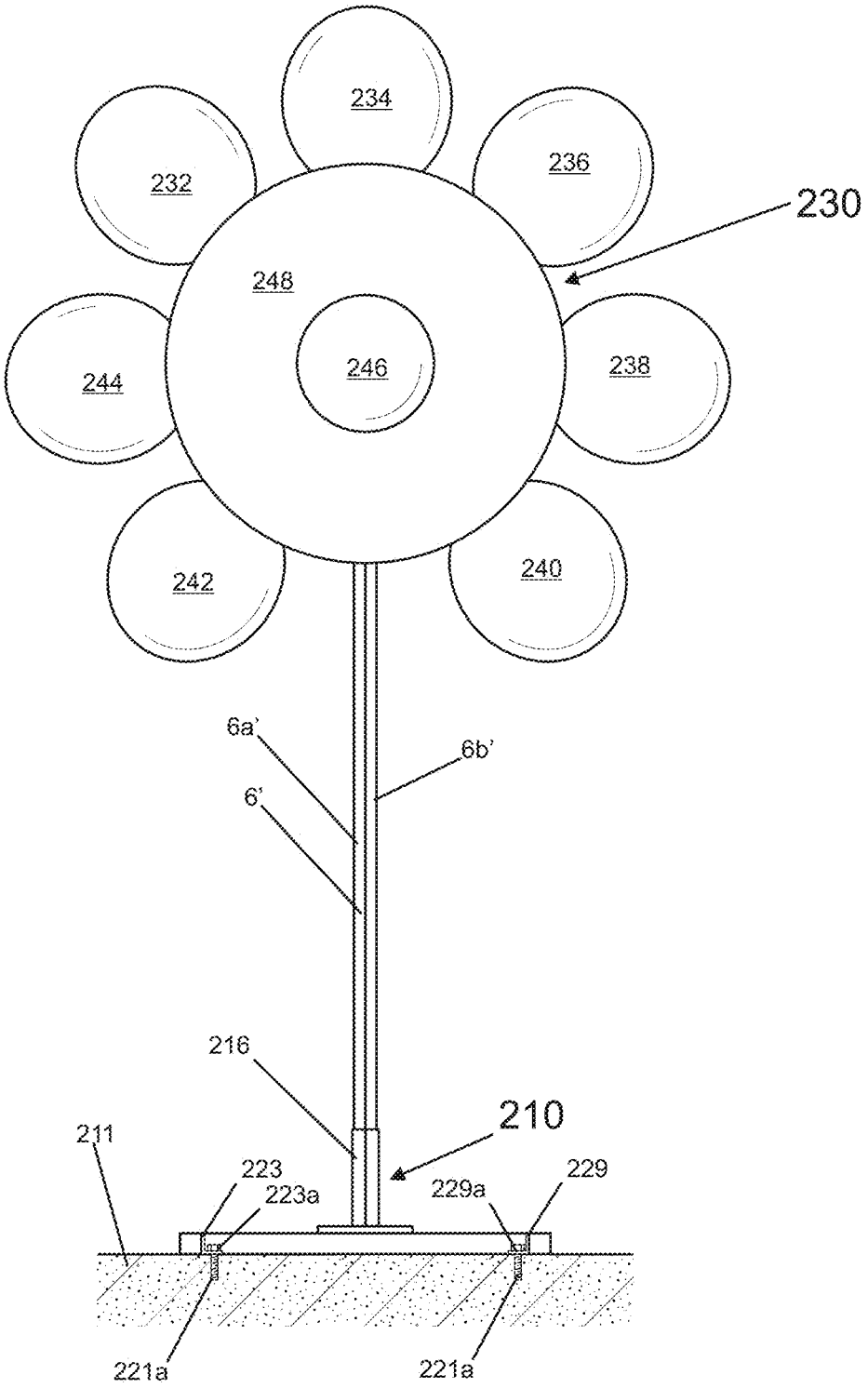
FIG. 17A shows a front view of a fourth target apparatus of an embodiment of the present invention, wherein the fourth target apparatus is fixed to a beam or member, along with a plurality of balloons attached to the fourth target apparatus.
Figure 17B:
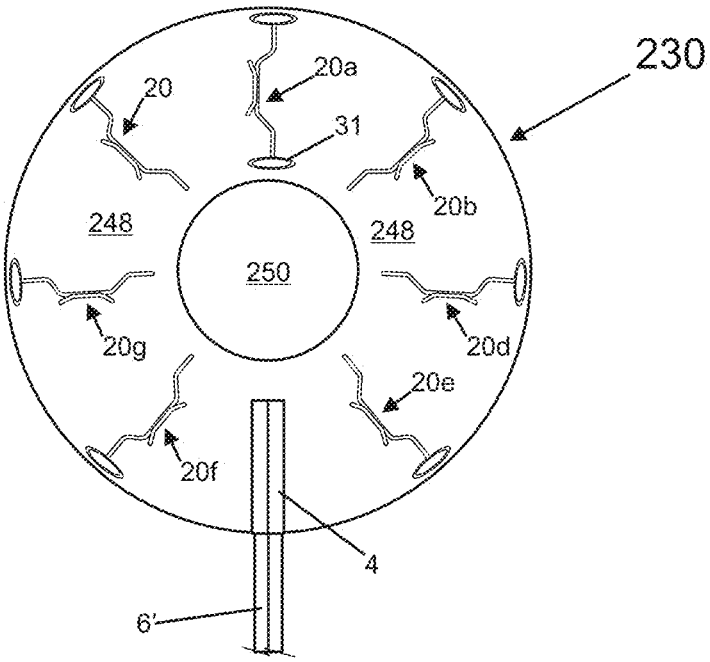
FIG. 17B shows a rear view of the fourth target apparatus with a plurality of cleat apparatuses each of which is similar or identical to that shown in FIG. 3A.

FIG. 17A shows a front view of a target apparatus 230 of an embodiment of the present invention, wherein the target apparatus 230 is fixed to a beam or member 211, along with a plurality of balloons 232, 234, 236, 238, 240, 242, 244, and 246 attached to the target apparatus 230. FIG. 17B shows a rear view of the target apparatus 230 with a plurality of cleat apparatuses 20, 20*a*, 20*b*, 20*c*, 20*d*, 20*e*, 20*f*, and 20*g*, each of which is similar or identical to cleat apparatus 30 shown in FIG. 2A. However, the cleat apparatus 20*a* may include an additional ring 21 shown in FIG. 17B for attachment of center balloon 246.

The target apparatus 230 includes central structure 248 having an opening 250 shown in FIG. 17B, behind which the balloon 246 sits. The target apparatus 230 includes members 4 and 6'.

The ends of balloons 232, 234, 236, 238, 240, 242, 244, and 246 may be inserted through rings of cleat apparatuses 30*b*, 30*a* (top ring in FIG. 17B), 30, 30*g*, 30*f*, 30*e*, 30*d*, and 30*a* (ring 31 in FIG. 17B) to attach the balloons 232, 234, 236, 238, 240, 242, 244, and 246 to the apparatus 230, in a manner similar or identical to that shown by the steps of FIGS. 4A-4E.

Figure 17C:
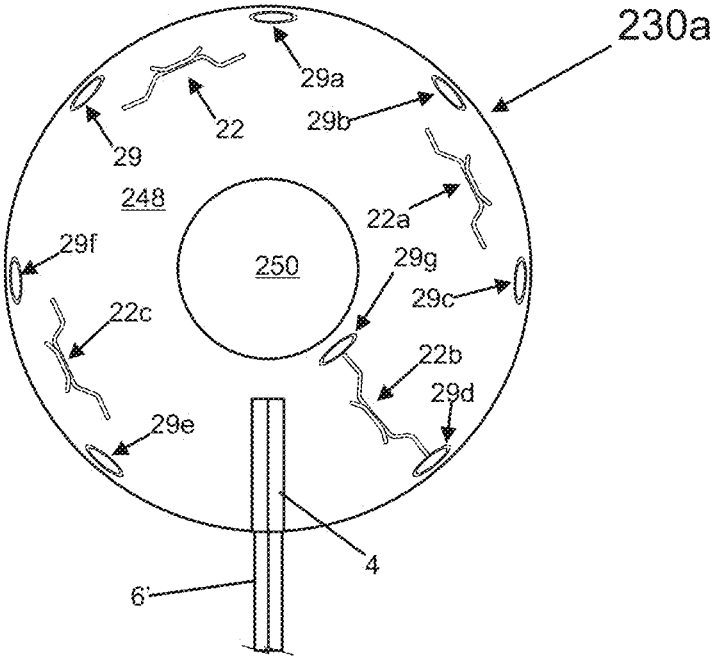
FIG. 17C shows a rear view of an alternative embodiment of the fourth target apparatus, with a plurality of cleat apparatuses, each of which is similar or identical to that shown in FIG. 2A.

FIG. 17C shows a rear view of a target apparatus 230*a*, which is the same as the apparatus 230 except as will be described. The target apparatus 230 includes a plurality of parts of cleat apparatuses similar to or identical to part 22 of FIG. 2A. The target apparatus 230 includes parts 22, 22*a*, 22*b*, and 22*c*. The target apparatus 230 further includes rings 29, 29*a*, 29*b*, 29*c*, 29*d*, 29*e*, 29*f*, and 29*g*.

The ends of balloons 232, 234, 236, 238, 240, 242, 244, and 246 may be inserted through rings of 29*b* (and then attached to part 22*a*), 29*a* (at then attached to part 22), 29 (and then attached to part 22), 29*f* (and then attached to part 22*c*), 29*e* (and then attached to part 22*c*), 29*d* (and then attached to part 22*b*), and 29*g* (and then attached to part 22*b*) to attach the balloons 232, 234, 236, 238, 240, 242, 244, and 246 to the apparatus 230*a*, in a manner similar or identical to that shown by the steps of FIGS. 4A-4E.

FIG. 17A shows base 210 previously referred to in FIG. 16. The base 216 may be, for example, spiked to ground typically horizontal soil or bolted to hard typically horizontal surface, by placing or driving spikes or bolts through openings 223*a*, 225*a*, 227*a*, and 229*a* shown in FIG. 16.

Figure 18A:
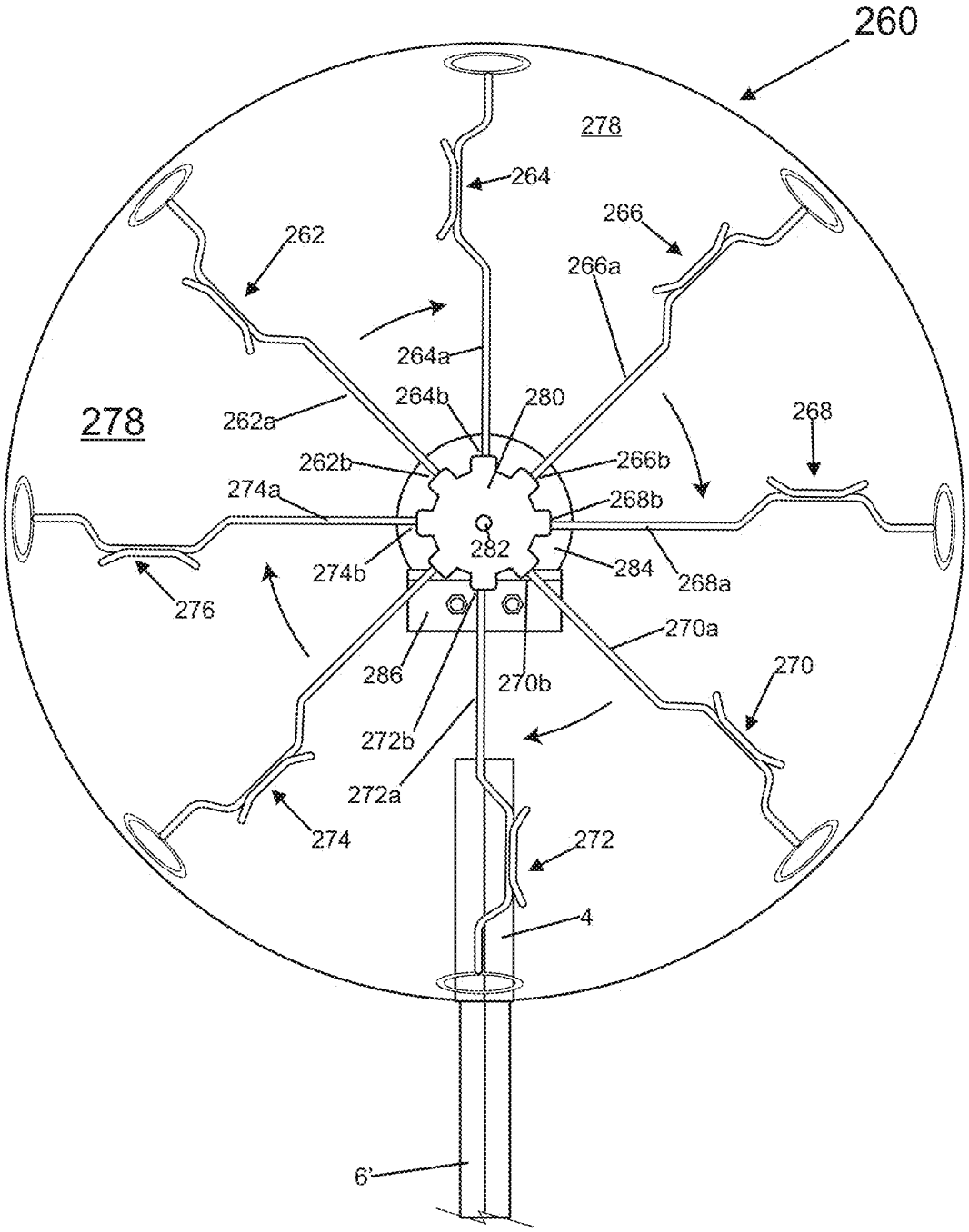
FIG. 18A shows a rear view of a fifth target apparatus, which is a motorized version, in accordance with an embodiment of the present invention.

FIG. 18A shows a rear view of a target apparatus 260 in accordance with an embodiment of the present invention. The target apparatus 260 is a motorized version. The target apparatus 260 includes parts and rings 262, 264, 266, 268, 270, 272, 274, and 276, each of which may be similar or identical to cleat apparatus 30 shown in FIG. 3A. The ends 262*b*, 264*b*, 266*b*, 266*b*, 268*b*, 270*b*, 272*b*, 274*b*, and 276*b* of members 262*a*, 264*a*, 266*a*, 266*a*, 268*a*, 270*a*, 272*a*, 274*a*, and 276*a*, respectively, are shown connected to gear 280. The gear 280 is connected to motor by pivot pin 282 so that gear 280 is configured to rotate with respect to motor 284. The motor 284 is fixed to housing 278 through plate or member 286, which are fixed by screws to housing 278. The housing 261 is connected to L or V-shaped member 4, which is connected to L or V-shaped member 6'.

Figure 18B:
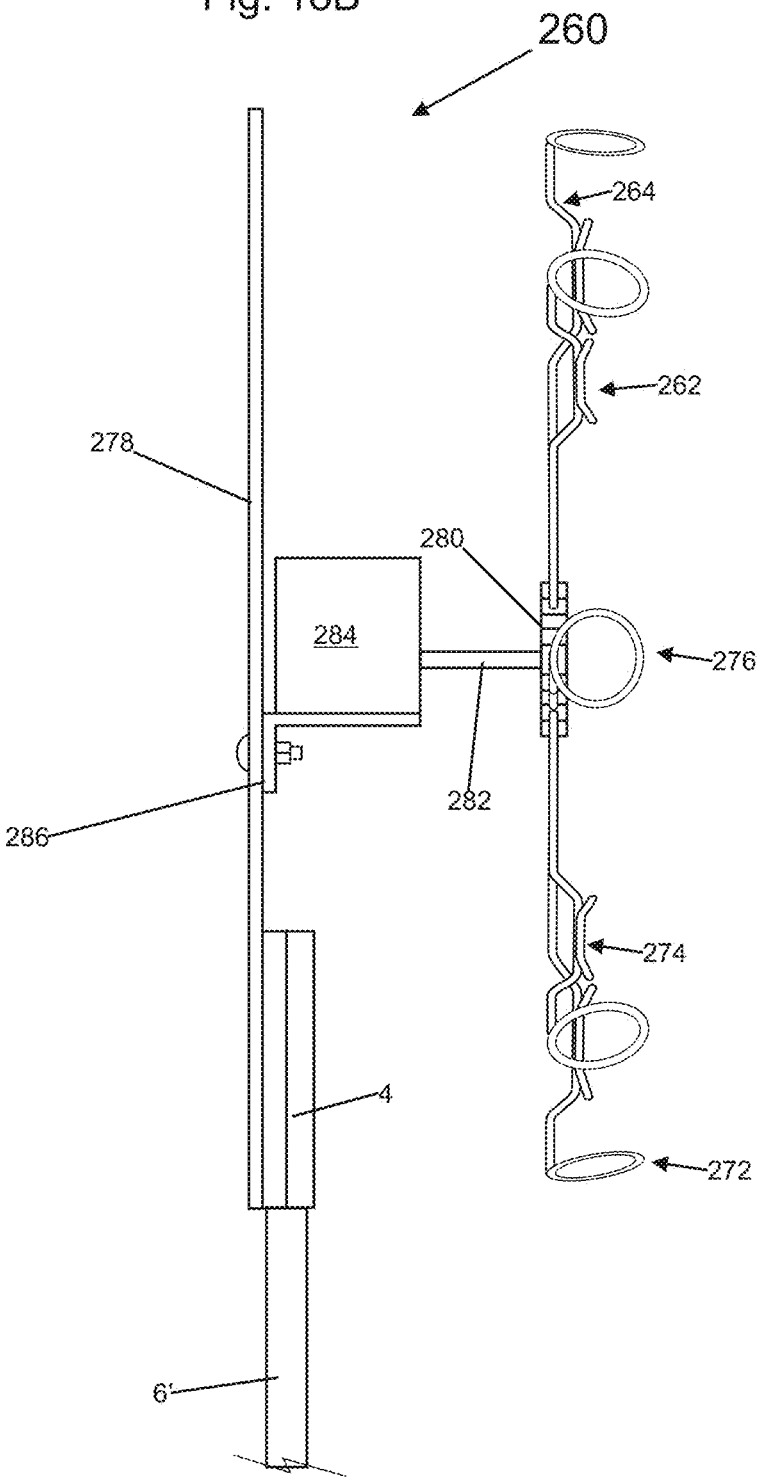
FIG. 18B shows a side view of the fifth target apparatus of FIG. 18A.

FIG. 18B shows a side view of the target apparatus 260 of FIG. 18A.

The ends of balloons 232, 234, 236, 238, 240, 242, 244, and 246, shown in FIG. 17A, may be inserted through rings of 266, 264, 262, 276, 274, 272, and 270, and then attached to the respective cleat apparatus to attach the balloons 232, 234, 236, 238, 240, 242, and 244 the apparatus 230*a*, in a manner similar or identical to that shown by the steps of FIGS. 4A-4E.

Figure 19:
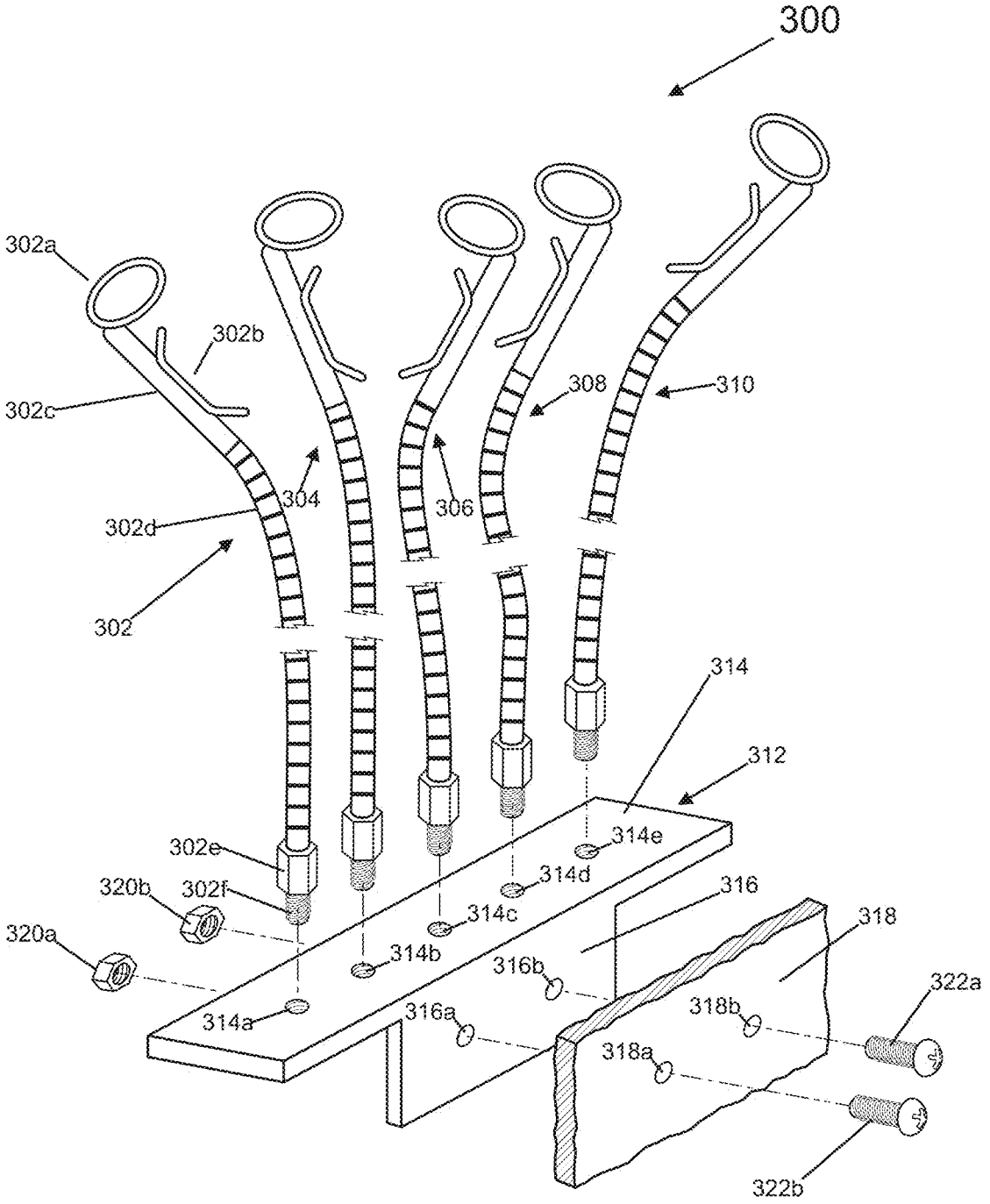
FIG. 19 shows a front, top, and left perspective view of a sixth target apparatus, in a disassembled state in accordance with an embodiment of the present invention.

FIG. 19 shows a front, top, and left perspective view of a target apparatus 300, in a disassembled state in accordance with an embodiment of the present invention.

The target apparatus 300 includes devices 302, 304, 306, 308, and 310. Each of the devices 302, 304, 306, 308, and 310 are identical or substantially identical, and device 302 will be described as representative. The device 302 includes ring 302*a* having a central opening, member 302*b* similar or identical to part 24 shown in FIG. 2A, fixed to member 302*c*, which is connected to flexible member or device 302*d*, which is connected to fastener 302*e* and bolt and/or grooves or outer threads 302*f*. The bolt or grooves or outer threads 302*f* is configured to be screwed into and/or inserted into opening 314*a* to attach device 302 to member 312.

The apparatus 300 of FIG. 19 may provide a quick connect option.

Similarly or identically, the devices 304, 306, 308, and 310 are configured to be attached to plate 312 by being inserted through openings 314*b*-314*e*, respectively.

The plate 312 is fixed to a plate 316 at a right angle. The plate 316 may be fixed to a plate or wall 318 by bolts 322*a* and 322*b* being inserted through openings 318*a* and 318*b* into plate 316*a* and 316*b*, and then connected to nuts 320*a* and 320*b* respectively. The plate or wall 318 may be part of an existing steel target and the apparatus 300 may be fixed to the existing steel target, wall, or plate 318.

Ends of balloons may be inserted through rings of devices 302, 304, 306, 308, and 310, respectively, similar or identical to as shown by the steps of FIGS. 4A-4E.

The part 302*b*, in the present application and similar or identical parts, may be referred to as a cleat by itself, or in combination with one or more further components.

Figure 20A:
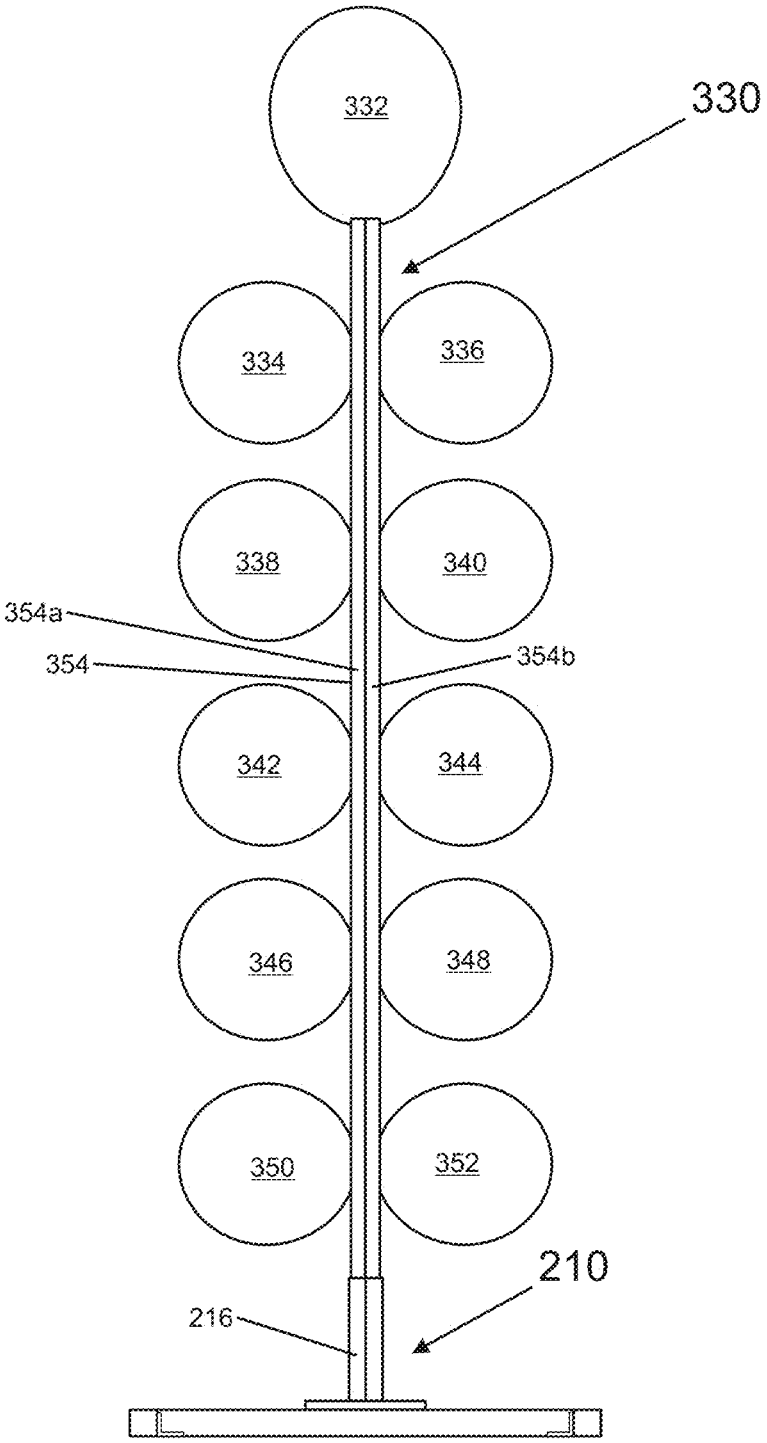
FIG. 20A shows a front view of a seventh target apparatus in accordance with an embodiment of the present invention, along with a plurality of attached balloons.

FIG. 20A shows a front view of a target apparatus 330 in accordance with an embodiment of the present invention, along with a plurality of attached balloons 332, 334, 336, 338, 340, 342, 344, 346, 348, 350, and 352. The apparatus 330 may include L or V-shaped member 354 having members 354a and 354b, which are at an angle with respect to each other. The member 354 may be inserted into the member 216 of the universal base 210 previously described with reference to FIG. 16.

Figure 20B:
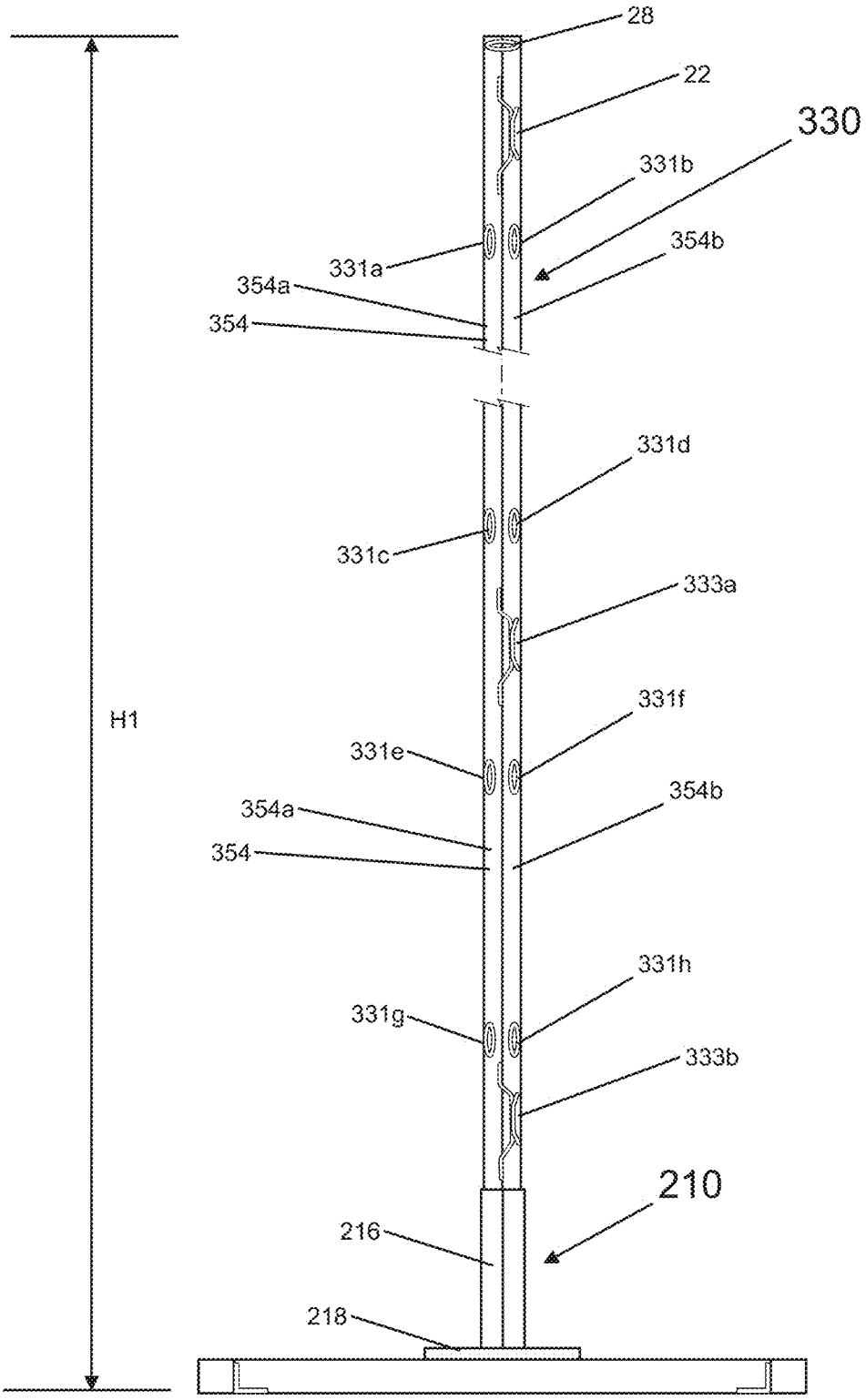
FIG. 20B shows a rear of the seventh target apparatus.

FIG. 20B shows a rear view of the target apparatus 330. The target apparatus 330 may include cleats or cleat portions 22, 333a, and 333b as shown in FIG. 20B. The target apparatus 330 may further include rings 28, 331a, 331b, 331c, 331d, 331e, 331f, 331g, and 331h as shown in FIG. 20B. The balloons 332, 334, and 336 may be attached to cleat 22 by inserting ends through rings 28, 331, and 331b, and attaching to cleat 22 in a manner similar or identical to as shown by steps of FIGS. 4A-4E. The balloons 338, 340, 342, and 344 may be attached to cleat 333a by inserting ends through rings 331c, 331d, 331e, and 331f, and attaching to cleat 333a in a manner similar or identical to as shown by steps of FIGS. 4A-4E. The balloons 346, 348, 350, and 352 may be attached to cleat 333b by inserting ends through rings 331g, and 331h, and two more rings not shown, and attaching to cleat 333b in a manner similar or identical to as shown by steps of FIGS. 4A-4E.

FIG. 20B shows that there may be variable vertical heights H1 for the target apparatus 330, by showing a broken away portion of the members 354, 354a and 354b. In at least one embodiment, the vertical height H1 of the target apparatus 330 is perpendicular or substantially perpendicular to the base plate 218 which is typically parallel to a ground surface or member to which the base 210 is fixed.

Figure 21A:
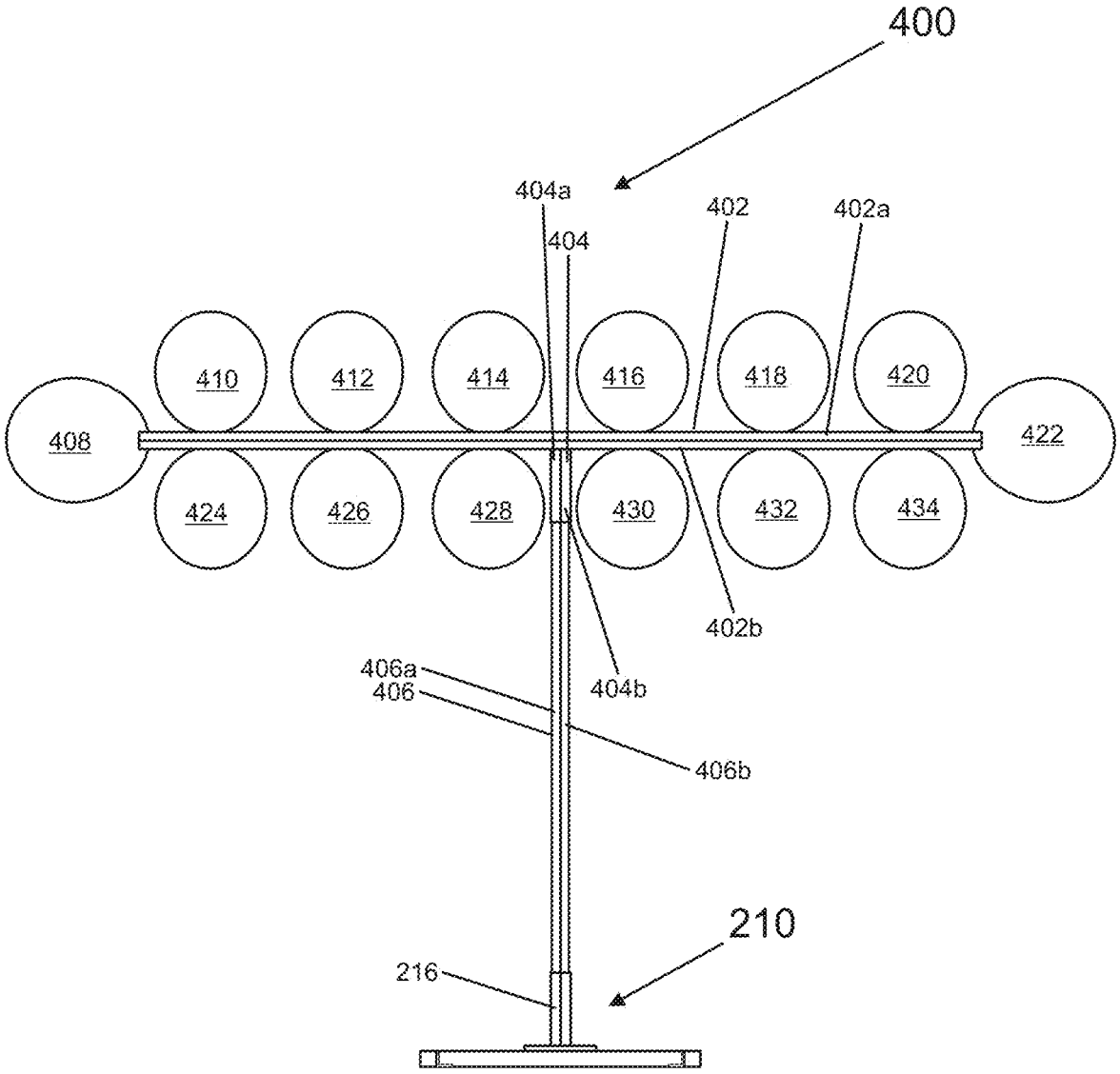
FIG. 21A shows a front view of an eighth target apparatus in accordance with an embodiment of the present invention, along with a plurality of attached balloons.

FIG. 21A shows a front view of a target apparatus 400 in accordance with an embodiment of the present invention, along with a plurality of attached balloons 408, 410, 412, 414, 416, 418, 420, 422, 424, 426, 428, 430, and 434.

The target apparatus 400 includes L or V-shaped member 402 having members 402a and 402b which are at an angle with respect to each other; L or V-shaped member 404 having members 404a and 404b which are at an angle with respect to each other; L or V-shaped member 406 having members 406a and 406b which are at an angle with respect to each other; and base 210 including L- or V-shaped member 216 having two members at an angle with respect to each other.

Figure 21B:
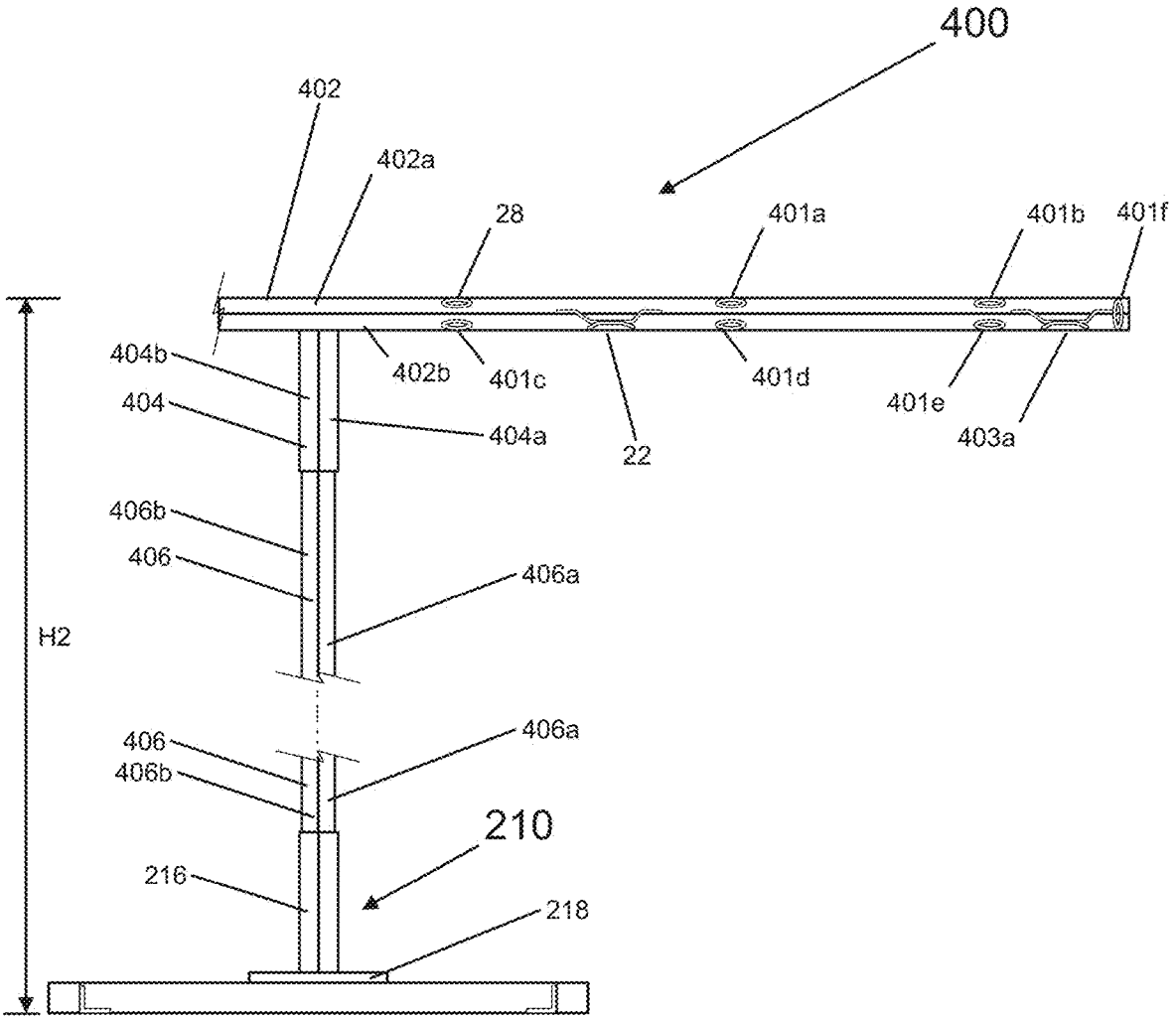
FIG. 21B shows a partial rear view of the eight target apparatus of FIG. 21A without any attached balloons.

FIG. 21B shows a partial rear view of the target apparatus 400 of FIG. 21A without any attached balloons. The target apparatus 400 includes rings 28, 401a, 401b, 401c, 401d, 401e, and 401f, shown in FIG. 21B. The target apparatus 400 further includes cleats 22 and 403a. The target apparatus 400 includes further rings and cleats, but these are not shown in FIG. 21B. Ends of the balloons 408, 410, and 424 shown in FIG. 21A are configured to be inserted through rings 401f, 401b, and 401e, and attached to cleat 403a, similar to or identical to as shown by steps of FIGS. 4A-4E. Ends of balloons 412, 414, 426, and 428 in FIG. 21A are configured to be inserted through rings 401a, 28, 401c, and 401d shown in FIG. 21B, and then attached to cleat 22, similar or identical to as shown by steps of FIGS. 4A-4E.

FIG. 21B shows one side of the member 402, and the other side of the member 402 has a mirror image of cleats and rings (so there would be seven more rings similar or identical to ring 28, and two more cleats, similar or identical to cleat 22) for another seven balloons for the total of fourteen balloons in FIG. 21A.

FIG. 21B shows that there may be variable vertical heights H2 for the target apparatus 400, by showing a broken away portion of the members 406, 406a, and 406b. In at least one embodiment, the vertical height H2 of the target apparatus 400 is perpendicular or substantially perpendicular to the base plate 218 which is typically parallel to a ground surface or member to which the base 210 is fixed.

Figure 22:
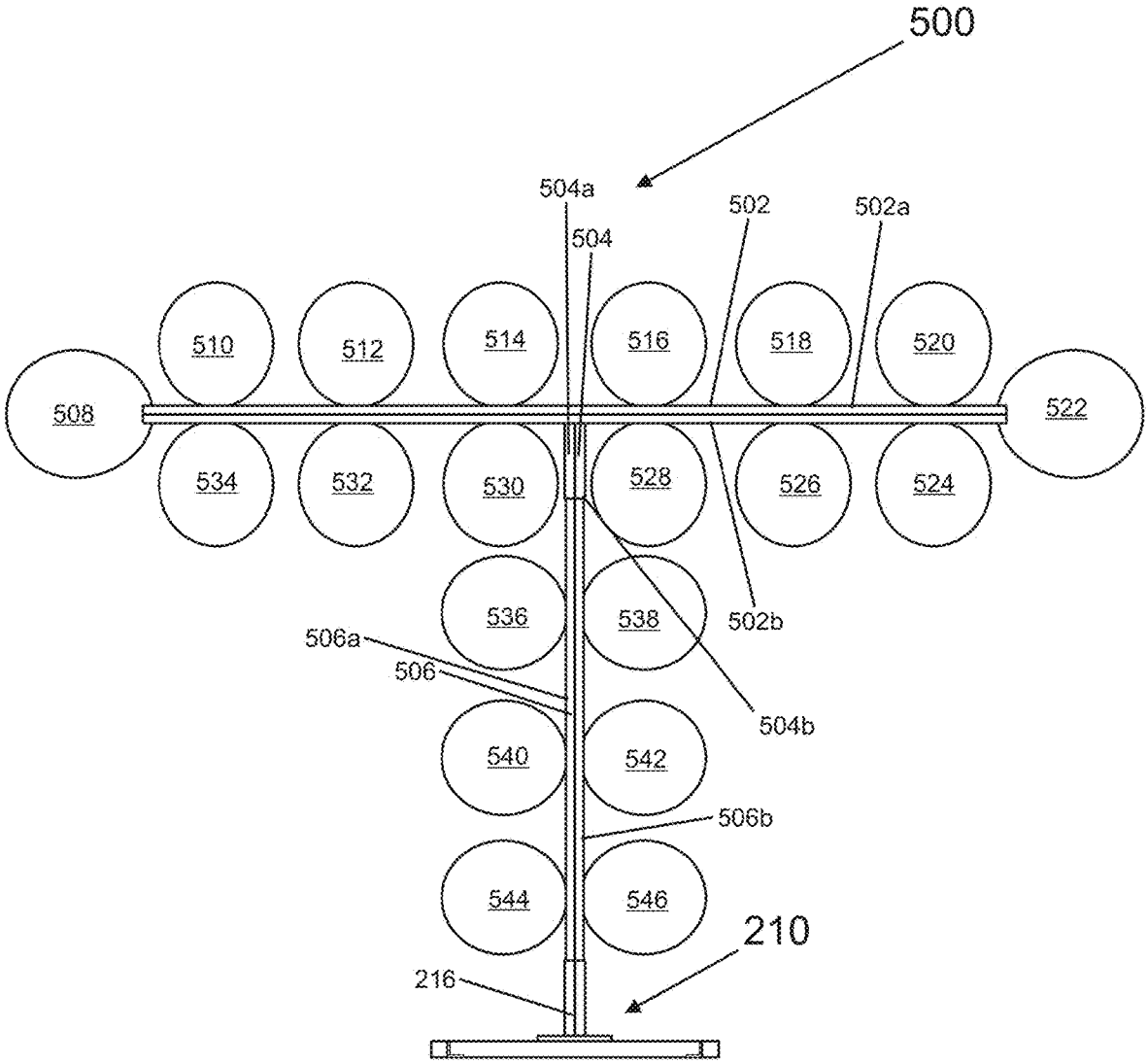
FIG. 22 shows a front view of a ninth target apparatus in accordance with an embodiment of the present invention, along with a plurality of attached balloons.

FIG. 22 shows a front view of a target apparatus 500 in accordance with an embodiment of the present invention, along with a plurality of attached balloons 508, 510, 512, 514, 516, 518, 520, 522, 524, 526, 628, 530, 532, 534, 536, 538, 540, 542, 544, and 546.

The target apparatus 500 includes L or V-shaped members 502, 504, 506, and 216. Member 502 includes members 502a and 502b. Member 504 includes members 504a, and 504b. Member 506 includes member 506a and 506b. Member 216 includes two members at an angle with respect to each other. The apparatus 500 also includes universal base 210.

The member 502 may be similar or identical to the member 402 shown in FIG. 21B allowing for attachment of up to fourteen balloons to the member 402. The member 506 may be similar to the member 402 and have rings and cleats for attachment of up to six balloons, such as with two rings and one cleat for every two balloons or six rings and one cleat for all six ballons (of balloons 536, 538, 540, 542, 544, and 546).

Figure 23A:
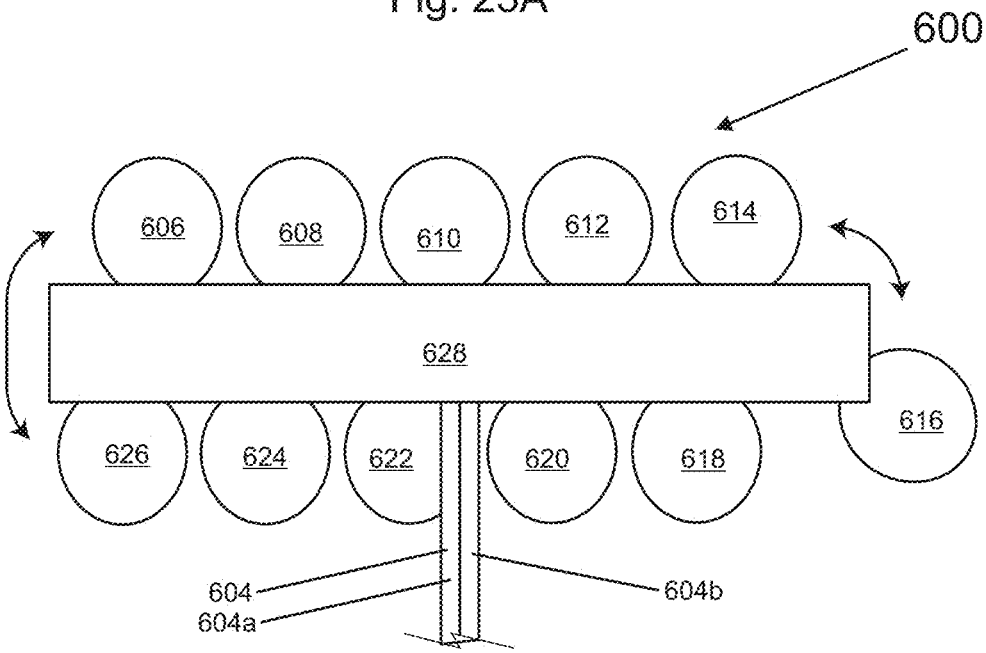
FIG. 23A shows a front view of a tenth target apparatus, which is a motorized version with rotation, in accordance with an embodiment of the present invention, along with a plurality of attached balloons.
Figure 23B:
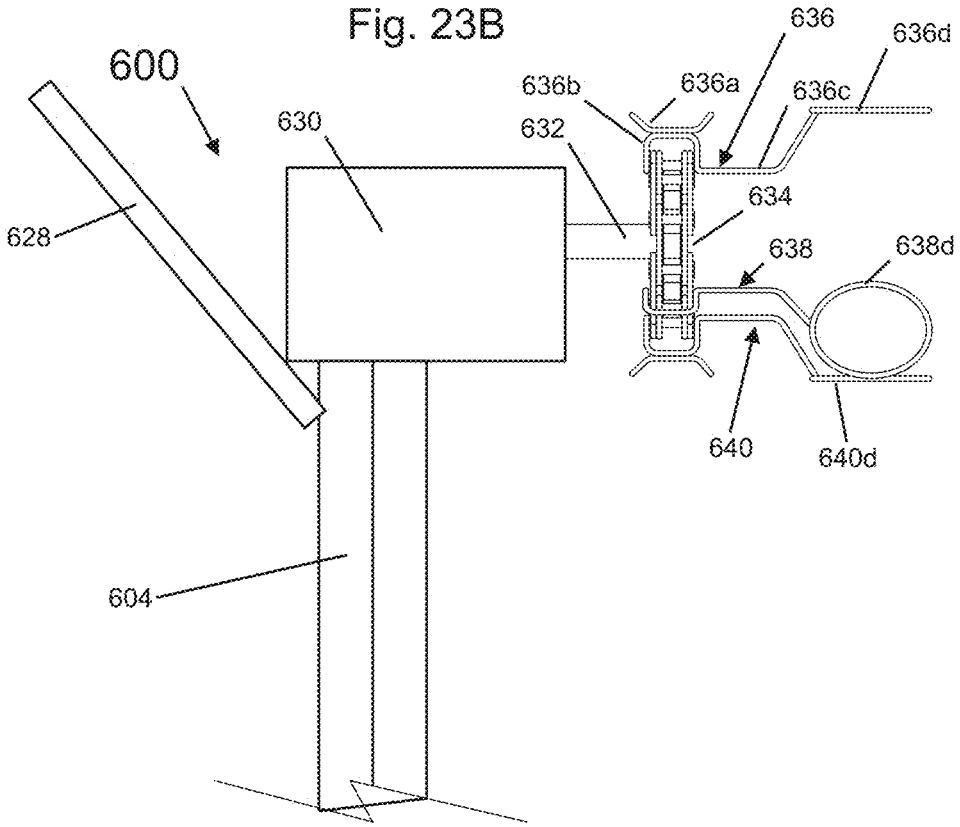
FIG. 23B shows a side view of the tenth target apparatus, without any attached balloons.
Figure 23C:
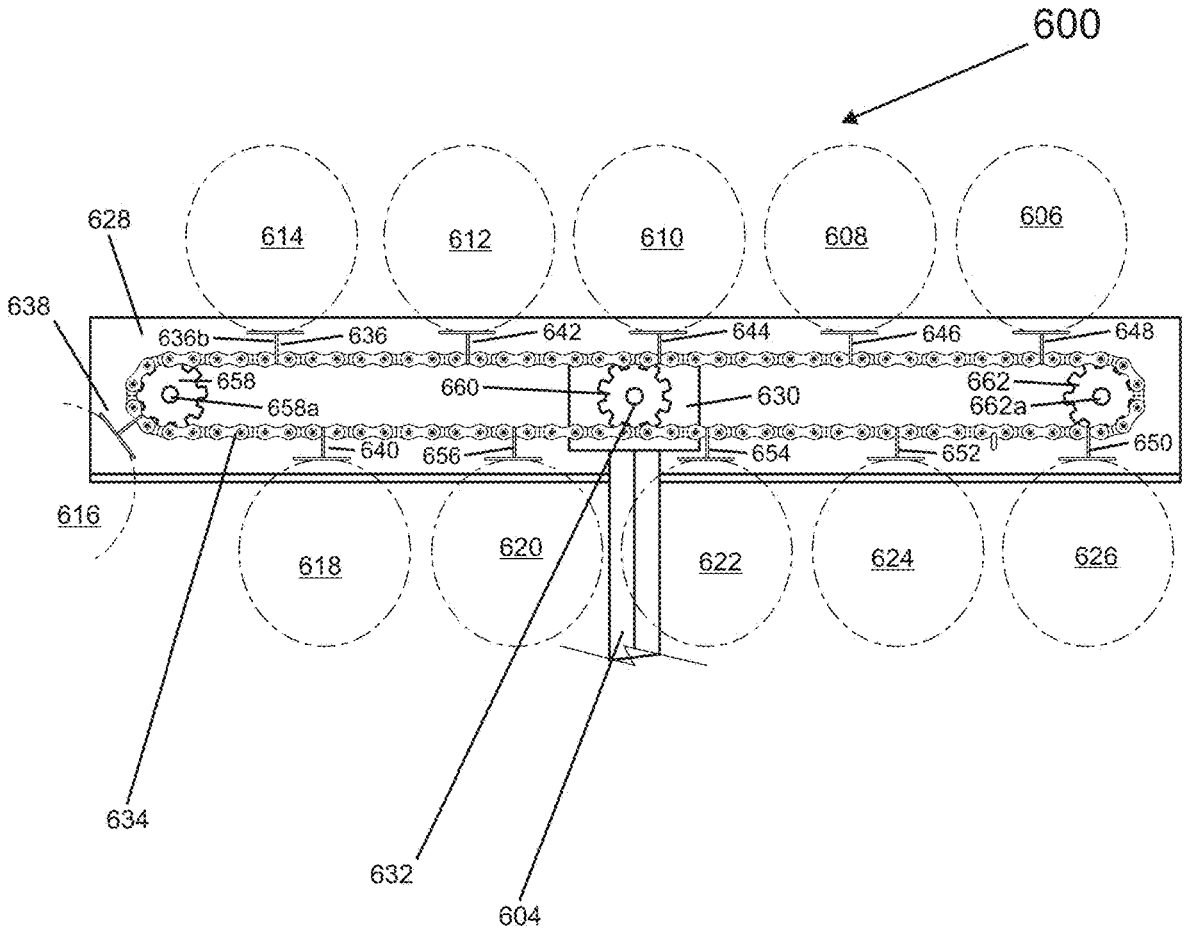
FIG. 23C shows a rear view of the tenth target apparatus, along with a plurality of balloons shown by dashed lines.

FIG. 23A shows a front view of a target apparatus 600 in accordance with an embodiment of the present invention, along with a plurality of attached balloons 606, 608, 610, 612, 614, 616, 618, 620, 622, 624, and 626. FIG. 23B shows a side view of the target apparatus 600, without any attached balloons. FIG. 23C shows a rear view of the target apparatus 600, along with the plurality of balloons (606-626) shown by dashed lines.

The target apparatus 600 includes a motor 630, a base plate 628, a member 604, a pivot pin or shaft 632, a chain 634, and cleat apparatuses 636, 638, 640, 642, 644, 646, 648, 650, 652, 654, and 656. Each of cleat apparatuses 636-656 may include a cleat or cleat portion similar or identical to portion 24 shown in FIG. 3A, fixed to a portion 26c, which is connected to a perpendicular member, which is connected to chain 34 at various increments, such as an equal increments so that the cleats 636, 638, 640, 642, 644, 646, 648, 650, 652, 654 move when the chain 634 rotates due to rotation of gear 660. A pin or shaft 632 connects gear 660 to motor 630, and the motor rotates pin 632 to rotate gear 660 to rotate chain 634. The gears 658 and 662, which are not connected to shaft or pin 632 of motor 630 also rotate, on pins 658a and 662a, respectively, due to movement of chain 634.

The motor 630 may be powered by direct wired connection to an electrical outlet or may be powered by a battery which may be part of motor or motor apparatus 630.

The balloons 606, 608, 610, 612, 614, 616, 618, 620, 622, 624, and 626 are connected to cleat apparatuses 648, 646, 644, 642, 636, 638, 640, 656, 654, 652, and 650, respectively, in a manner similar or identical to that shown by steps of FIGS. 4A-4E.

Each cleat apparatus of cleat apparatuses 648, 646, 644, 642, 636, 638, 640, 656, 654, 652, and 650 has a ring attached to it for inserting an end of a balloon through a center of the particular ring. For example, as shown in FIG. 23B, the cleat apparatuses 636, 638, and 640 have rings 636d, 638d, and 640 respectively.

Figure 24A:
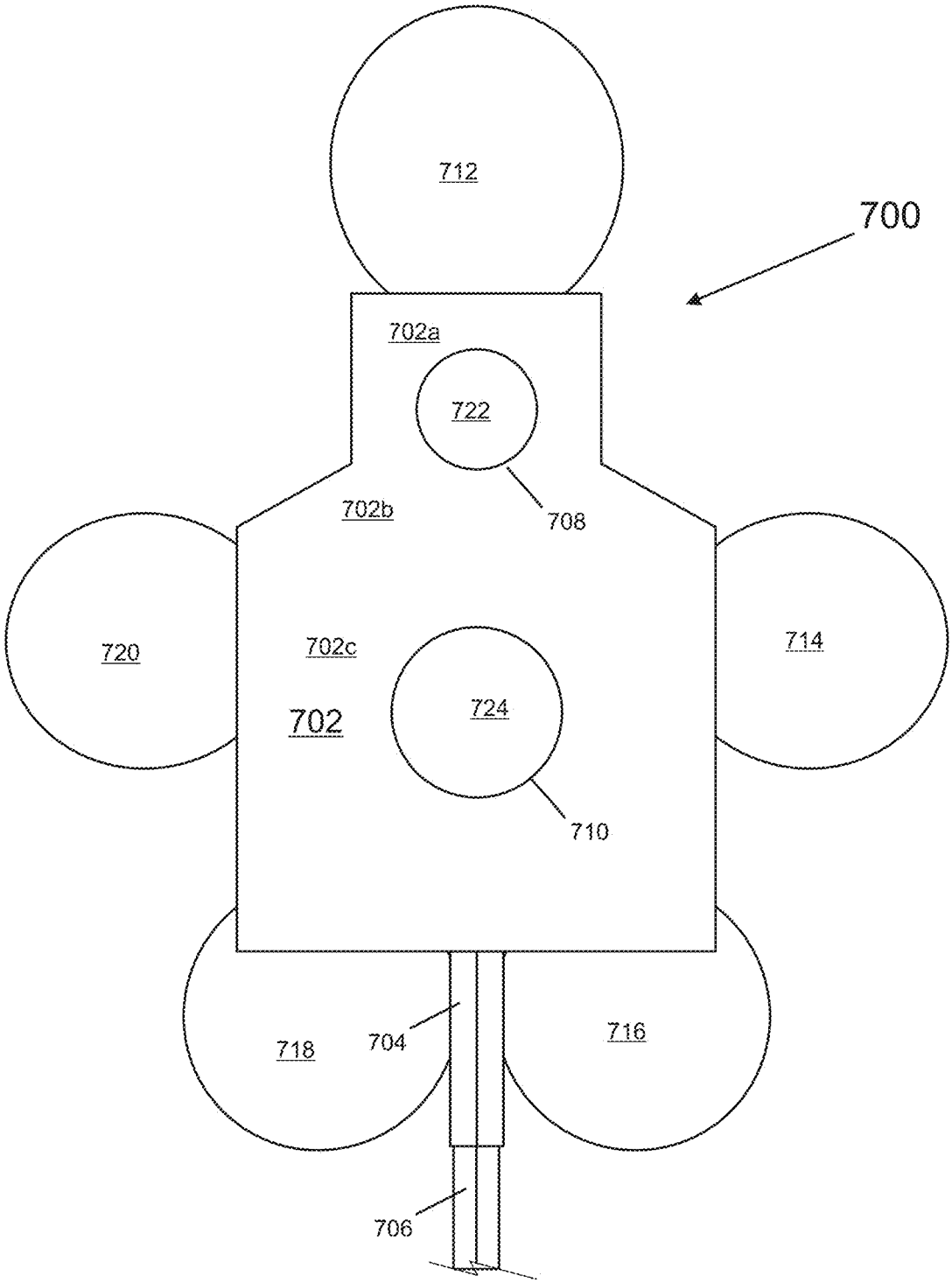
FIG. 24A shows a front view of an eleventh target apparatus along with a plurality of attached balloons.
Figure 24B:
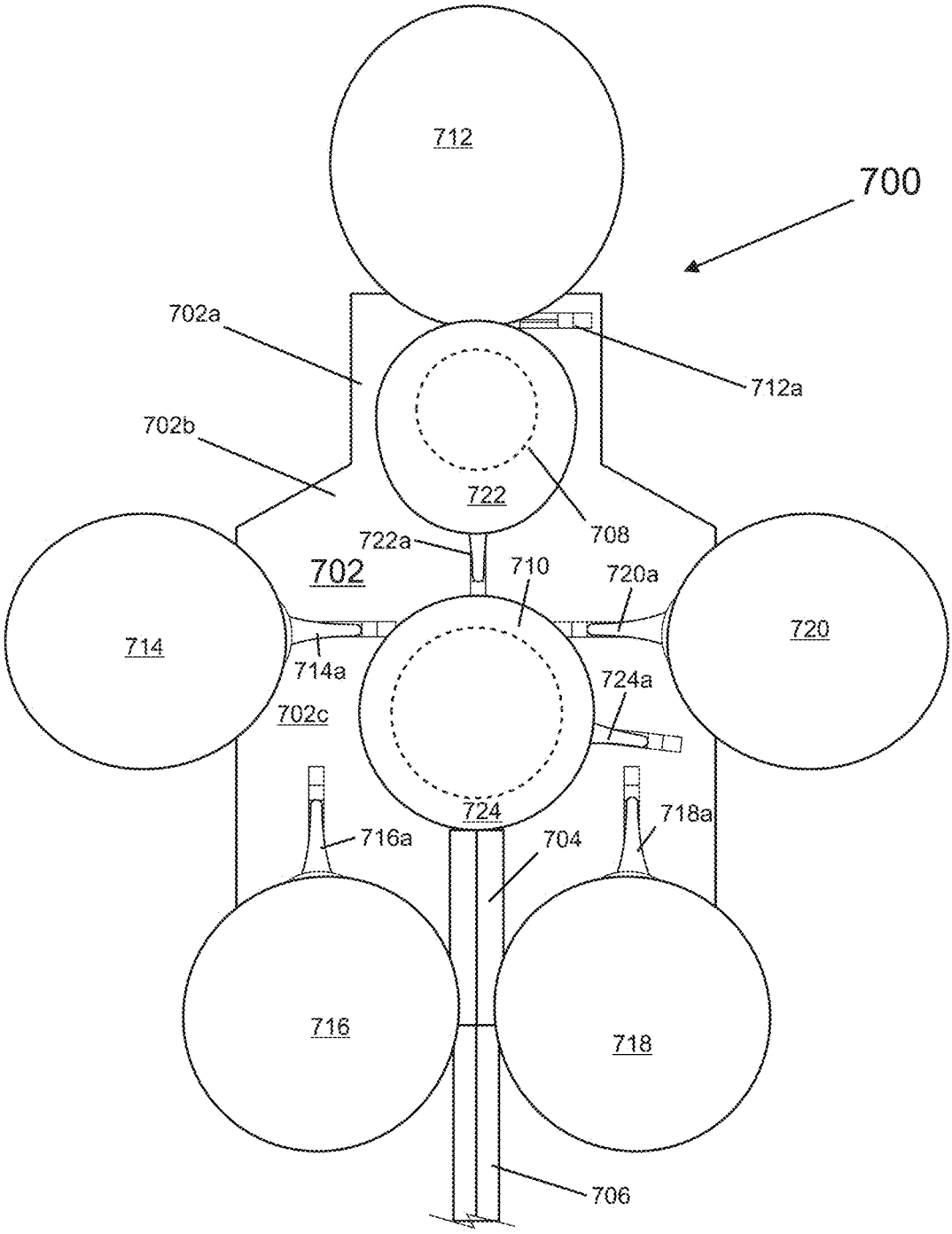
FIG. 24B shows a rear view of the eleventh target apparatus along with a plurality of attached balloons.
Figure 24C:
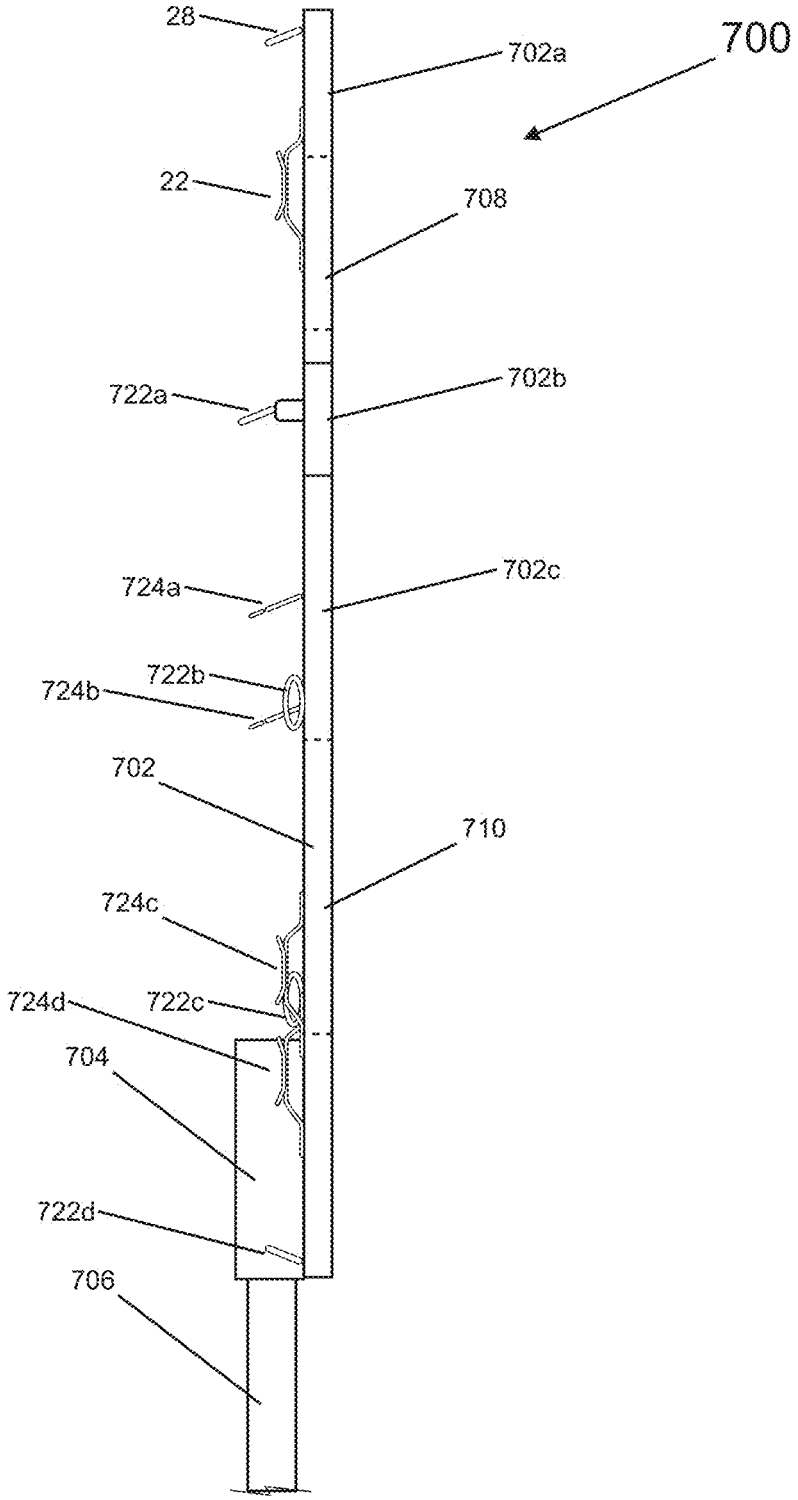
FIG. 24C shows a side view the eleventh target apparatus without any attached balloons.

FIG. 24A shows a front view of a target apparatus 700 along with a plurality of attached balloons 712, 714, 716, 718, 720, 722, and 724. FIG. 24B shows a rear view of the target apparatus 700 along with the plurality of attached balloons 712-724. FIG. 24C shows a side view the target apparatus 700 without any attached balloons.

The target apparatus 700 includes a metal plate 702 which has portions 702*a* (neck), 702*b* (shoulder), and 702*c* (body). The body portion 702*c* has an opening 710 shown in dashed lines in FIG. 24B. The neck portion 702*a* has an opening 708 shown in dashed lines in FIG. 24B. The plate 702 may be made of steel or hardened steel, or AR 500 steel, or a material of a type used for a metal target or a hardened target at a firearm target range.

The balloons have ends 714*a*, 716*a*, 718*a*, 720*a* 722*a*, and 712*a*, which are attached to cleat or cleat portions which may be similar to cleat or cleat portions 22 shown in FIG. 2A.

FIG. 24C shows rings 28, 722*a*, 722*b*, 722*c*, and 722*d*, and cleats or cleat portions 22, 724*a*, 724*b*, 724*c*, and 724*d*, fixed to housing or plate 702. Each of the cleats or cleat portions 22, 724*a*, 724*b*, 724*c*, and 724*d*, may be or may be replaced by any one of the cleat portions 22, 32, 52, 62, 72, 82, 102, 112, 122, or 132 described previously. The target apparatus 700 includes L or V-shaped members 704 and 706, wherein member 704 is fixed to housing or plate 702.

Figure 24D:
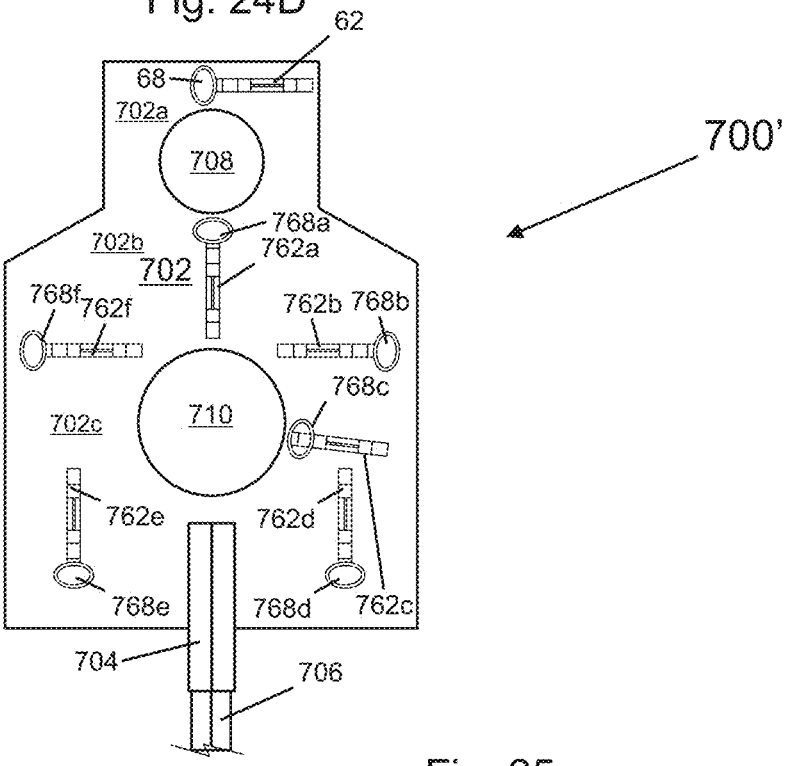
FIG. 24D shows a rear view of the eleventh target apparatus without any attached balloons, and with the fourth cleat apparatus of FIG. 6A used.

FIG. 24D shows a rear view of the target apparatus 700' without any attached balloons, and which may be identical to apparatus 700 except as will be described. The apparatus 700' includes cleat apparatus 60 of FIG. 6A. The version shown in FIG. 24D includes openings 708 and 710, plate 702 having portions 702*a*, 702*b*, and 702*c*, rings 68, 768*a*, 768*b*, 768*c*, 768*d*, 768*e*, and 768*f*, and cleats or cleat portions 62, 762*a*, 762*b*, 762*c*, 762*d*, 762*e*, and 762*f*. Balloons 714, 712, 720, 718, 716, 722, and 724 are configured to be attached to cleats or cleat portions 762*b*, 62, 762*f*, 762*e*, 762*d*, 762*a*, and 762*c* through rings 768*b*, 68, 768*f*, 768*e*, 768*d*, 768*a*, and 768*c* respectively, in a manner similar or identical to the steps shown for FIGS. 4A-4E.

Figure 25:
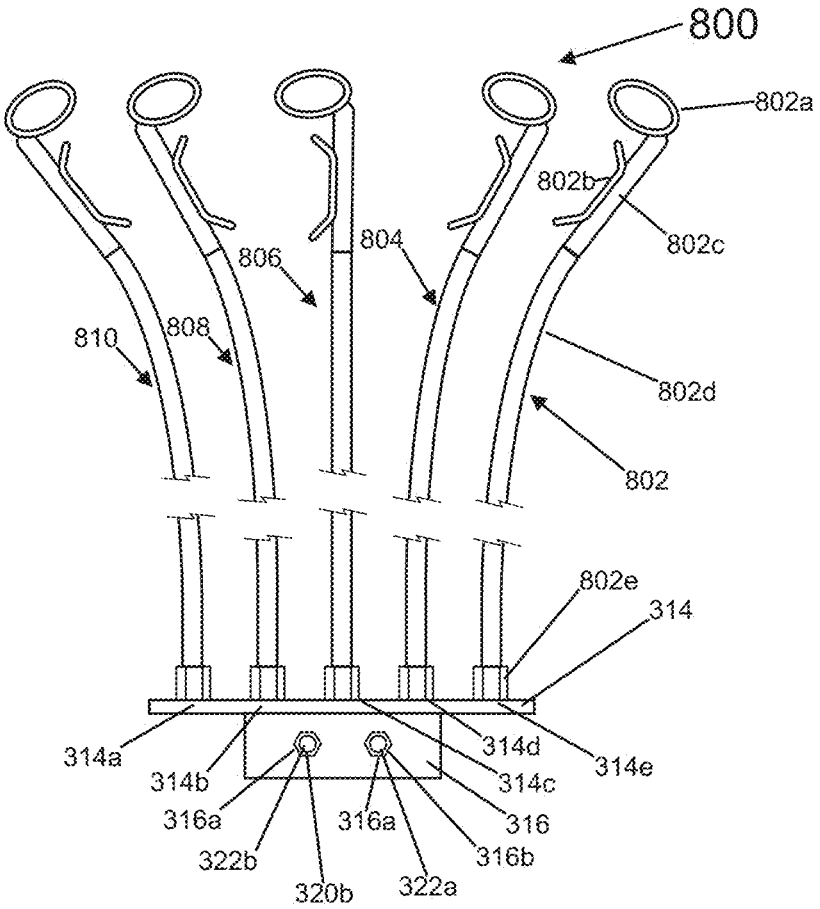
FIG. 25 shows a front view of a twelfth target apparatus in accordance with an embodiment of the present invention.

FIG. 25 shows a front view of a target apparatus 800 in accordance with an embodiment of the present invention. The target apparatus includes devices 802, 804, 806, 808, and 810. Each of the devices 802-810 may be identical and device 802 will be described in further detail.

The device 802 includes ring 802*a*, member 802*b* (which may be identical or substantially similar to part 24 show in FIG. 3A), member 802*c* (which may be identical to member 26*c* shown in FIG. 2A), member 802*d* (which may be a flexible member), and nut 802*e* (which may be identical to nut 302*e* shown in FIG. 19), and there also may be a threaded end (similar or identical to end 302*f* shown in FIG. 19) for connecting to member 314 through opening 314*e*. The devices 810, 808, 806, and 804 may connect to the member 314 in a similar or identical manner to device 802 through openings 314*a*, 314*b*, 314*c*, and 314*d*, respectively. The member 314 may be fixed perpendicular to the member 316 similar or identical to as shown in FIG. 19. The member 316 may be fixed to a wall member or existing firearms target, such as an existing steel firearms target, through bolts 322*a* and 322*b* and corresponding nuts 320*a*, and 320*b* through openings 316*a*, and 316*b*, respectively, similar or identical to as shown in FIG. 19.

Figure 26:
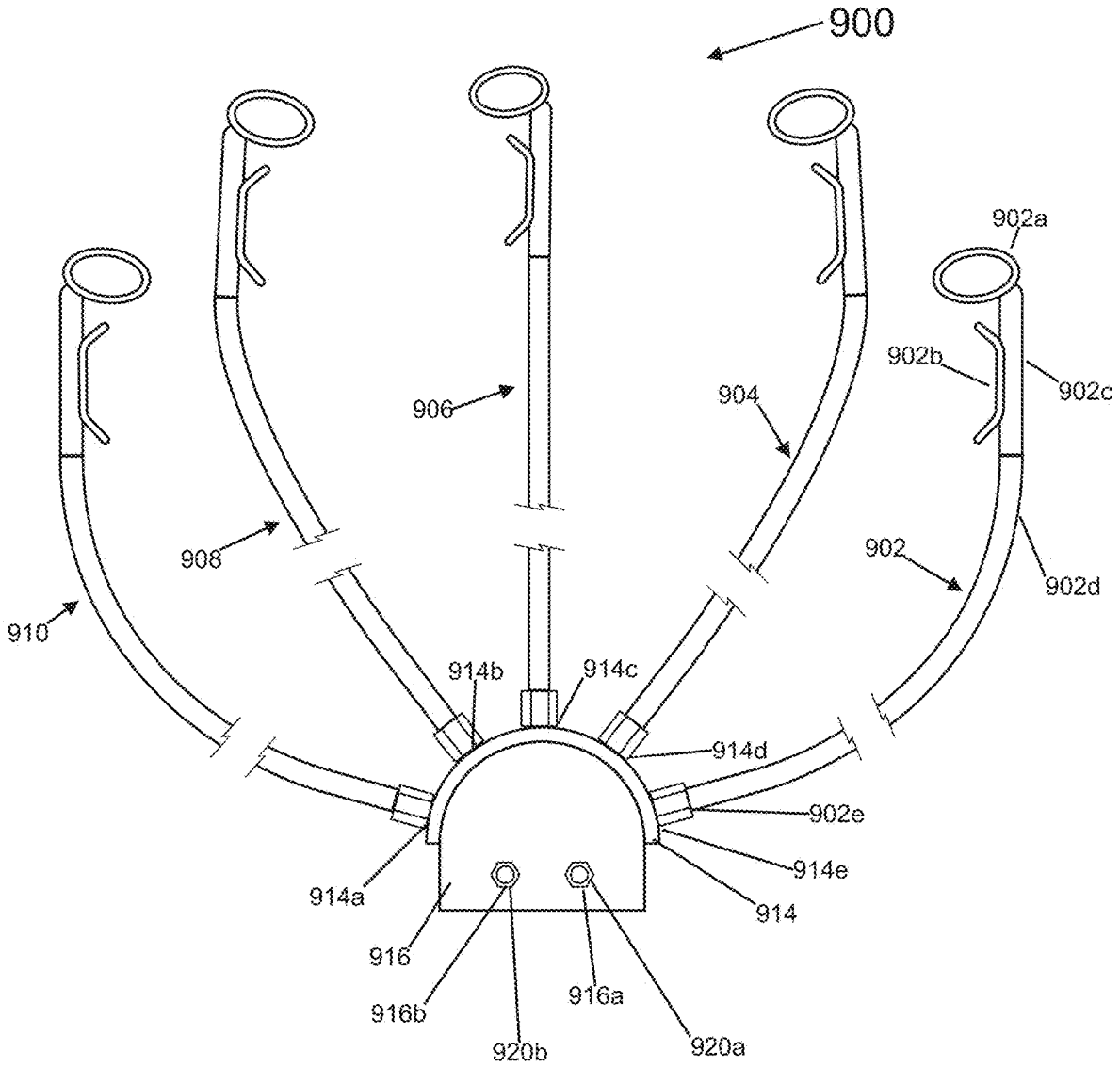
FIG. 26 shows a front view of a thirteenth target apparatus in accordance with an embodiment of the present invention.

FIG. 26 shows a front view of a target apparatus 900 in accordance with an embodiment of the present invention. The target apparatus 900 includes devices 902, 904, 906, 908, and 910. Each of the devices 902-910 may be identical to each other and device 902 will be described in further detail.

Device 902 includes ring 902*a*, member 902*b* (which may be identical or substantially similar to part 24 show in FIG. 3A), member 002*c* (which may be identical to member 26*c* shown in FIG. 2A), member 902*d* (which may be a flexible member), and nut 902*e* (which may be identical to nut 302*e* shown in FIG. 19), and there also may be a threaded end (similar or identical to end 302*f* shown in FIG. 19) for connecting to member 914 through opening 914*e*. Instead of nut 902*e*, a known quick connect mechanism may be provided.

Figure 27A:
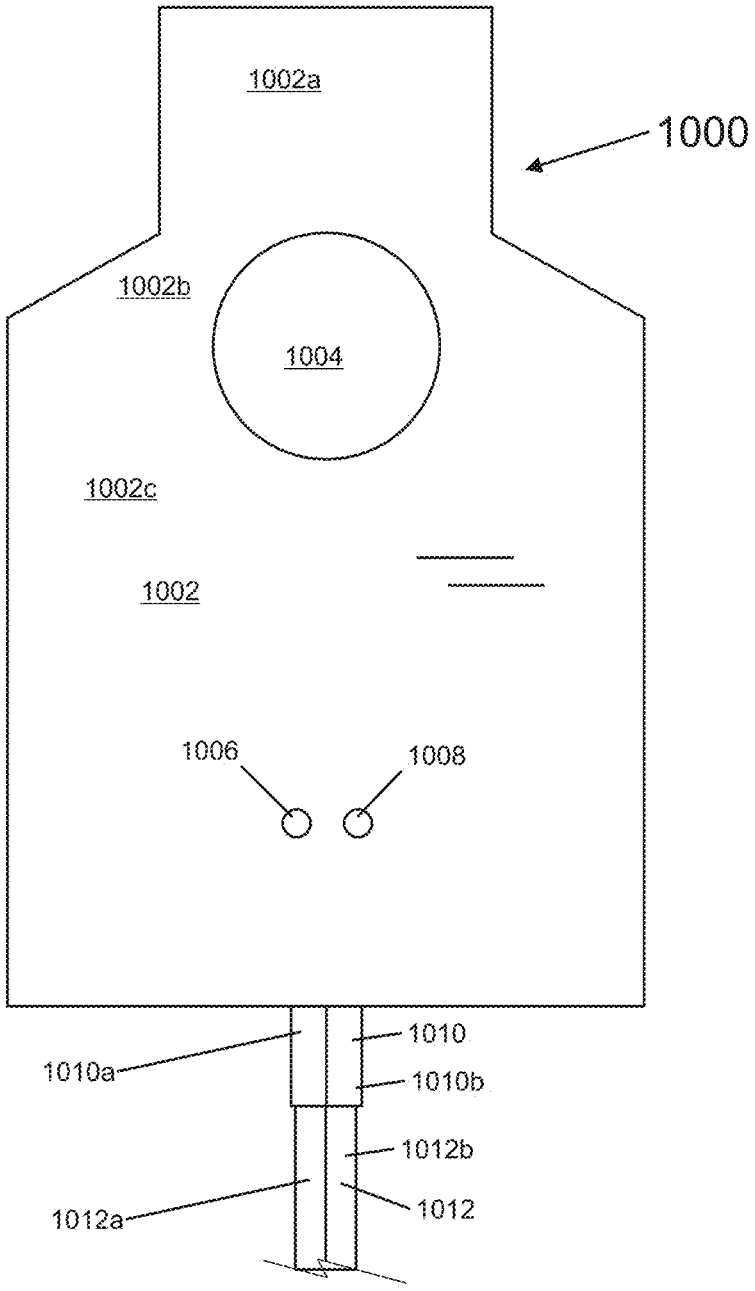
FIG. 27A shows a front view of a fourteenth target apparatus in accordance with an embodiment of the present invention.

The devices 910, 908, 906, and 904 may connect to the member 914 in a similar or identical manner to device 902 through openings 914*a*, 914*b*, 914*c*, and 914*d*, respectively. The member 914 may be fixed to the member 916 similar or identical to as shown in FIG. 19, except that the member 914 is curved and the member 916 has a curved top. The member 916 may be fixed to a wall member or to an existing steel target or existing firearms target, through bolts and/or nuts 920*b*, and 920*a* through openings 916*b*, and 916*a*, respectively, similar or identical to as shown in FIG. 19. FIG. 27A shows a front view of a target apparatus 1000 in accordance with an embodiment of the present invention. The target apparatus 1000 includes plate 1002, which is comprised of portions 1002*a*, 1002*b*, and 1002*c*. The plate 1002 has an opening 1004, and openings 1006 and 1008. The target apparatus 1000 includes L or V-shaped members 1010 and 1012. The member 1010 includes members 1010*a* and 1010*b* which are preferably at an angle of between thirty and ninety degrees with respect to each other to provide deflection of projectiles, similar or identical to as shown in FIG. 13B for members 4*a* and 4*b*. Similarly, member 1012 includes members 1012*a* and 1012*b* which are preferably at an angle of between thirty and ninety degrees with respect to each other to provide deflection of projectiles, similar or identical to as shown in FIG. 13B for members 4*a* and 4*b*.

Figure 27B:
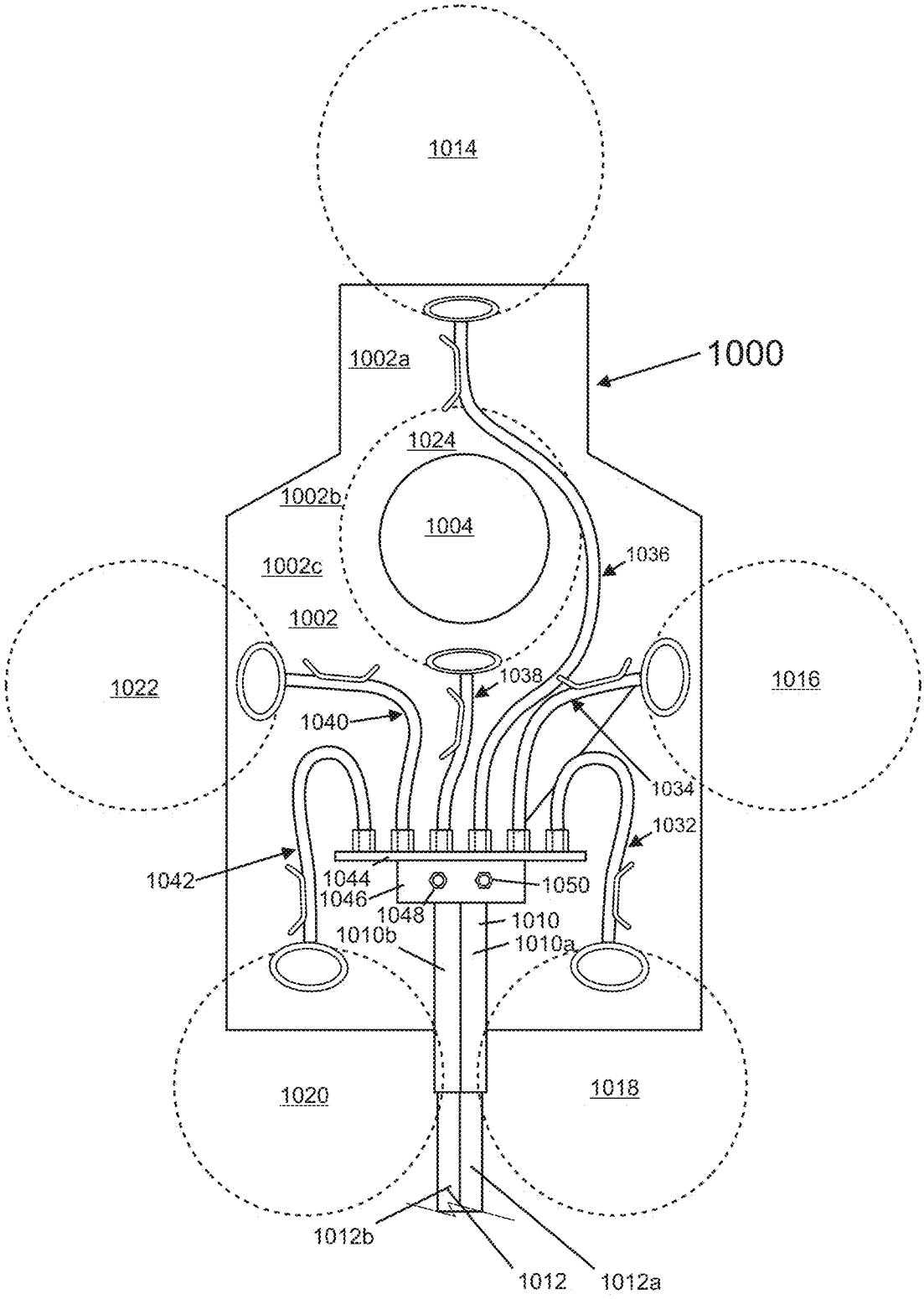
FIG. 27B shows a rear view of the fourteenth target apparatus of FIG. 27A, along with a plurality of balloons shown in dashed lines.

FIG. 27B shows a rear view of the target apparatus 1000 of FIG. 27A, along with a plurality of balloons 1014, 1016, 1018, 1020, 1022, and 1024 shown in dashed lines. The apparatus 1000 includes devices 1032, 1034, 1036, 1038, 1040, and 1042, plate 1044, plate 1046, and bolts or nuts 1048 and 1050, which may be similar or identical to the devices 802, 804, 806, 808, and 810, and (a sixth device for FIG. 27B that is identical to any of 802-810) plate 314, plate 316, and bolts or nuts 320*b*, and 320*a* shown in FIG. 25, except there are six devices for 1032-1942 and only five for 802-810 and some of the devices 1032-1042 may be of different from lengths from devices of 802-810.

The devices 1032, 1034, 1036, 1038, 1040, and 1042 hold balloons 1018, 1016, 1014, 1024, 1022, and 1020, in a manner similar or identical to as shown for steps of FIGS. 4A-4E. The bolts and/or nuts 1048 and 1050 fix the plate 1046 to the plate or member 1002.

Figure 27C:
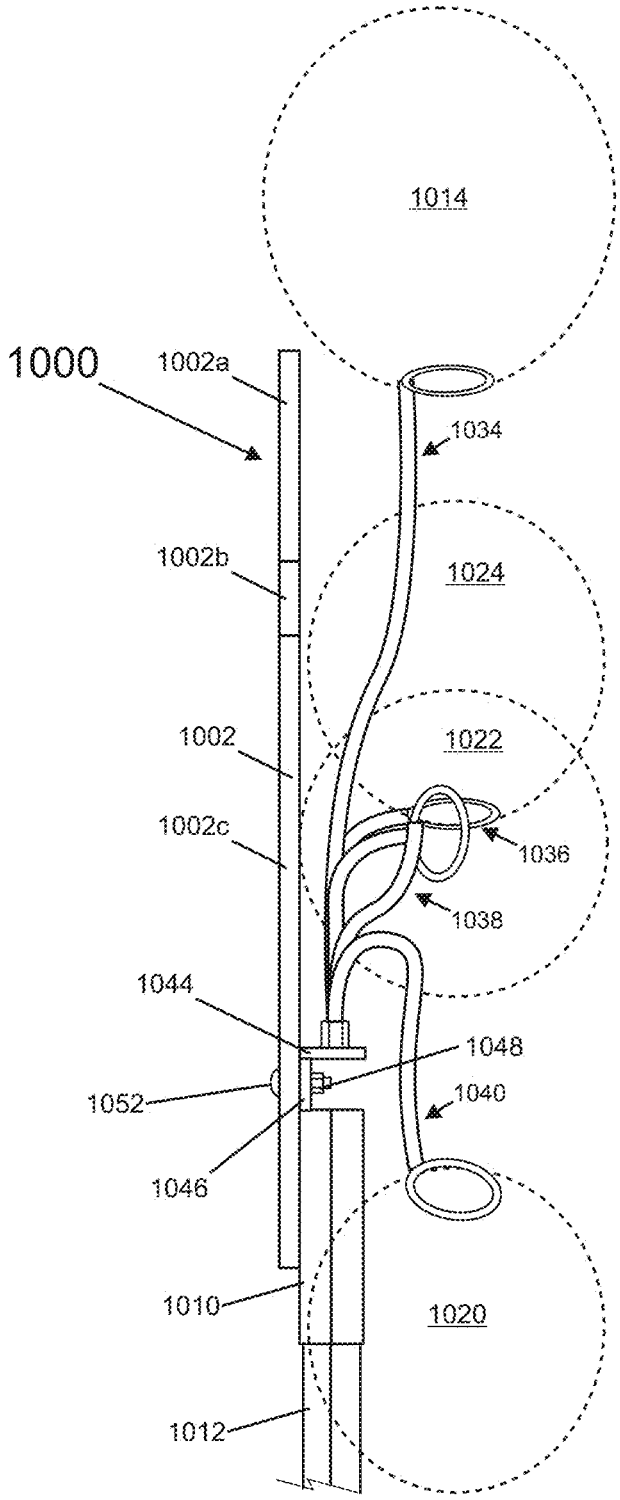
FIG. 27C shows a side view of the fourteenth target apparatus of FIG. 27A along with a plurality of balloons shown in dashed lines.

FIG. 27C shows a side view of the target apparatus 1000 of FIG. 27A along with a plurality of balloons, such as 1014, 1024, 1022, and 1020 shown in dashed lines, wherein the other balloons of FIG. 27A are not shown in this view. FIG. 27C shows the portions 1002*a*, 1002*b*, 1002*c* of the member or plate 1002. The member or plate 1044 and the member or plate 1046 are shown in FIG. 27C. A bolt 1052 is shown connected to a nut 1048 in FIG. 27C for fixing the plate 1046 to the plate 1002. There is another bolt, not shown, similar or identical to bolt 1052, which is connected to the nut 1050 of FIG. 27B, for fixing plate 1046 to plate 1002.

Figure 28A:
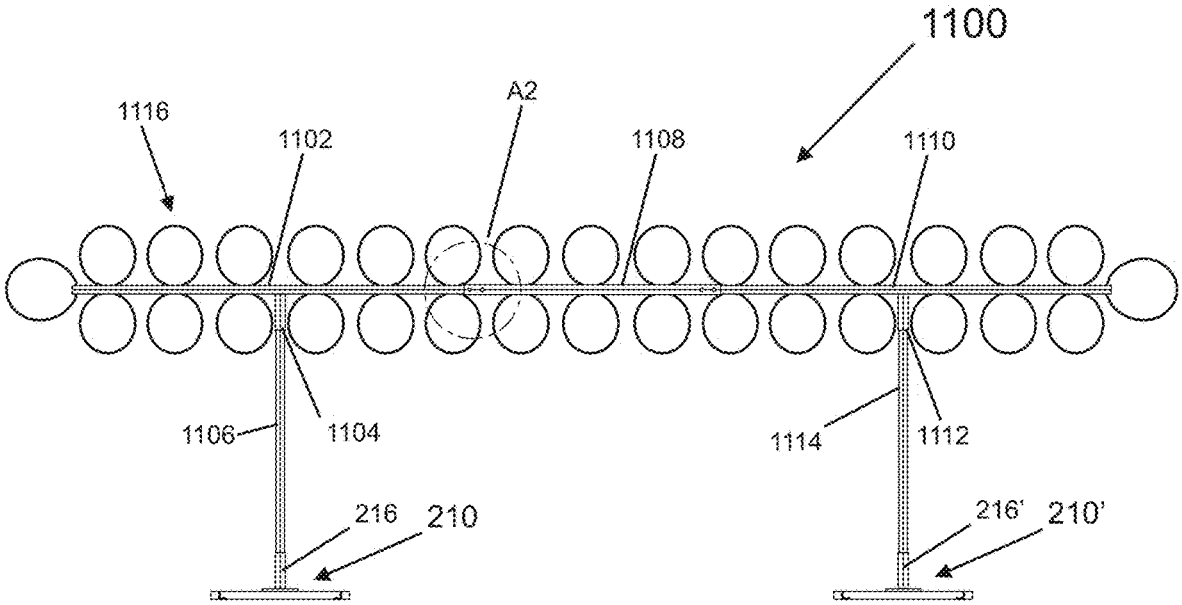
FIG. 28A shows a front view of a fifteenth target apparatus along with a plurality of balloons shown attached.

FIG. 28A shows a front view of a target apparatus 1100 along with a plurality of balloons 1116 shown attached. The apparatus 1100 includes L or V-shaped members 1102, 1104, 1106, 1108, 1110, 1112, and 1114. The apparatus 1100 further includes base 210 including member 216. The apparatus 1100 further includes base 210' and member 216' which may be similar or identical to base 210 and member 216, respectively.

Figure 28B:
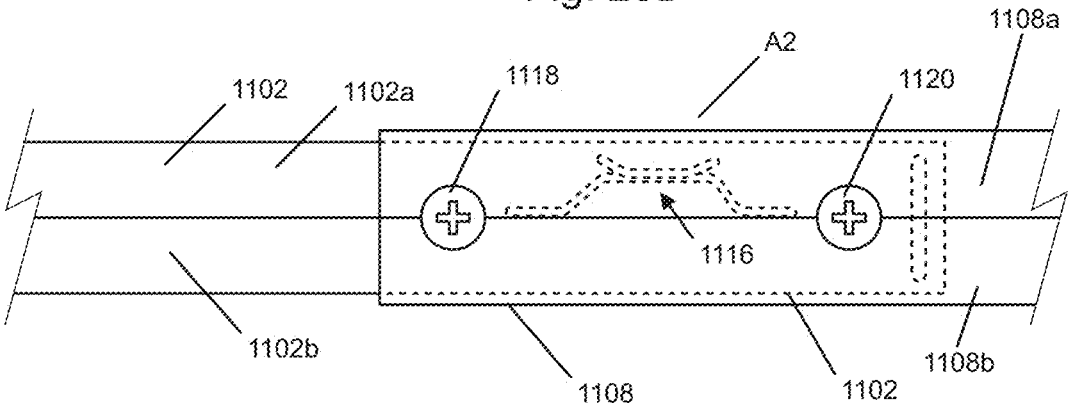
FIG. 28B shows a front closeup view of part of the fifteenth target apparatus, with portions that are not visible in the view, shown by dashed lines.
Figure 28C:
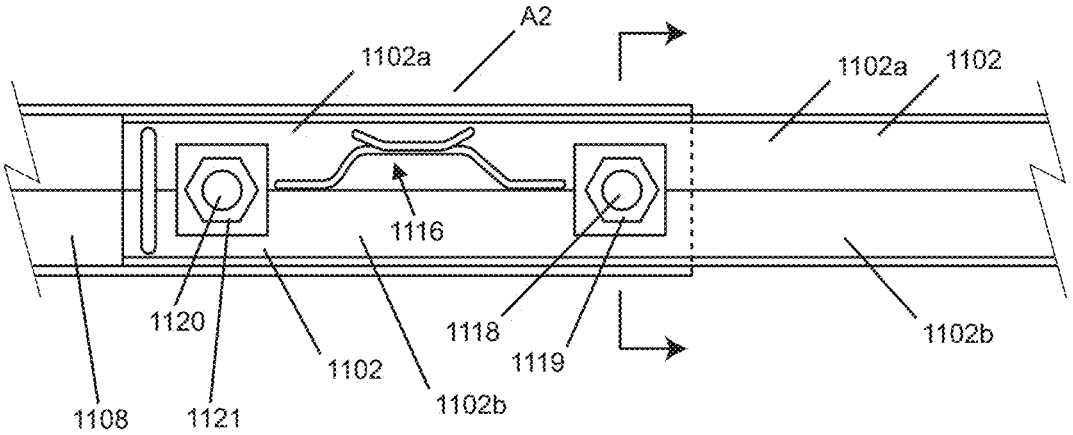
FIG. 28C shows a rear closeup view of part of the fifteenth target apparatus, with portions that are not visible in the view, shown by dashed lines.

FIG. 28B shows a front closeup view of part, identified by A2 in FIG. 28A, of the target apparatus 1100, with portions that are not visible in the view, shown by dashed lines. FIG. 28C shows a rear closeup view of the part identified by A2 of the target apparatus 100 shown in FIG. 28A, with portions that are not visible in the view, shown by dashed lines.

The member 1102 is connected to the member 1110 by the member 1108 in a manner shown by the area identified by A2 in FIGS. 28A-C. As shown by FIGS. 28B-C, a part of the member 1102 is fixed within a part of the member 1108 by screws or bolts 1118 and 1120. A cleat 1105, and a ring 1107, which may be identical to cleat or clear portion 22, and ring 28 of FIG. 2A, are fixed to the member 1102 for attaching a balloon in the manner shown by steps of FIGS. 4A-4E. The bolt 1118 may be fixed to connect plates 1102 and 1108 by or together with nut 1119 as shown in FIG. 28C. The bolt 1120 may be fixed to connect plates 1102 and 1108 by or together with nut 1121 as shown in FIG. 28C. There are a plurality of cleats, and a plurality or rings, similar or identical to cleat or cleat portion 1105, and ring 1107, which are not shown in FIGS. 28A-C. Each cleat or cleat portion, may for example provide for the connection of three or four balloons, in a manner similar or identical to that shown in FIG. 21B, for example, of the balloons 1116 shown in FIG. 28A.

Figure 28D:
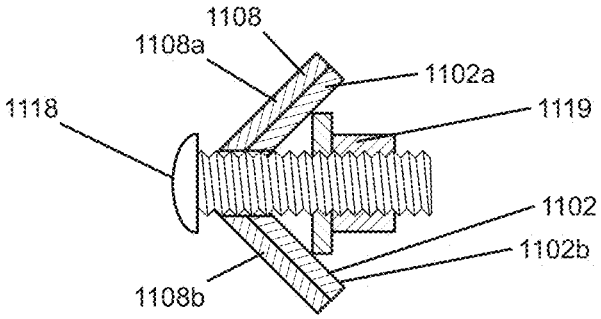
FIG. 28D shows a cross sectional view of part of the fifteenth target apparatus, including a connecting bolt and nut.

FIG. 28D shows a cross sectional view of another part of the target apparatus 1100, including a connecting bolt 1118 and a nut 1119, shown connected to L or V-shaped members 1108 and 1102. The L or V-shaped member 1108 includes members 1108*a* and 1108*b*, which are fixed at an angle with respect to each other, to provide for deflection of a projectile, such as a bullet; and the L or V-shaped members 1102 includes members 1102*a* and 110*b*, which are fixed at an angle with respect to each other, to provide for deflection of a projectile, such as a bullet.

Figure 29:
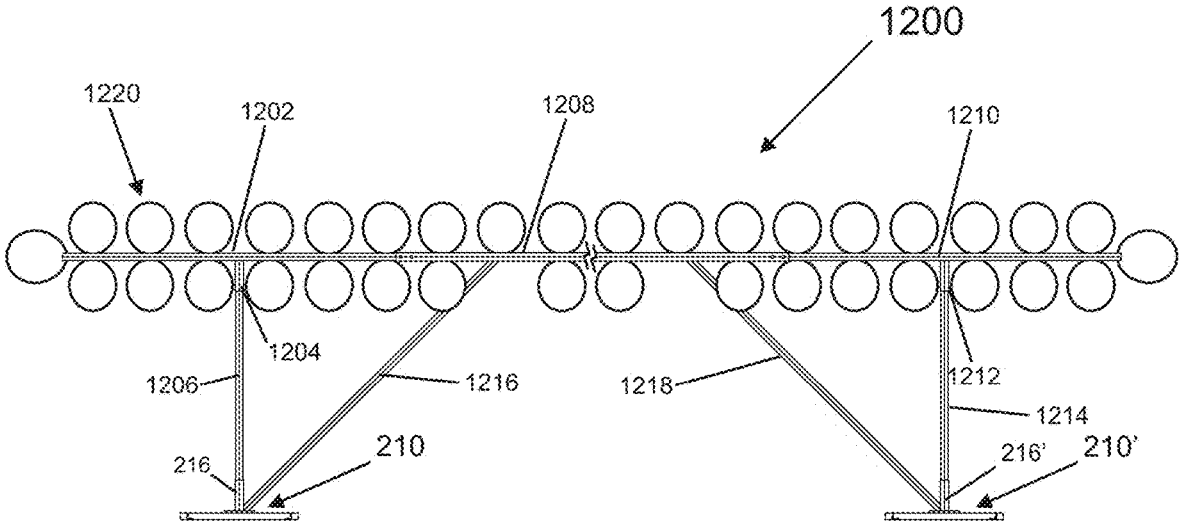
FIG. 29 shows a front view of a sixteenth target apparatus along with a plurality of balloons shown attached.

FIG. 29 shows a front view of a target apparatus 1200 along with a plurality of balloons 1220 shown attached. The apparatus 1200 may include L or V-shaped members 1202, 1204, 1216, 1208, 1218, 1210, 1212, and 1214. The target apparatus 1200 may also include the base 210 including member 216. The target apparatus 1200 may also include base 210' including member 216' which may be identical to the base 210 and member 216, respectively.

The members 1216 and 1218 provide extra support. The balloons 1220 may be connected to the appropriate members of members 1202, 1208 and 1210, through cleats, similar or identical to cleat or cleat portion 22, and rings, similar or identical to ring 28, in a manner similar or identical to that shown by FIGS. 4A-4E. The member 1208, is used to connect members 1202 and 1210 in a manner similar or identical to that shown for member 1108 connecting members 1102 to 1110 in FIGS. 28A-C.

Generally, from a front view, the exterior bottom of the V-shaped members (such as V-shaped member 1102, 1104, 1106, 1108, 1110, 1112, 114, 216, and 216' in FIG. 28A faces an individual who is shooting at a target apparatus, such as target apparatus 1100. Generally, from a rear view, the interior inside separate members of the V-shaped members are configured to allow a cleat or cleat portion, such a cleat 22 and ring, such as ring 28 to fit in the rear interior of the two members which form the V-shaped member, so that the cleat 22 and ring 28, for example are hidden from a front view, and are not damaged substantially by a projectile impacting the front or exterior bottom of the V-shape. A projectile coming from the front, i.e. towards the exterior bottom of the V-shape is deflected by the two angled members which make up the V-shaped members.

Generally, any of the cleat or cleat portions, such as 22, 32, 52, 62, 72, 82, 92, 102, 112, 122, and 132, and rings 28, 38, 58, 68, 78, 88, 98, 108, 118, 128, and 138, may be used as alternatives in any of the target apparatus shown.

Generally, when a higher powered firearm is to be used, the target apparatuses (not including the balloons), are typically entirely made of a hardened steel. However, when a lowered powered firearm is to be used, the target apparatuses (not including the balloons), may be made of a softer steel or a less hardened material.

In one or more embodiments, one or more cleats, wedges, or cleat apparatuses, or components thereof, including but not limited to cleat apparatuses 20, 30, 50, 60, 70, 80, 100, 110, 120, 130, 262, 302*b*, 636*a*, 762*a*, 802*b*, 902*b*, and 1116, eliminate having to tie one or more balloons to each of the cleats, wedges, or cleat apparatuses.

In one or more embodiments, each of the target apparatuses described previously (not including balloons) may be made of different types of steel, plastic, polymer, and/or any combination of such materials.

The embodiments of FIGS. 1, 13A-C, 14A-B, and 15A-C may be referred to or thought of as smaller targets with a smaller base.

The embodiments of FIGS. 16, 17A-C, 18A-B, 20A-B, 22, 23A-C, 24A-d, 27A-C, 28A-D, and 29 may be referred to or thought of as larger targets with a larger base.

Generally, one or more target apparatuses of the present invention and/or one or more cleats or cleat apparatuses of the present invention, may be provided as add-ons, and/or may be attached onto existing known targets, such as existing known steel targets. For example, embodiments, including, but not limited to that shown in FIGS. 2A-B, 3A-C, 5, 6A-B, 7, 8, 9, 11, 12, 19, 25, 26 may be attached as an add on to existing known targets, such as existing known steel targets. As an example, plate 916 shown in FIG. 26 may be fixed as an add-on onto an existing steel target using bolts 916*a-b* and nuts 920*a-b*, to fix the entire apparatus 900 of an embodiment of the present invention, onto an existing known steel target. Similarly apparatus 800 of an embodiment of the present invention may be fixed onto a known steel target by fixing plate 316 onto the known target by using bolts 322*a* and 322*b* and corresponding nuts 320*a* and 320*b*.

In one or more embodiments, multiple balloons, such as up to six ballons may be attached to any one of a single cleat, wedge, or part, such as any one of cleats or wedges 24, 34, 54, 64, 74, 84, 104-105, 114, 124, 134, 262, 302*b*, 636*a*, 762*a*, 802*b*, 902*b*, and 1116.

In at least one embodiment of the present invention, a low velocity projectile may be a projectile traveling at a speed of one thousand feet per second, or less. Examples of a low velocity projectile may include an air soft pellet, a BB gun pellet, some types of rimfire, rifle, and/or handgun ammunition and/or cartridges.

In at least one embodiment of the present invention, a medium velocity projectile may be a projectile traveling at a speed between one thousand to two thousand feet per second. Examples of a medium velocity projectile may include some rimfire rifle, or handgun cartridges or ammunition.

In at least one embodiment of the present invention, a high velocity projectile may be a projectile traveling at a speed of two thousand feet per second (fps), or more. Examples would be high powered rifle cartridges.

In at least one embodiment of the present invention, the use of certain projectiles determines which type of steel is used, and the thickness of the particular steel for the particular target apparatus.

The particular types of steel are typically broken into two types: (a) soft and/or mild steel, and (b) hardened steel.

In at least one embodiment, soft and/or mild steel is typically intended for all low velocity projectiles, and is solely dependent upon target shape/structure and user safety awareness.

In at least one embodiment, hardened Steel is specifically intended for medium to high velocity projectiles.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A target apparatus comprising:

a base;

a first V-shaped member having a first end and an opposing second end, wherein the opposing second end is connected to the base;

a first plate having a front surface and an opposing rear surface, wherein the first plate is connected to the first V-shaped member at the first end of the first V-shaped member;

a first cleat connected to the rear surface of the first plate;

wherein the first V-shaped member includes a first member and a second member;

wherein the first member has a first edge and a second edge;

wherein the second member has a first edge and a second edge;

wherein the first edges of the first and second members are fixed together;

wherein the second edges of the first and second members are separated by a gap; and wherein the first plate is connected to the first V-shaped member so that when the rear surface of the first plate is visible, the gap is visible, and when the front surface of the first plate is visible, the gap is not visible.

2. The target apparatus of claim 1 further comprising a motor fixed to the rear surface of the first plate;

and wherein the first cleat is connected to a shaft of the motor, and the first cleat is configured to rotate with respect to the first plate when the shaft of the motor rotates.

3. A target apparatus comprising:

a base;

a first flexible member, wherein the first flexible member has a first end and a second opposing end, with the second opposing end is adapted to be removably attached to the base at a first location;

a first cleat connected to the first flexible member; and a first ring connected to the first flexible member closer to the first end of the first flexible member than the first cleat.

4. The target apparatus of claim 3 further comprising a second flexible member, wherein the second flexible member has a first end and a second opposing end, with the second opposing end of the second flexible member is adapted to be removably attached to the base at a second location, while the second opposing end of the first flexible member is simultaneously removably attached to the base at the first location;

a second cleat connected to the second flexible member; and a second ring connected to the second flexible member closer to the first end of the second flexible member than the second cleat.

5. The target apparatus of claim 3 further comprising a first plate having a front surface and an opposing rear surface; and wherein the base is fixed to the rear surface of the first plate.

6. The target apparatus of claim 5 further comprising a first V-shaped member having a first end and an opposing second end; and wherein the first V-shaped member includes a first member and a second member;

wherein the first member has a first edge and a second edge;

wherein the second member has a first edge and a second edge;

wherein the first edges of the first and second members are fixed together;

wherein the second edges of the first and second members are separated by a gap; and wherein the first end of the first V-shaped member is fixed to the first plate so that the rear surface of the first plate is visible when the gap is visible and when the first cleat is visible, and the front surface of the first plate is visible when the gap is not visible, and the first cleat is not visible.

* * * * *